US005455667A

United States Patent [19]

Hiroi et al.

[11] Patent Number: 5,455,667

[45] Date of Patent: Oct. 3, 1995

[54] SHEET HANDLING APPARATUS WITH PLURAL SHEET STORAGE UNITS

[75] Inventors: Masakazu Hiroi, Yokohama; Masataka Naito; Norifumi Miyake, both of Kawasaki; Tomohito Nakagawa, Matsudo, all of Japan

[73] Assignee: Canon Kabushiki Kaisha, Tokyo, Japan

[21] Appl. No.: 120,922

[22] Filed: Sep. 15, 1993

[30] Foreign Application Priority Data

Sep. 16, 1992 [JP] Japan ..... 4-270780

[51] Int. Cl.[6] ..... G03G 21/02

[52] U.S. Cl. ..... 355/309; 355/321; 271/288

[58] Field of Search ..... 355/308, 309, 355/313, 321, 323; 271/3.1, 288

[56] References Cited

U.S. PATENT DOCUMENTS

| | | | |
|---|---|---|---|
| 4,522,486 | 6/1985 | Clark et al. | 355/323 |
| 4,544,148 | 10/1985 | Kitajima et al. | 271/3.1 |
| 4,607,948 | 8/1986 | Naito | 355/24 |
| 4,757,356 | 7/1988 | Garofalo | 355/323 |
| 4,854,571 | 8/1989 | Kitajima et al. | 271/293 |
| 4,900,009 | 2/1990 | Kitahara et al. | 271/296 |
| 4,917,364 | 4/1990 | Iida et al. | 270/37 |
| 4,928,941 | 5/1990 | Uto et al. | 270/53 |
| 4,930,761 | 6/1990 | Naito et al. | 270/53 |
| 4,941,657 | 7/1990 | Kitajima et al. | 271/293 |
| 4,965,629 | 10/1990 | Hiroi et al. | 355/50 |
| 4,986,520 | 1/1991 | Shido et al. | 270/53 |
| 5,011,130 | 4/1991 | Naito et al. | 271/288 |
| 5,035,412 | 7/1991 | Hiroi et al. | 270/53 |
| 5,042,793 | 8/1991 | Miyake | 271/293 |
| 5,104,106 | 4/1992 | Shido et al. | 270/53 |
| 5,110,104 | 5/1992 | Wakao et al. | 271/3.1 |
| 5,215,300 | 6/1993 | Hiroi et al. | 271/176 |
| 5,255,908 | 10/1993 | Hiroi et al. | 271/293 |

*Primary Examiner*—Joan H. Pendegrass
*Attorney, Agent, or Firm*—Fitzpatrick, Cella, Harper & Scinto

[57] ABSTRACT

A copying apparatus comprises an original support unit for supporting original sheets, an original transport unit for feeding the originals one by one from the original support unit to an exposure unit, and, after the exposure, discharging the originals to the original support unit, a circulation detecting unit for detecting one circulation of the originals by the original transport unit, a counter for counting the number of originals transported by the original transport unit, a copying unit for effecting exposure in the exposure unit, and copying the image of the exposed original onto a sheet, and a storage unit provided with plural storage devices for storing sheets subjected to the copying by the copying unit. The copying apparatus further comprises a control unit adapted to cause the original transport means to effect an operation of a first circulation of the originals, to cause the counter to effect an operation of counting the number of the originals, to cause the copying unit to effect an operation of copying the originals, and to cause the storage unit to store the copied sheets in predetermined storage devices, then to cause the original transport unit to effect an operation of a second circulation of the originals, and to cause the copying unit to effect an operation of copying the originals, and also adapted to vary the assignment of the storage devices for storing the copied sheets according to the counting result by the counter.

24 Claims, 49 Drawing Sheets

| FIG. 12A |
| --- |
| FIG. 12B |

| FIG. 15A |
| --- |
| FIG. 15B |

| FIG. 16A |
| --- |
| FIG. 16B |

| |
|---|
| FIG. 17A |
| FIG. 17B |
| FIG. 17C |

FIG. 35

| CASE NO. | VALUE OF BUNDLE THICKNESS h | RELATIONSHIP BETWEEN BUNDLE THICKNESS AND SHEET NUMBER | OUTPUT SIGNAL (POSITION DETECTION SENSOR 204) |
|---|---|---|---|
| I | h>h1 | h1=5mm (50 SHEETS OF ORIGINAL) | BEGINING OF APPLIED VOLTAGE TO SOLENOID 5V 0V |
| II | h2≦h≦h1 | 0.5～5mm (5 TO 50 SHEETS OF ORIGINAL) | 5V 0V |
| III | h<h2 | h2=0.5mm (5 SHEETS OF ORIGINAL) | 5V 0V |

| FIG. 36A | FIG. 36B |
|---|---|

SHEET HANDLING APPARATUS WITH PLURAL SHEET STORAGE UNITS

BACKGROUND OF THE INVENTION

1. Field of the Invention

The present invention relates to a sheet handling apparatus for storing sheets with plural sheet storage units.

2. Related Background Art

In the conventional image forming system consisting of an image forming apparatus (main body) connected with a recycling document feeder (RDF) and a sheet post-handling apparatus generally called a sorter, the operation of sorting a predetermined number of copy sheets prepared from a certain number of originals is achieved by placing the originals on the tray of RDF, selecting a sorting mode by a key of the main body, entering the required number of copies and depressing the copy start button. In response the lowermost (or uppermost) original is separated from the stacked originals, supplied onto the platen glass of the main body and is scanned by a number of times corresponding to the entered number of copies, whereby the copies of the required number are prepared. The prepared copy sheets are distributed, in succession, in the storage bins of a corresponding number in the sorter, starting from the first bin thereof. The above-explained operations are repeated for the number of originals, thereby achieving the sorting operations of the copies of the entered number.

Such conventional configuration may, however, run into a difficulty if the maximum number of originals that can be placed on the RDF does not coincide with that of sheets acceptable in each bin of the sorter, for example, in case a system with an RDF capable of accepting more than 50 originals is connected with a sorter of which each bin can store 50 sheets at maximum. No problems will arise as long as the number of the set originals does not exceed 50 since it is within the storage capacity per bin of the sorter. However, if the number of the originals exceeds 50, control means of the sorter sends a signal to the main body to inhibit the copying operation thereafter, when sheet counting means, such as a sheet sensor, in the sorter detects that the counted number of sheets has reached the maximum number, and the copying operations for the remaining originals can only be re-started by actuating the copy start button again after the copy sheets are removed from the bins of the sorter. Thus, the operator may find the copying operation being interrupted when he leaves the copying apparatus unattended and returns thereto after a sufficient time required for the copying, and is required to remove the copy sheets from the bins of the sorter and to temporarily store these copy sheets in a divided state, in order to re-start the copying operation. Moreover, after the remaining copying operation, there is required a cumbersome operation of matching the bundles of the temporarily stored copy sheets with those of the remaining copies, in order to obtain complete sets of the copies.

In order to prevent the above-mentioned situation, it is required to divide in advance the copying operation into two or more operations in such a manner that the number of the originals stacked on the RDF does not exceed the storage capacity per bin of the sorter, or to design the sorter in such a manner that the storage capacity per bin is at least equal to the maximum number of originals acceptable by the RDF.

In the former case, the number of the originals has to be known in advance. The originals can be counted by the operator or by the RDF, but this counting operation is required for each copying operation. For example, there can be conceived a method of requesting the operator to count and enter the number of the originals even for the originals of which number is evidently less than the maximum storage capacity per bin of the sorter, or a method of counting the originals by idle circulation of the RDF in advance, or a method, in case the number of the originals is identified as in excess of the maximum storage capacity per bin after such counting, of dividing the originals for effecting two or more copying operations or of storing the copy sheets in every other bin, in order to store the copy sheets in the adjacent empty bin when a bin becomes full, thereby accommodating a set of copy sheets in two adjacent bins. However, for executing such methods, there is always required a cumbersome operation of counting the originals in advance. Such operations involve a significant loss in time, so that an improved throughput cannot be expected in an automated system.

In the latter case, if the bins are designed with a limited space, an increase in the storage capacity per bin results in a reduced number of bins. As an example, if 20 bins capable of storing 50 sheets each can be provided in the given space, there can be provided only 10 bins capable of storing 100 sheets each. Consequently, the settable number of copies becomes limited for the frequently encountered number of originals, which is usually less than 50. This means that a new drawback is generated by resolving the above-mentioned drawback that the maximum settable number of originals exceeds the maximum storage capacity per bin of the sorter.

In this manner, the conventional configuration has been associated with various drawbacks such as the complication of the copying operation resulting from the fact that the number of originals is not known in advance, or the counting means for the number of originals being unacceptable due to the loss in time in the copying operation.

The original recycling systems can be generally classified into following three types.

A first type is the switch-back original feeding method, in which an original sheet is supplied from an original tray to an image reading position on a platen glass from an end thereof, then read by the movement of an image reading unit of the image forming apparatus after the sheet is placed in a predetermined position, and, after the image reading, the sheet is discharged through the same end of the platen glass to the tray.

In such method, the time required for sheet exchange (hereinafter called sheet exchange time), after the reading of the image of the sheet by the image reading unit, from the sheet discharge from the platen glass to the placing of a next sheet on the platen becomes long because there is involved a transport distance of about two sheets for the sheet discharge from the platen and the supply of the next sheet.

Consequently, in a high-speed image forming apparatus, since the between-sheet time (distance between the rear end of a sheet and the front end of a next sheet, divided by the process speed) becomes shorter with the increase in the speed, the productivity of the image forming apparatus in a 1-to-1 image formation (forming an image from a sheet) cannot be made 100% unless a relation [sheet exchange time]≦[between-sheet time] stands.

For this reason, the above-mentioned switchback method is generally considered unable to achieve a productivity of 100% in a high-speed image forming apparatus because of the long sheet exchange time.

However, such switchback method, being capable of feeding the originals from a direction close to the home position of the image reading optical system of the image forming apparatus, has the advantage that the distance from the original stacking tray to the feed position on the platen is relatively short, so that the time required from the start of separation of the sheet to the placement thereof on the platen glass and the time to the start of first copying can be shortened.

A second type is the feeding method with a closed-loop original feeding device. The sheet is fed to the image reading position on the platen glass from an end thereof, and, after image reading, it is discharged, depending on the sheet size, either from the same end of the platen glass to the sheet tray or from the opposite end of the platen glass to the sheet tray through a closed-loop sheet path. Thus, a large-sized (for example, A3) sheet is transported by the switchback method as explained above, but a small-sized sheet (for example, A4 or smaller) is transported through said closed-loop path.

Such closed-loop method can achieve high-speed sheet exchange in comparison with the switchback sheet feeding, because the sheet exchange only involves a transport distance corresponding to a sheet and a between-sheet distance. However, an increase in the transport speed may cause difficulty in controlling the precise stopping position, thereby resulting in more damage to the sheets due to sheet jamming, an increased size of the motor leading to a larger size of the apparatus, a higher cost thereof and an increased level of noise.

A third type is the document feeder capable of switchback feeding and non-stop image reading by a closed loop, in which so-called non-stop image reading is effected by fixing the image reading unit of the image forming apparatus and continuously transporting the original sheet for achieving a high-speed process.

In such non-stop image reading, the image reading has to be executed while the original sheet is transported from an end of the platen glass toward the other end, so there is provided another sheet feeding slot for feeding the originals from the opposite side to the switchback path, thereby enabling to feed the sheet to the image reading position from either end of the platen glass.

In such a document feeding device, the switchback feeding and the closed-loop non-stop image reading are both used for feeding the sheet from an optimum direction, according to the operation mode. Since control means is provided for switching the fixed sheet reading mode and the non-stop sheet reading mode, the sheet exchange time can be made equal to or less than the between-sheet time of the image forming sheets in the image forming apparatus, by employing the non-stop image reading mode for a 1-to-1 copying operation with a half original size or smaller. Consequently, such a document feeder, even on a high-speed image forming apparatus, can achieve a productivity of 100% without sacrificing the copying speed in a 1-to-1 copying operation for a half-sized sheet, namely without requiring a high-speed handling of the original sheets.

Also, in a 1-to-1 copying mode, a process ability same as mentioned above can be achieved by feeding the originals in continuation through the closed-loop path, which feeds the originals from the opposite direction.

Also, in the field of sorters, there have been proposed various sorters responding to the diversifying requirements of the users.

For example, certain users require to prepare a large number of copies from a relatively limited number of originals, while other users require to prepare a limited number of copies from a large number of originals. For the former users, there are required a large number of storage bins though the sheet storage capacity per bin is limited, while, for the latter users, many bins are unnecessary if the storage capacity per bin is high.

In order to accommodate these contradicting requirements, there are required a large number of bins each having a large sheet storage capacity, and such configuration eventually leads to the use of two sorters or a large-dimensioned sorter, giving rise to a high cost.

For example, in case of preparing a set of copies from a small number of originals (several originals or less), even if the image reading is conducted in the non-stop image reading mode in which the sheet exchange time is shortest, the advantage of such non-stop image reading (flow reading) does not become obvious, because the time to the start of the first copying operation is longer in the non-stop image reading path than in the switchback path or in the closed-loop path.

For this reason, if a document feeder capable of switchback feeding and non-stop image reading with a closed loop path is mounted on a high-speed image forming apparatus, in a 1-to-1 copying operation of preparing a copy only from a limited number of originals, the total copying time, from the actuation of the copy start button to the completion of the copying operation, is strongly influenced by the time required to the start of the first copying operation, and the total copying time may be shorter in the switchback mode which has a longer original exchange time than in the non-stop image reading mode.

Since such inconvenience cannot be recognized by the document feeder until all the originals placed thereon are recycled, such document feeder may result in a loss of productivity in case of preparing a copy only (or sometimes two copies) from a limited number of originals.

SUMMARY OF THE INVENTION

An object of the present invention is to provide a sheet handling apparatus which is not associated with the above-mentioned drawbacks.

Another object of the present invention is to provide an inexpensive sheet handling apparatus capable of smoothly sorting a predetermined number of copy sheets even when the number of originals exceeds the maximum storage capacity of each storage unit.

Still other objects of the present invention, and the features thereof, will become fully apparent from the following description, which is to be taken in conjunction with the attached drawings.

BRIEF DESCRIPTION OF THE DRAWINGS

FIG. 35 is a view showing states of thickness of the originals on the original tray 4;

DETAILED DESCRIPTION OF THE PREFERRED EMBODIMENTS

Figure 1:
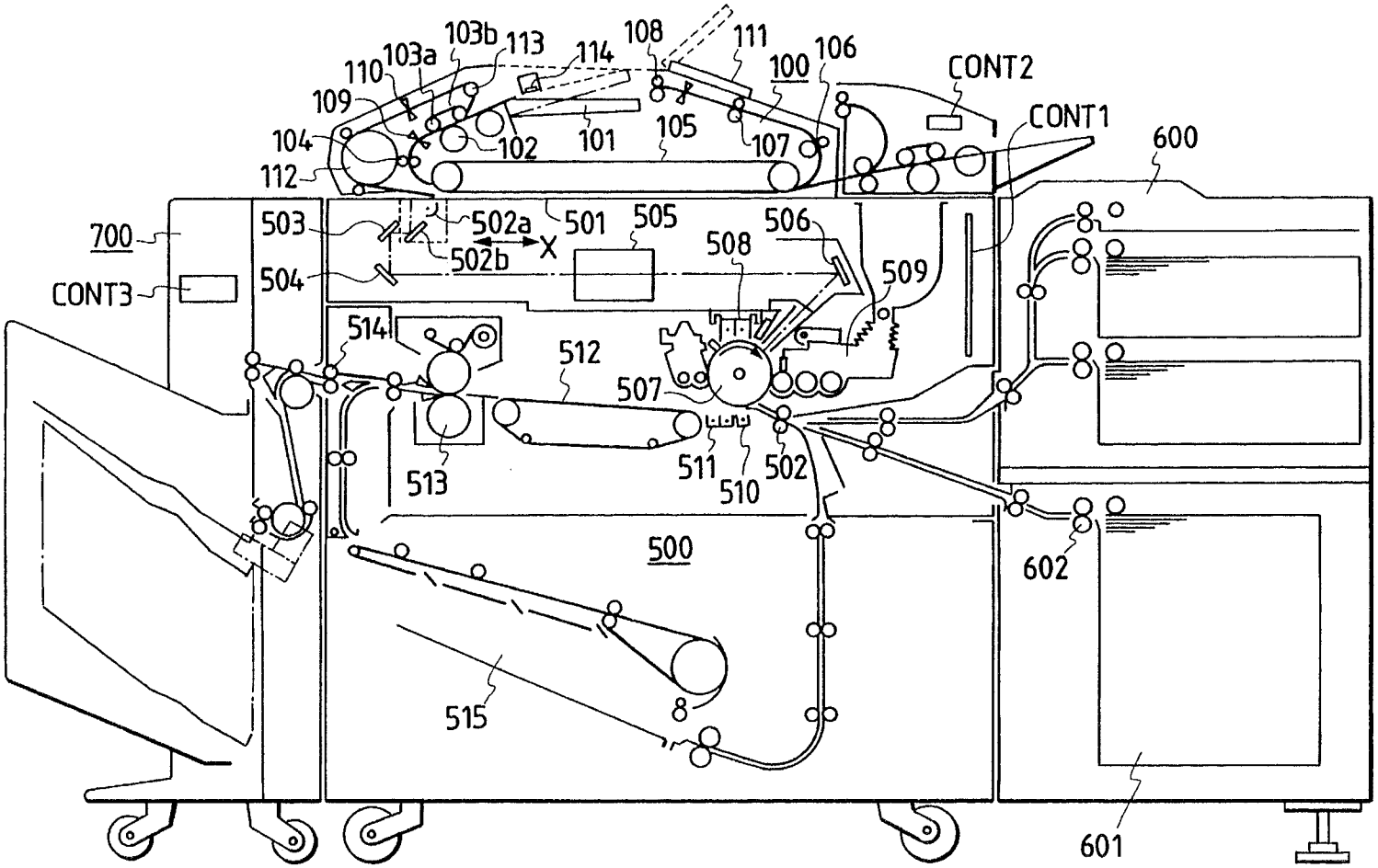
FIG. 1 is a cross-sectional view of an image forming system, constituting an embodiment of the present invention.

FIG. 1 is a cross-sectional view of an image forming system, constituting an embodiment of the present invention, wherein shown are a recycling document feeder (RDF) 100, and an original tray 101 capable of supporting plural originals, with the top faces thereof positioned upwards. A transport roller 102, in cooperation with paired separating rollers 103*a* and a separating belt 103*b*, separates and transports the lowermost one of the plural originals, and the separated original is subjected to skew correction and timing control by registration rollers 104, and is positioned on a platen glass 501 by a conveyor belt 105. The positioned original is scanned by a lamp 502*a* of an optical system, according to a predetermined process of a main body 500, and, after the scanning, it is discharged by a conveyor belt 105, intermediate transport rollers 106, 107 and tray discharge rollers 108 onto the originals stacked on the original tray 101. A main body controller CONT1 is capable of communicating with a controller CONT2 of the RDF 100 and a controller CONT3 of a sorter 700 and controls the main body, the RDF and the sorter according to control sequences stored in an unrepresented ROM and executed by an unrepresented CPU as will be explained later.

In the above-explained image forming system, while first sorting control means (controller CONT3 in this embodiment) sorts the copy sheets, prepared from the originals fed in a first cycle, into predetermined storage bins of the sorter 700, counting means (a counter of the controller CONT2 in this embodiment) counts the number of the originals fed in the first cycle. Thus, the counted number of the originals is compared with the sheet storage capacity of the remaining storage bins other than the predetermined storage bins, and, in the second and subsequent recycling of the originals, second sorting control means (controller CONT3 in this embodiment) sorts the sheets into plural storage bins, thereby enabling to sort the copy sheets of a desired number, prepared from the originals of which number exceeds the sheet storage capacity of each bin.

Also, the second sorting control means effects, in the second and subsequent recycling of the originals, the sorting of the copy sheets into two adjacent storage bins so as not to exceed the sheet storage capacity of each bin, thereby enabling to sort the copy sheets of a desired number, prepared from the originals of a number exceeding the sheet storage capacity of each bin, in an easily collectable manner.

Furthermore, the second sorting control means effects, in the second and subsequent recycling of the originals, the sorting of the copy sheets into two adjacent storage bins in substantially equal amounts, so as not to exceed the sheet storage capacity of each bin, thereby making the thicknesses of the divided bundles of sheets substantially uniform.

Furthermore, the second sorting control means effects, in the second recycling of the originals according to the output of the counting means, the sorting of the copy sheets corresponding to a same original into the storage bins of a predetermined number, selected in skipped manner according to the designated number of copies, thereby enabling, in a sorting mode, to sort the copy sheets in the proper order of pages, corresponding to the originals of a number exceeding the sheet storage capacity of each bin.

Furthermore, in the second and subsequent recycling of the originals, determination means (controller CONT2 in this embodiment) compares the number of storage bins to be used for sorting and the total number of storage bins excluding predetermined storage bins, thereby determining the maximum settable number of the originals, and correction means (controller CONT1 in this embodiment) automatically corrects the set number of an operation unit, based on the output of the determination means, thereby enabling efficient post-processing of the sheets of an optimum number, utilizing all the storage bins.

In the following, there will be explained the image forming process in the main body 500.

The original on the platen glass 501 is scanned by the reciprocating motion, in a direction x, of a scanning lamp 502*a* and a first mirror 502*b* integral therewith. The reflected light of the original is vertically inverted by a second mirror 503, a third mirror 504 and a lens 505, and is transmitted by a fourth mirror 506 onto a photosensitive drum 507, which is charged in advance by a primary charging wire 508, whereby a latent image is formed by the optical information from the optical system. A developing unit 509 deposits, by means of a sleeve, toner onto the charge remaining on the photosensitive drum 507. A sheet feeding unit 600 is provided, in this embodiment, with three cassettes and a manual feeding mechanism on top. Sheets stacked in a lowermost sheet storage unit 601 are fed by separation/transport rollers 602. The advanced sheet is subjected to skew correction and timing control by registration rollers 502 of the main body, then subjected to image transfer upon passing the photosensitive drum 507 and a transfer wire 510, further separated from the drum 507 by means of a separating wire 511, then transported by a conveyor belt 512 to a fixing unit 513, further subjected to image fixation by heat and pressure of fixing rollers, and is finally transported to the sorter 700 by discharge rollers 514. In case of multiple or two-side image formation, the sheet is transported again to the registration rollers 502 through an intermediate process unit 515.

Figure 2A:
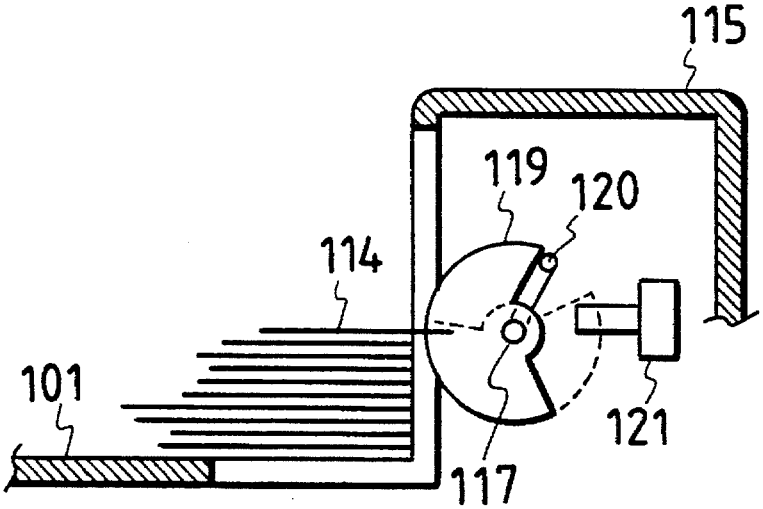
FIGS. 2A and 2B are partial cross-sectional views showing a partition mechanism of an original tray, in a recycling document feeder shown in FIG. 1.
Figure 2B:
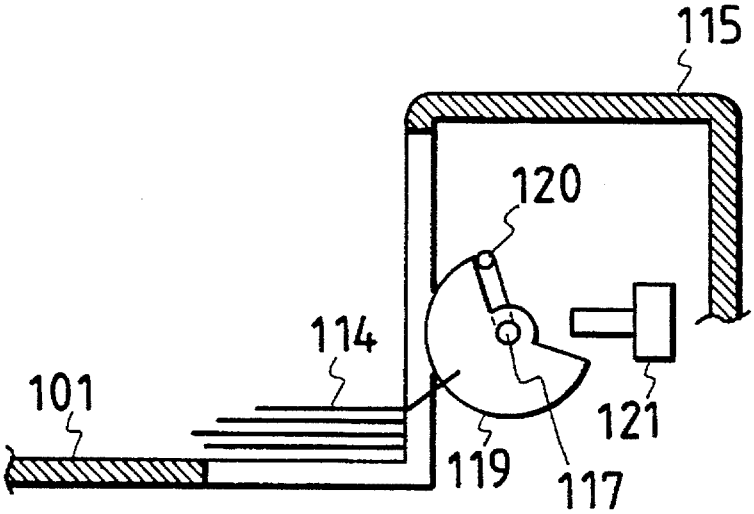

FIGS. 2A and 2B are partial cross-sectional views of a partition mechanism of the original tray 101 of the RDF 100 shown in FIG. 1, respectively with many originals and fewer originals.

On the shaft 117 of a partition member motor 115, there are provided a freely rotatable partition flag 119, and a partition lever 120 fixed on the shaft 117 and adapted to move the flag 119. As illustrated, the partition flag 119 is cut off in a part of the periphery, and bears a partition member 114, made of a flexible material such as polyester film or plate spring and rendered rotable integrally with the flag 119 about the shaft 117. The partition flag 119, having its center of gravity at the side of the partition member 114, stops at a position where the partition member 114 is positioned vertically below, when the member 114 is not placed on the stacked originals and it is not driven by the partition lever 120. A partition sensor 121 identifies the position of the partition member 114, by detecting the flag 119.

When the original tray 101 is fully loaded with original sheets P as shown in FIG. 2A, the distance from the contact position of the partition member 114 with the upper surface of the originals P to the mounting portion of the member 114 is short, so that the member 114 is not deformed and remains flat along the original sheets P.

On the other hand, when the original tray 101 is loaded with fewer original sheets P, a conventional more rigid partition member stops in a position where the end portion of the member contacts the surface of the original sheets P, so that the base portion of the partition member remains lifted from the surface, forming a gap thereto. As a result, the original sheet P discharged onto the partition member collides at the front end with the partition member, thus eventually being trapped by the member and not being stacked on the original tray in stable manner. On the other hand, the partition member 114 of this embodiment, being flexible, lies flat on the upper surface of the original sheets by the driving force of the partition lever 120, as shown in FIG. 2B.

In this manner the partition member 114 always lies flat on the upper surface of the stacked originals P regardless of the amount thereof, whereby the discharged originals do not collide with the member and can be stably stacked.

Figure 3:
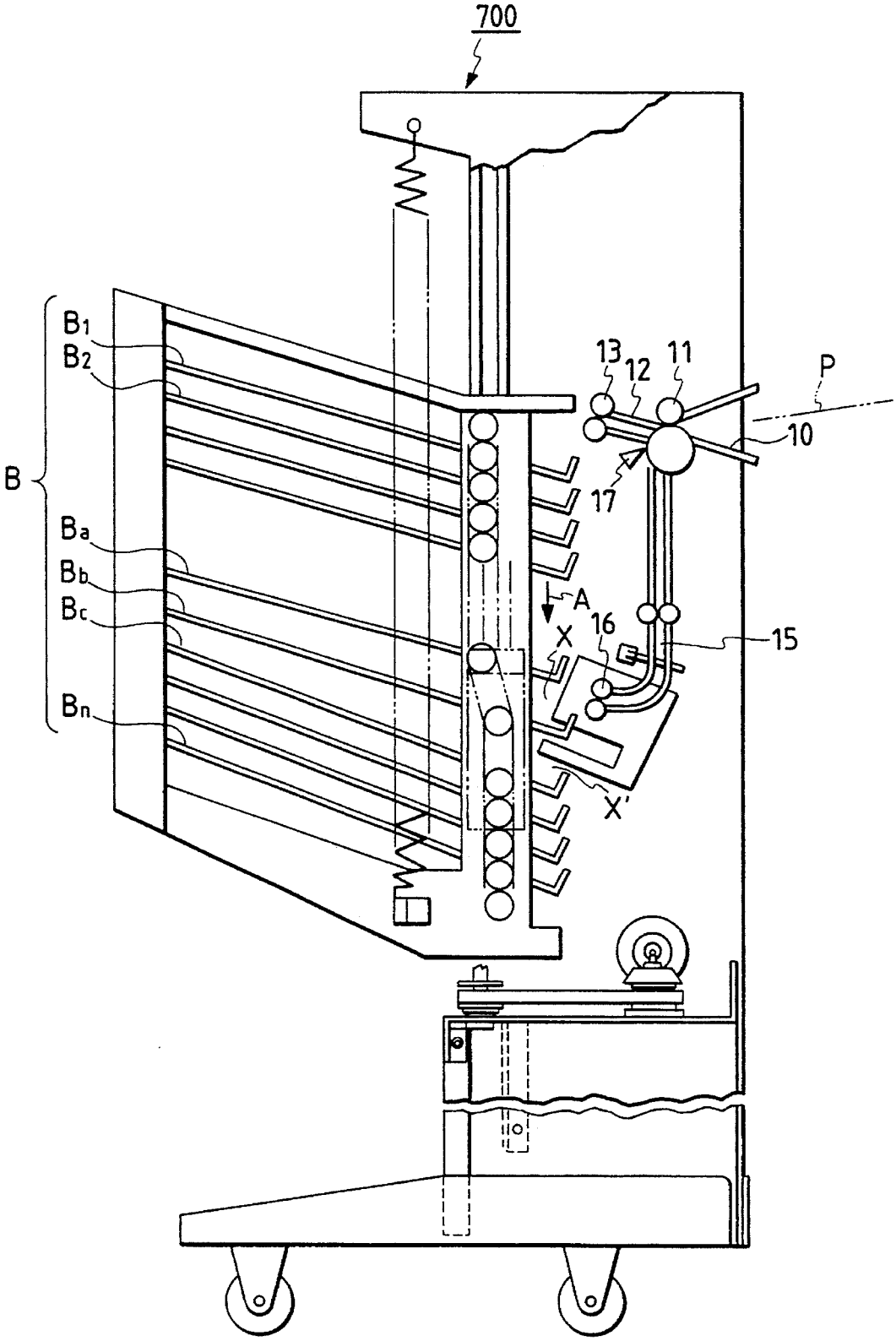
FIG. 3 is a cross-sectional view, showing the details of a sorter shown in FIG. 1.

FIG. 3 is a detailed cross-sectional view of the sorter 700, shown in FIG. 1, consisting in this case of a stapling sorter with movable storage bins.

The copy sheet, discharged from the discharge rollers 514 of the main body 500, is guided by fixed guide members 10, 12, 15 of the sorter 700, and is discharged into one of storage bins $B_1$–Bn, positioned at non-sorting discharge rollers 13 or sorting discharge rollers 16. After the discharge, the bins B are shifted upwards or downwards by an increment of a bin to accept a next sheet in an adjacent bin. The sorting of sheets into the storage bins is achieved by the repetition of this operation.

In the following there will be explained an image forming sequence when the recycling document feeder (RDF) and the sorter 700 are formed as a system.

For the use of understanding, the following specifications are assumed for the RDF 100 and the sorter 700. It is assumed that the RDF 100 can handle up to 100 originals at the same time, and, in the sorter 700, the uppermost (1st) bin can store more than 100 sheets, while each of the 2nd to 21st bins can store 50 sheets. These specifications match a copy system of a relatively large capacity.

Figure 4:
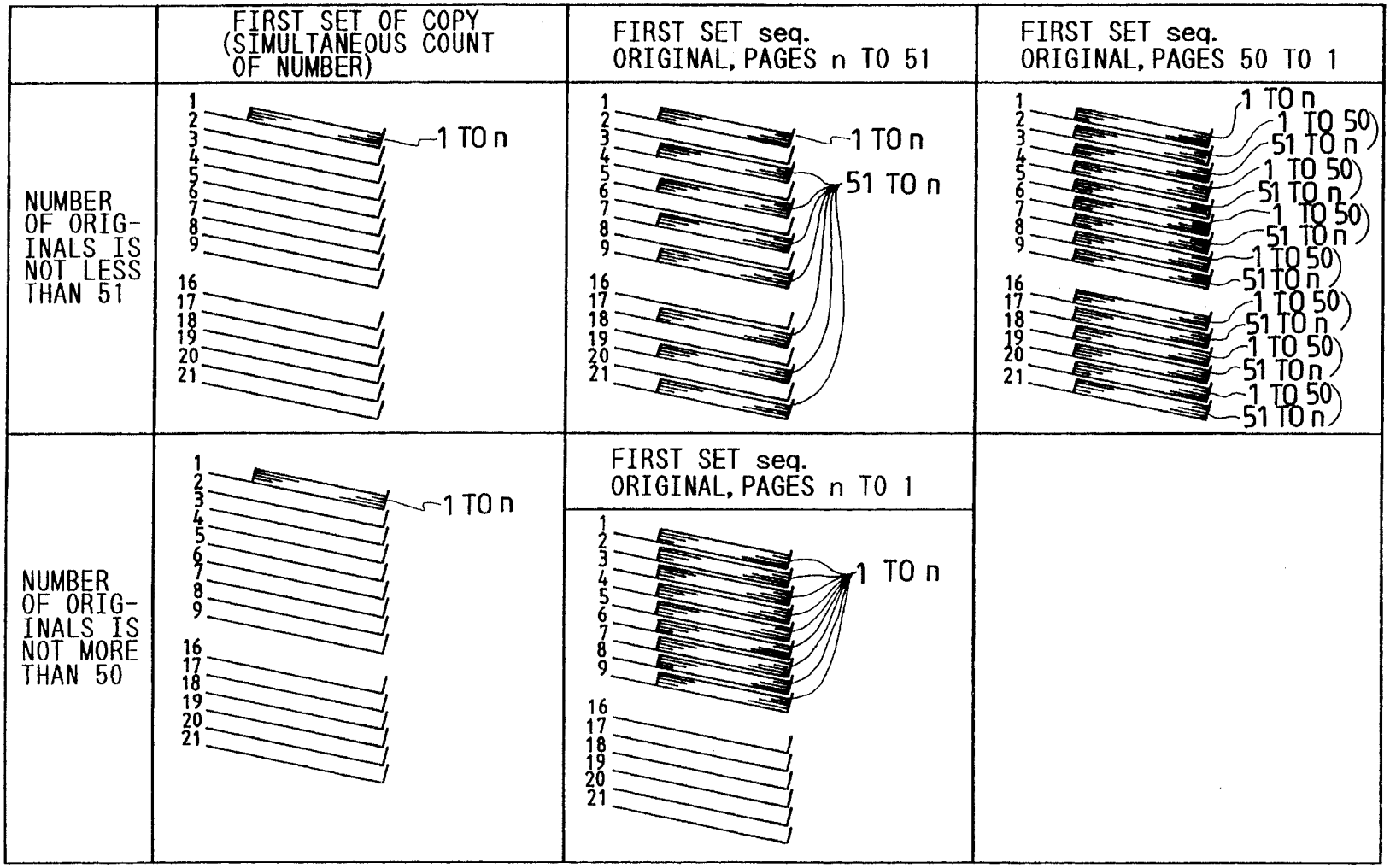
FIG. 4 is a schematic view, showing a first state of copy sheet sorting in the image forming system of the present invention.

In the following there will be explained the function of the sorter 700, with reference to sorting states shown in FIG. 4.

The operator places the originals on the original tray 101 of the RDF 100, and enters the operating mode and the number of copies into an unrepresented operation unit of the main body 500. In this state, the number of the originals is not known to the main body 500 nor to the operator unless it has been counted in advance.

In a conventional system including an image forming apparatus and a sorter, the originals are separated one by one from the bottom of the stacked originals and are subjected to a continuous copying operation for preparing the copies of the set number, and the sorter sorts these copies by stepwise movements of the storage bins. This operation is repeated until the originals are recycled by a complete cycle, and the copies of the set number are sorted in the storage bins.

As a result, the number of the originals is only recognized after the completion of these copying operations. Consequently, even when the number of the originals exceeds the maximum storage capacity of each bin, for example when 70 originals are placed, the sorting operation is continued, once the copying operation is initiated, even after the maximum storage capacity of each bin is exceeded. Thus, there eventually results a sheet jamming or a machine failure, or the copying operation is interrupted in an uncompleted state by an overstack signal generated by a sheet counting mechanism for each bin, when the maximum storage capacity is reached.

In contrast, in the present embodiment, there is at first adopted a mode of preparing a copy (1+01 copy) regardless of the set copy number, whereby the copying operation is started from the bottom of the originals stacked on the original tray 101 to prepare a copy from each original, until the originals are recycled by a complete cycle, with the counting of the number of the originals.

The RDF 100 is provided with a separation sensor 109, a registration sensor (not shown), a switchback sheet discharge sensor 110 and a closed-loop sheet discharge sensor 111. Small-sized originals (for example, A4 or B5 size) separated in the separation unit, are fed along an anticlockwise path as explained before, through the platen glass 501, intermediate transport rollers 106, 107 and discharge rollers 108 and returned to the original tray 101, and the returned originals are detected in succession by the closed-loop sheet discharge sensor 111 and are thus upcounted.

Also, large-sized originals (for example, A3 or B4 size) are fed to the platen glass 501 through a same path as in the closed-loop feeding, and are then returned to the original tray 101 through a return roller 112 and switchback sheet discharge rollers 113. The returned originals are detected in succession by the switchback sheet discharge sensor 110. At the side of the original tray 101 there is provided a partition member 114 for indicating the boundary between the initially stacked originals and those returned after scanning, and a complete cycle of the originals can be detected by a partition sensor 121 detecting a rotation of said partition member. At the completion of the cycle, the copying operation of a copy each and the counting of the originals are terminated, and, if the counted number of originals does not exceed 50, and, in the 2nd cycle, the copy sheets are sorted into the 2nd to n-th bins with the home position at the 2nd bin, as illustrated in the lower part of FIG. 4. More specifically, each original is subjected to a continuous copying operation for the set copy number (set copy number minus one in this embodiment, because the 1st copy is already stored in the 1st bin in the 1+01 copying operation), and the obtained copy sheets are sorted into the above-mentioned bins. After the sorting, the original is exchanged, and the above-mentioned copying operation is repeated.

In case the number of the originals exceeds 50, since the storage capacity of each bin in the sorter 700 is 50, there is adopted a skipped sorting mode in which the copy sheets are sorted in every other bin so as to store the copy sheets of a copy in two adjacent bins, in the 2nd cycle of the originals. In more detail, the copy sheets corresponding to the last page to the 51st page of the originals are skip sorted in the 3rd, 5th, 7th, . . . bins, and those corresponding to the 50th to 1st pages of the originals are skip sorted in the 2nd, 4th, 6th, . . . bins. In this manner the copy sheets corresponding to the entire originals can be obtained in the proper order of pages, by combining the sheets in the 2nd and 3rd, or 4th and 5th, or 6th and 7th bins as pair.

Figure 5:
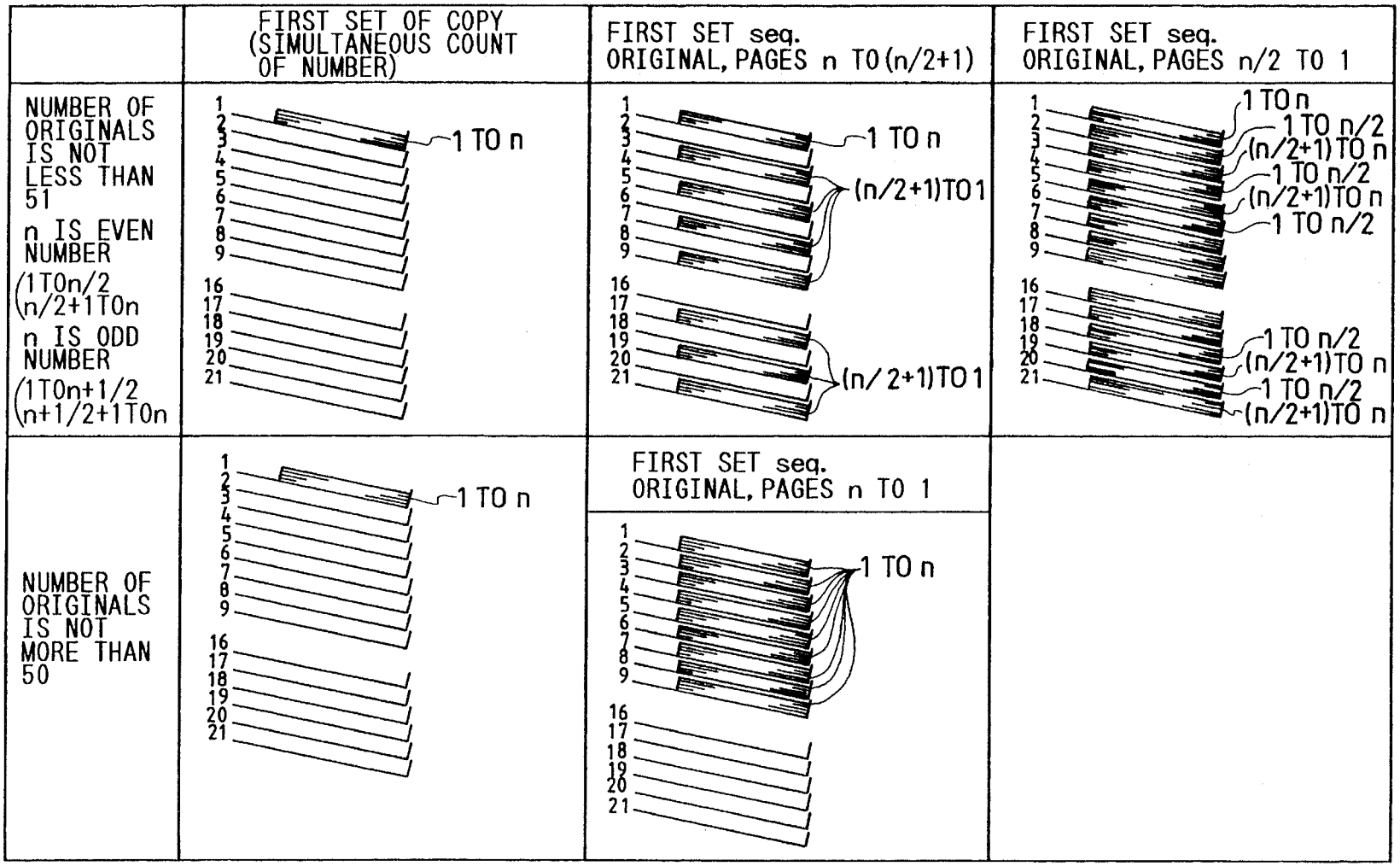
FIG. 5 is a schematic view, showing a second state of copy sheet sorting in the image forming system of the present invention.

In the foregoing description, if the number of the originals exceeds 50, the copy sheets of n-th to 51st pages are stored in the lower one of two adjacent storage bins, while those of 50th to 1st pages are stored in the upper one, but it is also possible, after counting the number of the originals in the first cycle thereof, to store the copy sheets from n-th page to {(n/2)+1} page in the lower one of two vertically adjacent storage bins, and to store those from (n/2)-th page to 1st page in the upper one, as shown in FIG. 5. Such equally divided storage in the bins ensures beautiful appearance of the copies when they are stapled on each bin.

In the foregoing embodiment, since the 1st bin alone can store more than 100 sheets, the sorting can be made up to 100 copies, by storing 100 sheets in the 1st bin and also 100 sheets in the 2nd and 3rd bins, 4th and 5th bins, or 6th and 7th bins taken as pairs. However, if the 1st bin of the sorter 700 can only store 50 sheets, namely if each of the 1st to n-th bins can only store 50 sheets, the copy sheets prepared in the first one-copy (1+01) copying operation are stored in the 2nd bin. If the originals complete a cycle while the copy sheets are stored in the 2nd bin, namely if the number of the originals does not exceed 50, the copy sheets prepared in the 2nd cycle of the originals are stored in the 1st, 3rd, 4th, 5th, . . . bins, skipping the 2nd bin. On the other hand, if the 2nd bin is filled in the course of the first cycle of the originals, namely if the number of the originals exceeds 50, the copy sheets from n-th page to (n–49)-th page are stored in the 2nd bin, and those from (n–50)-th page to 1st page are stored in the 1st bin. In this manner, the copy sheets corresponding to n originals (n>50) are stored in the 1st and 2nd bins. As the number of the originals can be recognized in this point, the copy sheets prepared in the 2nd cycle of the originals can be skip stored in every other bin, namely the copy sheets from n-th page to (n–49) page in the 4th, 6th, 8th, . . . bins and those from (n–50)-th to 1st page in the 3rd, 5th, 7th, . . . bins, whereby each set of copies can be obtained from the 1st and 2nd, 3rd and 4th, 5th and 6th, . . . bins taken in pairs.

Also, in case the RDF 100 can handle up to 150 originals at the same time, the copy sheets in the copying operation of the first cycle of the originals are stored in the 1st bin, corresponding to up to 50 originals. If the number of the originals exceeds 50, the copy sheets corresponding to subsequently 50 originals are stored in the 2nd bin. If the number of the originals exceeds 100, the copy sheets corresponding to subsequent originals are stored in the 1st bin. If the counted number of the originals does not exceed 50, the copy sheets prepared in the 2nd cycle of the originals are stored in the 1st, 2nd, 4th, 5th, . . . bins. If the counted number exceeds 50 but does not exceed 100, the copy sheets prepared in the 2nd cycle of the originals are stored, from the last page to 51st page in the 5th, 7th, . . . bins and from 50th to 1st pages in the 4th, 6th, . . . bins. In this case the 1st bin is not used. If the counted number exceeds 100 but does not exceed 150, the copy sheets in the 2nd cycle of the originals are stored, from the last page to 101st page in the 6th, 9th, . . . bins, from 100th page to 51st page in the 5th, 8th, . . . bins, and from 50th page to 1st page in the 4th, 7th, . . . bins.

Now, reference is made to FIGS. 6 to 14, for explaining a first original stacking control operation in the image forming system of the present invention.

[First original stacking control]

Figure 6:
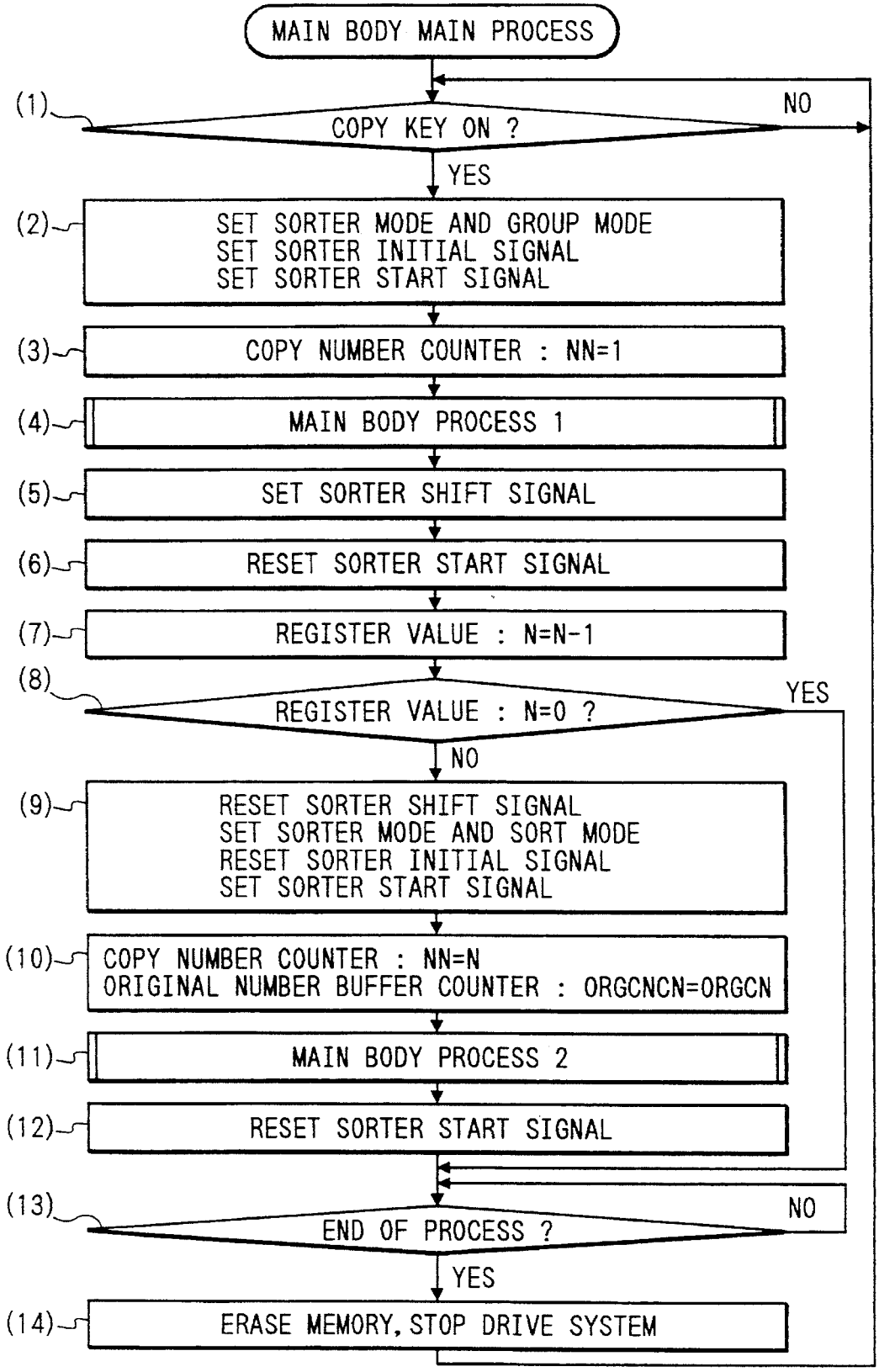
FIG. 6 is a flow chart showing an example of the main control sequence in the image forming system of the present invention.

FIG. 6 is a flow chart showing an example of the main control sequence in the image forming system of the present invention, wherein (1) to (14) indicate process steps.

At first there is awaited the actuation of the copy key for initiating the image forming operation (1), and, when the copy key is turned on, the operation mode of the sorter 700 is set (2). In this case there are set the group operation mode for storing a set of copy sheets in the uppermost bin B1 of the sorter 700, an initializing signal for the sorter 700, and a sorter start signal for starting the operation thereof (Detailed functions of the sorter 700 will be explained later). Then the count NN of a copy number counter, indicating the number of formed copies, is set at "1" (3). Then, there is executed a main body process-1 routine, to be explained later (4). The main body process-1 executes image formation of a number set by the copy number counter, for each of the originals placed on the RDF 100, by feeding an original onto the platen glass, effecting a copying operation-once for the original, then discharging the original from the platen glass to the original tray 101, and repeating these operations for all the originals. The main body process-1 routine effects a cycle of the originals present on the RDF 100 and simultaneously counts the number of the originals.

Then, a sorter shift signal is set (5), and the sorter start signal is reset (6). In this manner, the copy sheets of a set, prepared corresponding to the originals placed on the RDF 100, are stored in the uppermost storage bin of the sorter 700.

Then, the copy number "1" is subtracted from the set copy number N (N←N−1) (7), and there is discriminated whether thus subtracted number is "0" (8). If 0, the sequence proceeds to a step (13) to terminate the processes in the main body 500 and in the accessory devices. Then executed are post-processes for clearing the memories and stopping the driving systems (14), and the sequence returns to the step (1).

On the other hand, if the discrimination of the step (8) turns out negative, the sorter shift signal is reset, and the operation mode for the sorter 700 is set, in order to execute the remaining copying operations. In the present case, in order to store the copy sheets in the succeeding storage bins of the sorter, there is selected the sorting mode. Also, the initializing signal for the sorter 700 is reset, and the sorter start signal for starting the function of the sorter is set (9). Then, the remaining copy number N is substituted in the count NN of the copy number counter, and the value of an original counter ORG, counted in the main body process-1, is substituted in an original number buffer counter ORGCNCH (10). Then, there is executed a main body process-2 routine as will be explained later (11). The main body process-2 routine executes copying operations by a copy number set by the copy number counter, for the originals placed on the RDF 100, by feeding an original onto the platen glass, effecting the copying operations for the set copy number for the original, then discharging said original from the platen glass to the original tray 101, and repeating these operations for all the originals. As the sorter 700 is in the sorting mode, the copy sheets prepared in succession from a same original are stored in respectively different bins. After this main body process-2 routine, the sorter start signal is reset (12), then the process of the main body 500 and the accessory units is terminated (13), also there is executed a post-process for clearing various memories and stopping the drive systems (14), and the sequence returns to the step (1).

Figure 7:
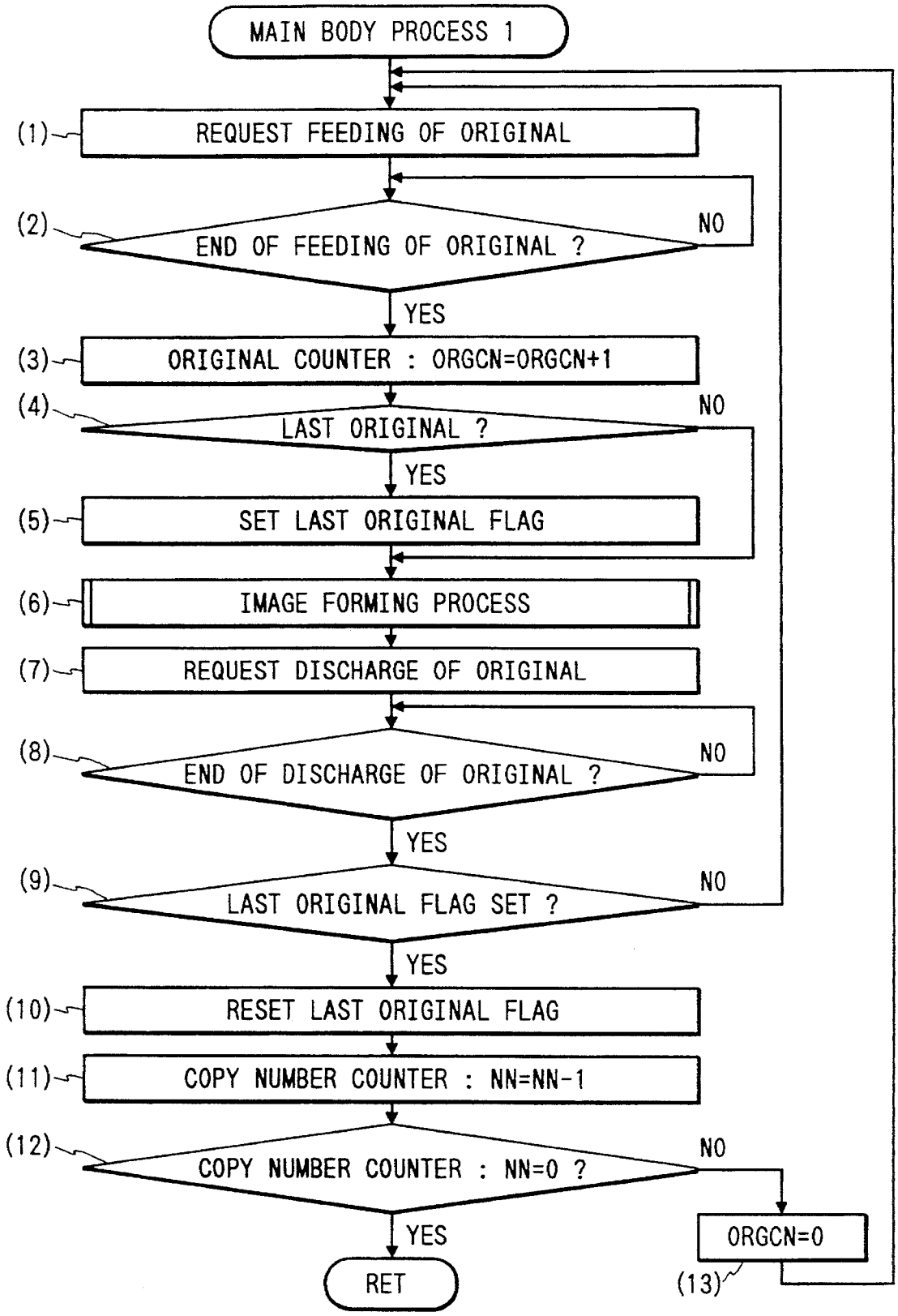
FIG. 7 is a flow chart showing the details of a main body process 1 routine shown in FIG. 6.

FIG. 7 is a flow chart showing the details of the main body process-1 routine shown in FIG. 6, wherein (1) to (13) indicate process steps.

At first a request is sent to the RDF 100 for feeding an original onto the platen glass (1), and, after the original feeding (2), and an increment is executed in the original counter ORGCN for counting the originals (3). Then, there is discriminated whether the fed original is the last one (4), and, if not, the sequence proceeds to a step (6), but, if the last one, there is set a last original flag on the memory (5). Then, there is executed an image forming routine for the original placed on the platen glass (7). Though the details are omitted, the image formation includes a copy sheet feeding from the sheet feeding unit in the main body 500, an image formation by a known image forming method, and a sheet discharge to the sorter 700. After the image formation, a request is sent to the RDF 100 for original discharge (7), and the completion of the original discharge is awaited (8). After the completion of the original discharge, there is discriminated whether the last original flag is set (9), and, if not, the sequence returns to the step (1). If set, the last original flag is reset (10), then the count NN of the copy number counter is decreased by "1" (11), and there is discriminated whether thus decreased value is "0" (12), and, if zero, the sequence returns to the main routine. If not, the count of the original counter ORGCN (provided in the controller CONT2) is cleared (13) and the sequence returns to the step (1) for repeating the image formation once for every original, until the last original is detected. At the same time, the number of the originals is counted by the original counter ORGCN.

Figure 8:
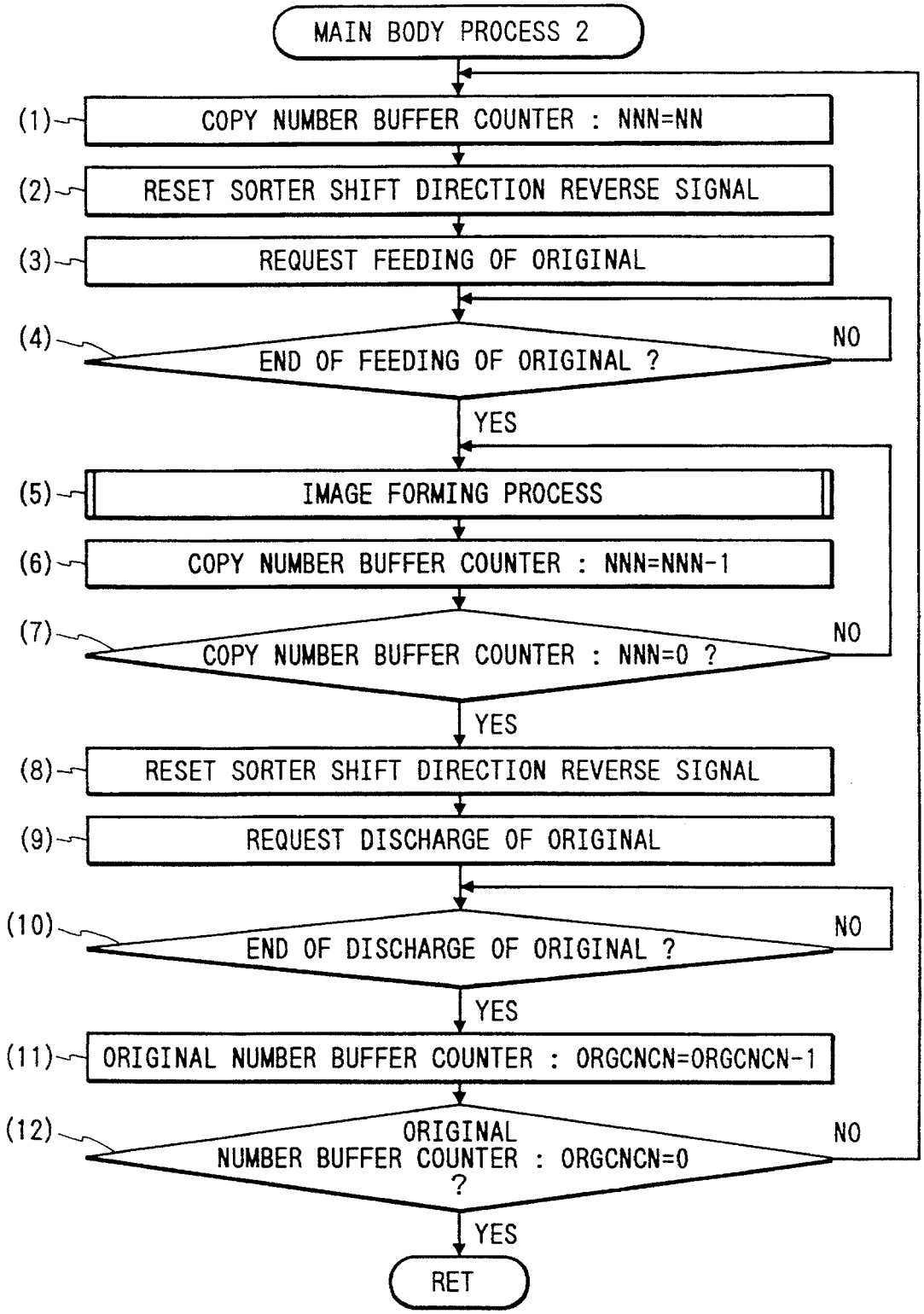
FIG. 8 is a flow chart showing the details of a main body process 2 routine shown in FIG. 6.

FIG. 8 is a flow chart showing the details of the main body process-2 routine shown in FIG. 6, wherein (1) to (12) indicate process steps.

At first the count of the copy number counter NN is substituted in the copy number buffer counter NNN (1), and a sorter shift direction inverting signal is reset (2). Then a request is sent to the RDF 100 for original feeding onto the platen glass (3), and the completion of the original feeding is awaited (4). Upon completion of the original feeding, the image forming routine is executed (5), then the count of the copy number buffer counter NNN is decreased by "1" (6), then there is discriminated whether said content has reached "0" (7), and, if not, the sequence returns to the step (5). If "0" has been reached, there is set a sorter shift direction inverting signal (8), and a request is released for the original discharge (9). Upon completion of the original discharge (10), the count of the original number counter ORGCNCN is decreased by "1" (11), then there is discriminated whether said count has reached "0" (12), and, if not, the sequence returns to the step (1). If "0" has been reached, the routine is terminated. In this manner image formations for the remaining number of copies are executed for every original, until the last original is detected.

Figure 9:
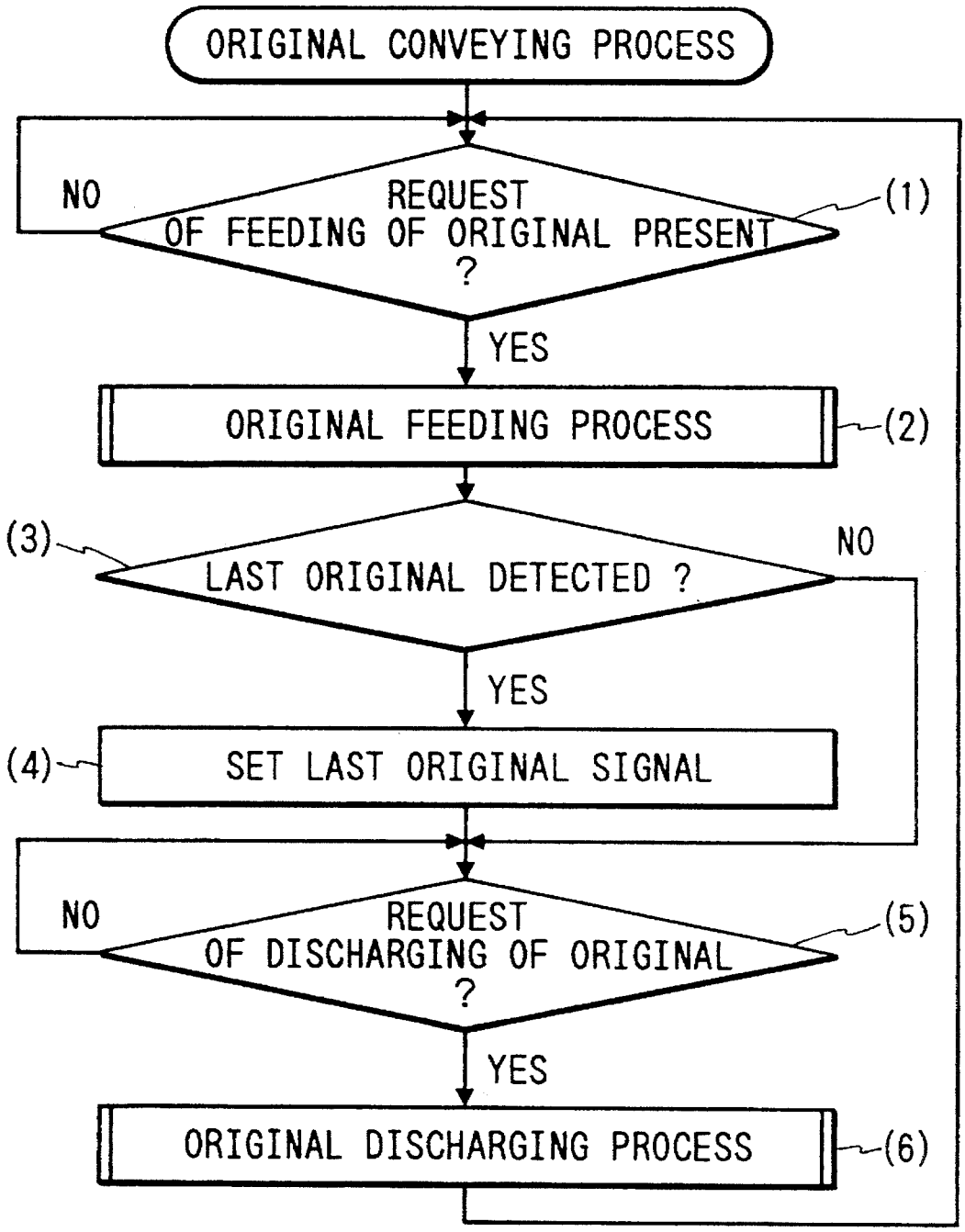
FIG. 9 is a flow chart showing an example of the original transport control sequence of the recycling document feeder shown in FIG. 1.

FIG. 9 is a flow chart showing an example of the original transport control sequence of the RDF 100 shown in FIG. 1, wherein (1) to (6) indicate process steps.

At first, there is discriminated whether a request for original feeding has been issued (1), and, if issued, an original feeding routine is executed (2). In the present embodiment, the original feeding routine is to separate one from the originals placed on the original tray 101 of the RDF 100, to feed the separated original onto the platen glass of the image forming apparatus and to stop it at an arbitrary image reading position, but the detailed description will be omitted.

Then, there is discriminated whether the feeding of the last original has been detected from the output of a sensor (3), and, if not, the sequence proceeds to a step (5). If detected, a final original signal is set (4), and, if a request for original discharge has been-released (5), the original is discharged (6) and the sequence returns to the step (1). In the present embodiment, the original discharge includes discharging the original present on the platen glass of the main body 500 toward the RDF 100 and placing the original onto the original tray 101, but the detailed description will be omitted.

Figure 10:
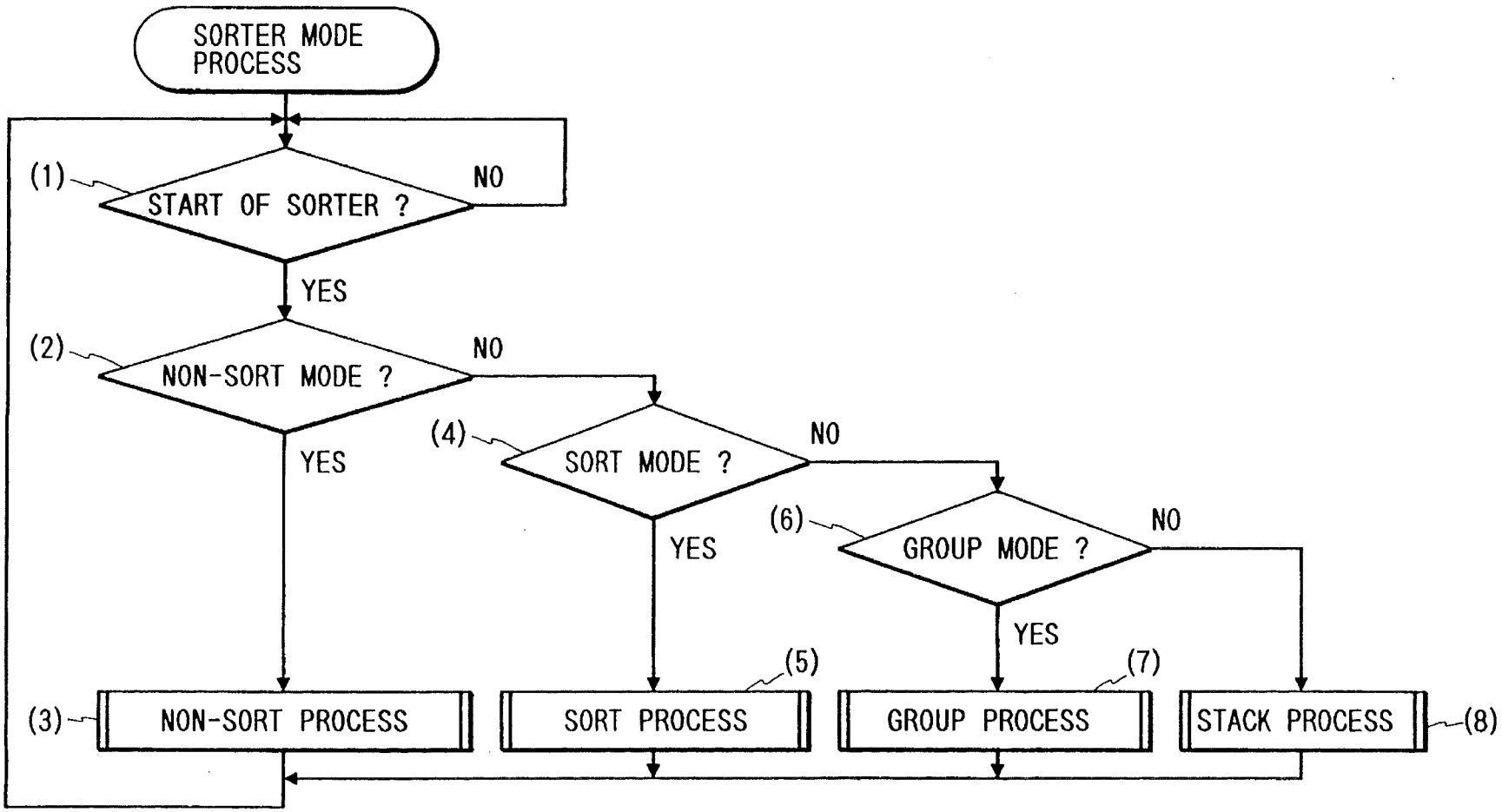
FIG. 10 is a flow chart showing an example of the sorter mode sequence of the sorter shown in FIG. 1.

FIG. 10 is a flow chart showing an example of the sorter mode sequence of the sorter 700 shown in FIG. 1, wherein (1) to (8) are process steps.

At first, the controller CONT2 discriminates whether a sorter start signal, indicating the start of sheet discharge, has been sent from the main body 500 (1), and, if the sorter start signal has been detected, there is discriminated whether the non-sorting mode has been selected (2). If selected, a non-sorting routine, to be explained later, is executed (3), and the sequence returns to the step (1).

On the other hand, if the discrimination of the step (2) turns out negative, there is discriminated whether the sorting mode has been selected (4), and, if selected, a sorting routine, to be explained later, is executed (5), and the sequence returns to the step (1).

Also, if the discrimination of the step (4) turns out negative, there is discriminated whether the group mode has been selected (6), and, if selected, a group routine, to be explained later, is executed (7) and the sequence returns to the step (1). If not selected, a stack routine, to be explained later, is executed (8), and the sequence returns to the step (1).

Figure 11:
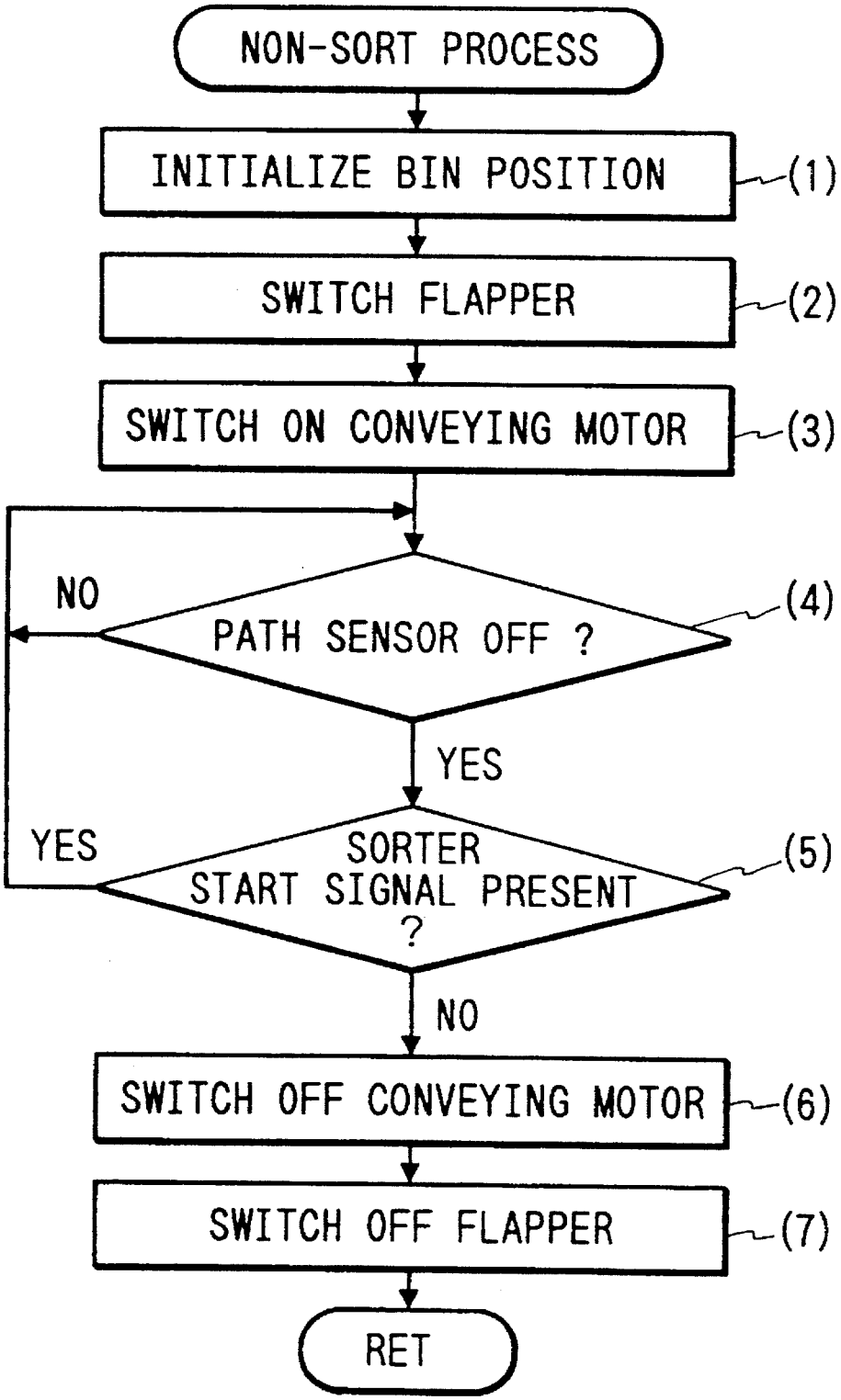
FIG. 11 is a flow chart showing the details of a non-sorting routine shown in FIG. 10.

FIG. 11 is a flow chart showing the details of the non-sorting routine shown in FIG. 10, wherein (1) to (7) indicate process steps.

At first, as initialization of the bins, the bin unit is lowered to a non-sorting home position, in order to store the sheets in the uppermost bin (1). Then, a flapper is switched for selecting the upper non-sorting sheet path inside the sorter (2). The flapper is provided with a driving solenoid (not shown), and is in a position for selecting a lower sorting path when the solenoid is normally turned off, but is shifted to a position for selecting an upper non-sorting path when the solenoid is energized.

Then, the transport motor is turned on until the output of a path sensor is turned off and until the sorter start signal is turned off (3–5). Then, the motor is turned off (6), and the flapper is turned off (7), whereby the routine is terminated.

Figures 12, 12A:
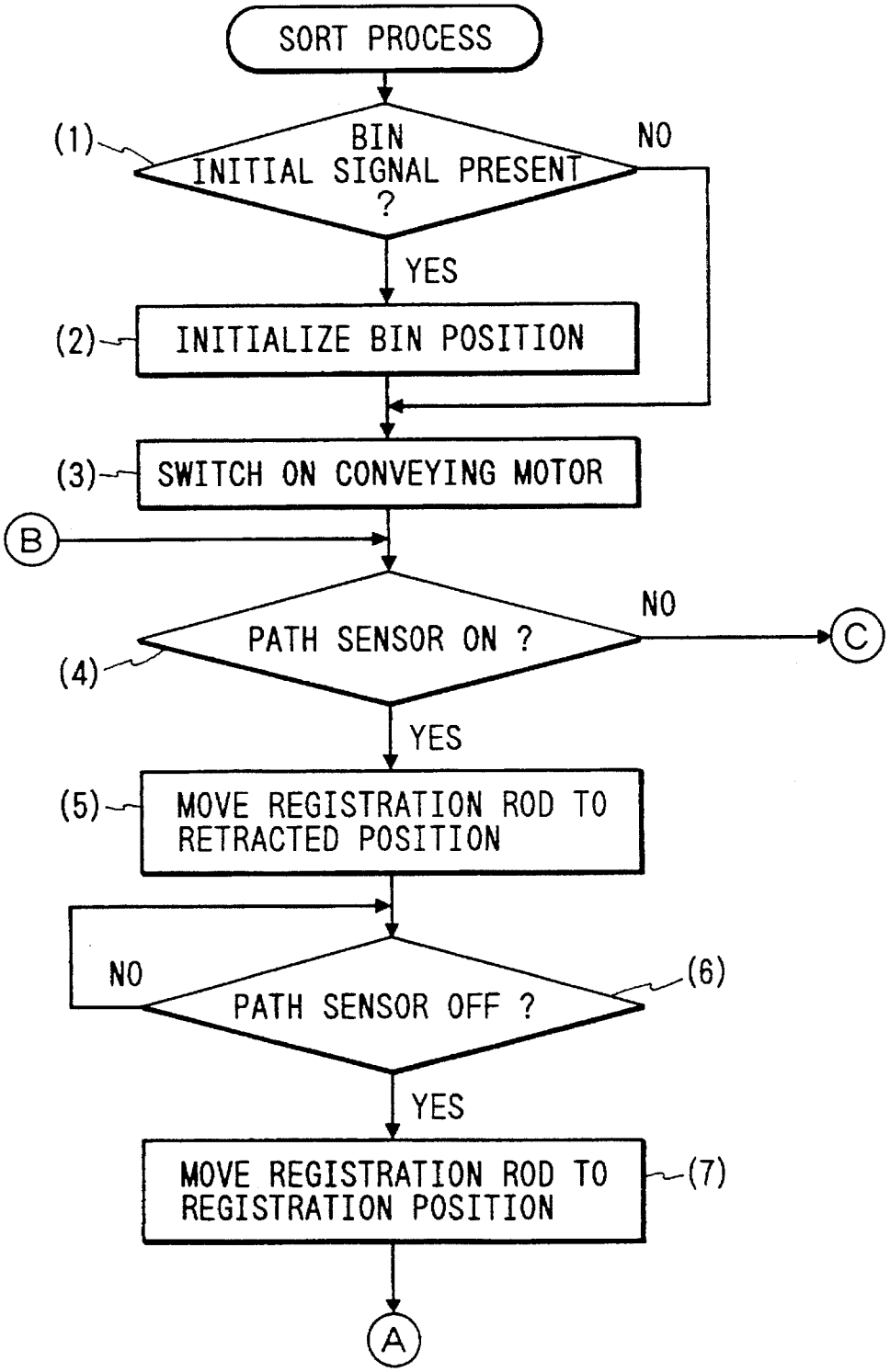
FIG. 12 is comprised of FIGS. 12A and 12B illustrating flow charts showing the details of a first sorting routine shown in FIG. 10.
Figure 12B:
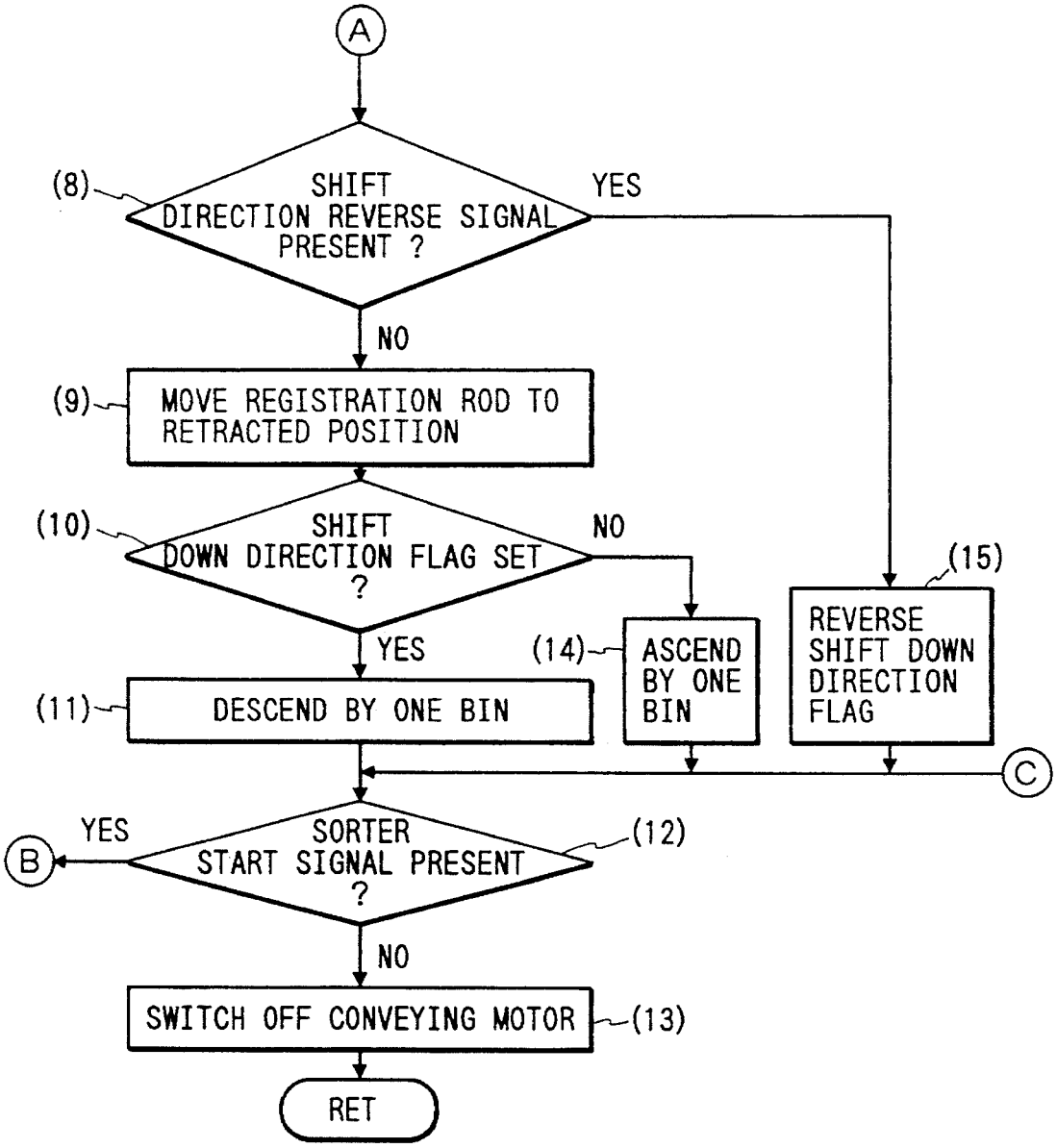

FIGS. 12A and 12B are together flow charts showing the details of a sorting routine shown in FIG. 10, wherein (1) to (15) indicate process steps.

At first, the controller CONT3 discriminates the presence of the bin initializing signal for effecting the sheet storage from the uppermost bin (1), and, if absent, the sequence proceeds to a step (3), but, if present, the bins are lowered to a non-sorting home position, as initialization (2). Then, the transport motor is turned on (3), and the controller CONT3 discriminates whether the path sensor is turned on (4). If not, the sequence proceeds to a step (12), but, if turned on, an aligning rod (registration rod) of the sorter bins is moved to a retracted position for effecting the aligning operation for the discharged sheets afterwards (5). Subsequently, when the path sensor is turned off (6), the aligning rod is moved to an aligning position (registration position), for aligning the sheets (7). Then, there is discriminated whether a shift direction inverting signal is released (8), and, if released, the sequence proceeds to a step (15). Then, a shift down flag, indicating the shifting direction in the sorter 700, is inverted (without the bin shifting), and the sequence returns to the step (12).

On the other hand, if the discrimination of the step (8) turns out negative, the aligning rod is moved to the retracted position (9), then there is discriminated whether the shift down flag, indicating the shifting direction in the sorter 700, is set (10), and, if set, the bins are lowered by one step (11), but, if not, the bins are lifted by one step (14) and the sequence returns to the step (12).

Subsequently, there is discriminated whether the sorter start signal is turned on (12), and, if on, the sequence returns to the step (4), but, if not, the transport motor is stopped (13) and the sorting sequence is terminated.

Figure 13:
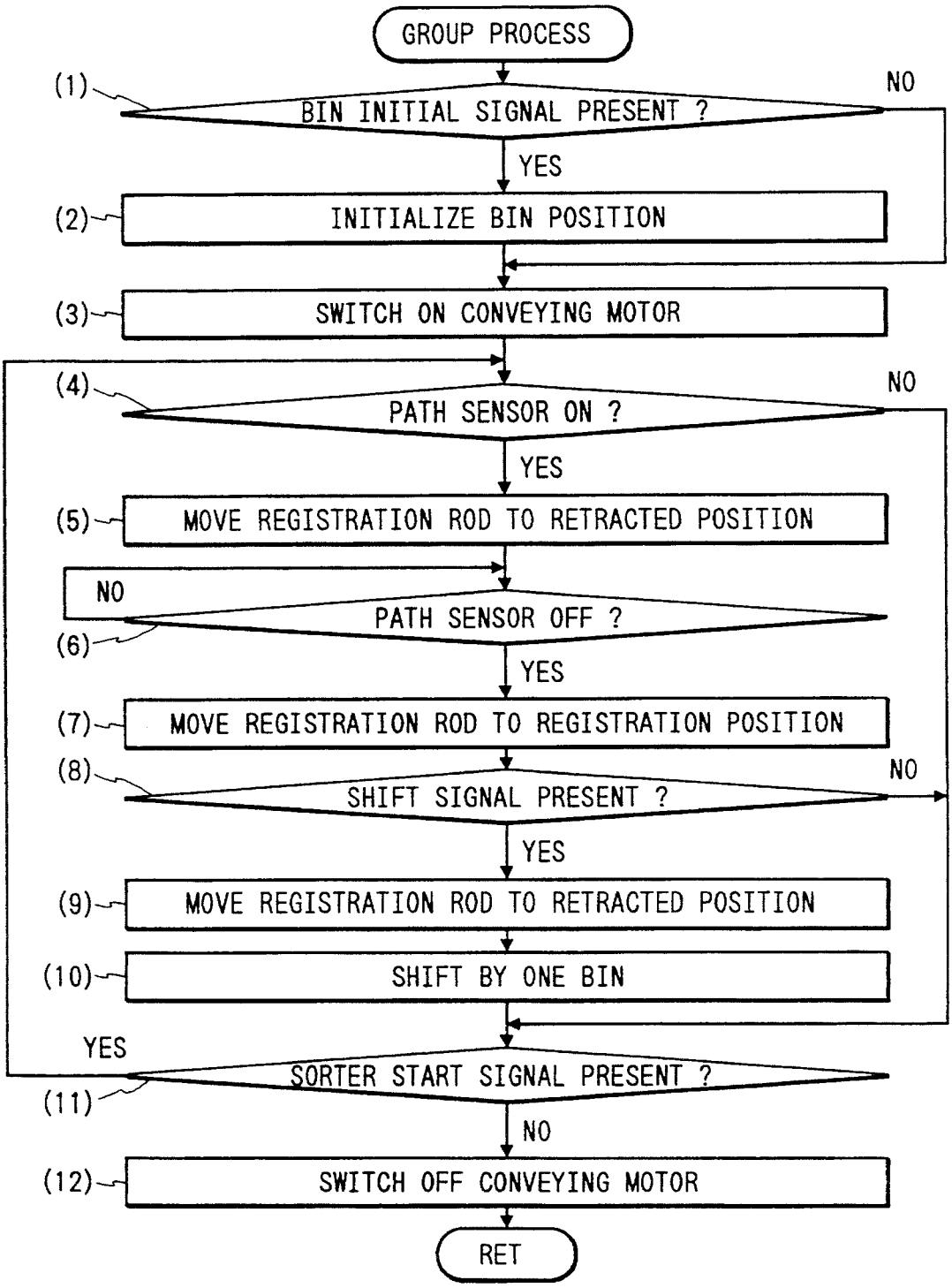
FIG. 13 is a flow chart showing the details of a group process routine shown in FIG. 10.

FIG. 13 is a flow chart showing the details of the group routine shown in FIG. 10, wherein (1) to (12) indicate process steps.

At first, there is discriminated whether the bin initializing signal, for effecting the sheet storage from the uppermost bin, is turned on (1), and, if not, the sequence proceeds to a step (3), but, if turned on, the bin unit is lowered to the non-sorting home position as the initialization of the bins. Then, the transport motor is turned on (3), and there is discriminated whether the path sensor is turned on (4), and, if not, the sequence proceeds to a step (11), but, if turned on, the aligning rod is moved to the retracted position, in order to effect the aligning operation for the sheets afterwards (5). Thereafter, the turning-off of the path sensor is awaited (6), and, when it is turned off, the aligning rod is moved to the aligning position for effecting the aligning operation for the sheets (7). Then, there is discriminated whether the bin shift signal is turned on (8), and, if not, the sequence proceeds to a step (11), but, if turned on, the bins are shifted by a step (10). Then, there is discriminated whether the sorter start signal is on (11), and, if turned on, the sequence returns to the step (4), but, if not, the transport motor is turned off (12) and the routine is terminated.

Figure 14:
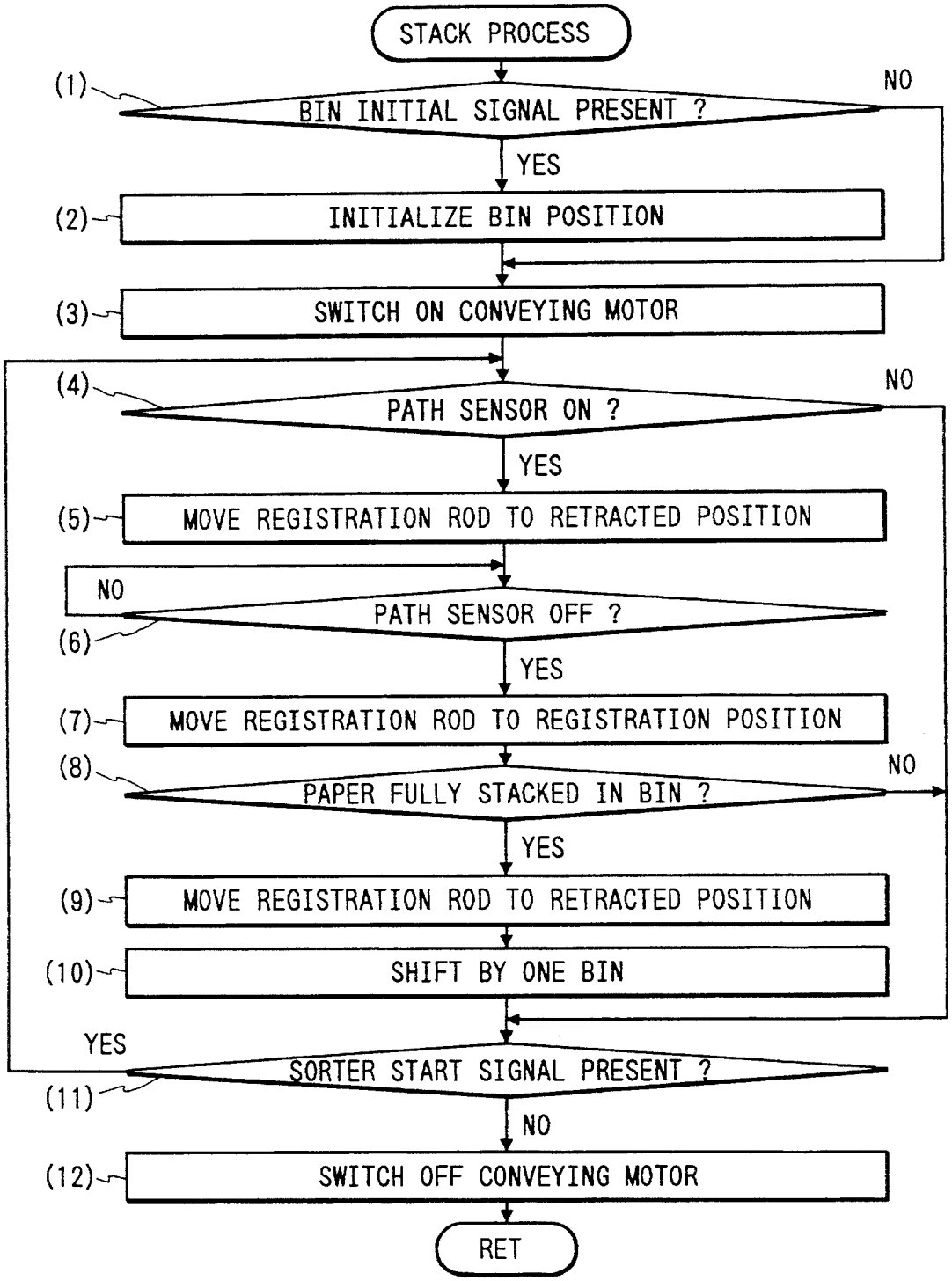
FIG. 14 is a flow chart showing the details of a stacking routine shown in FIG. 10.

FIG. 14 is a flow chart showing the details of the stacking routine shown in FIG. 10, wherein (1) to (12) indicate process steps.

At first, there is discriminated whether the bin initializing signal, for effecting the sheet storage from the uppermost bin, is turned on (1), and, if not, the sequence proceeds to a step (13), but, if turned on, the bin unit is lowered to the non-sorting home position as the initialization of the bins. Subsequently, the transport motor is turned on (3), then there is discriminated whether the path sensor is turned on (4), and, if not, the sequence proceeds to a step (11), but, if turned on, the aligning rod is moved to the retracted position in order to effect the aligning operation for the sheets afterwards (5). Subsequently, the turning-off of the path sensor is awaited (6), and, when the sensor is turned off, the aligning rod is moved to the aligning position for aligning the sheets (7). Subsequently, there is discriminated whether the bins in the storage operation have reached the maximum storage capacity, namely whether the bins have become full (8), and, if not, the sequence proceeds to a step (11), but, if full, the aligning rod is moved to the retracted position (9) and the bins are shifted by a step (10). Then, there is discriminated whether the sorter start signal is turned on (11), and, if on, the sequence returns to the step (4), but, if not, the transport motor is turned off (12) and the routine is terminated.

In the following, there will be explained a 2nd original stacking control operation in the image forming system of the present invention, with reference to FIGS. 15A to 17C.

[Second original stacking control]

Figures 15, 15A:
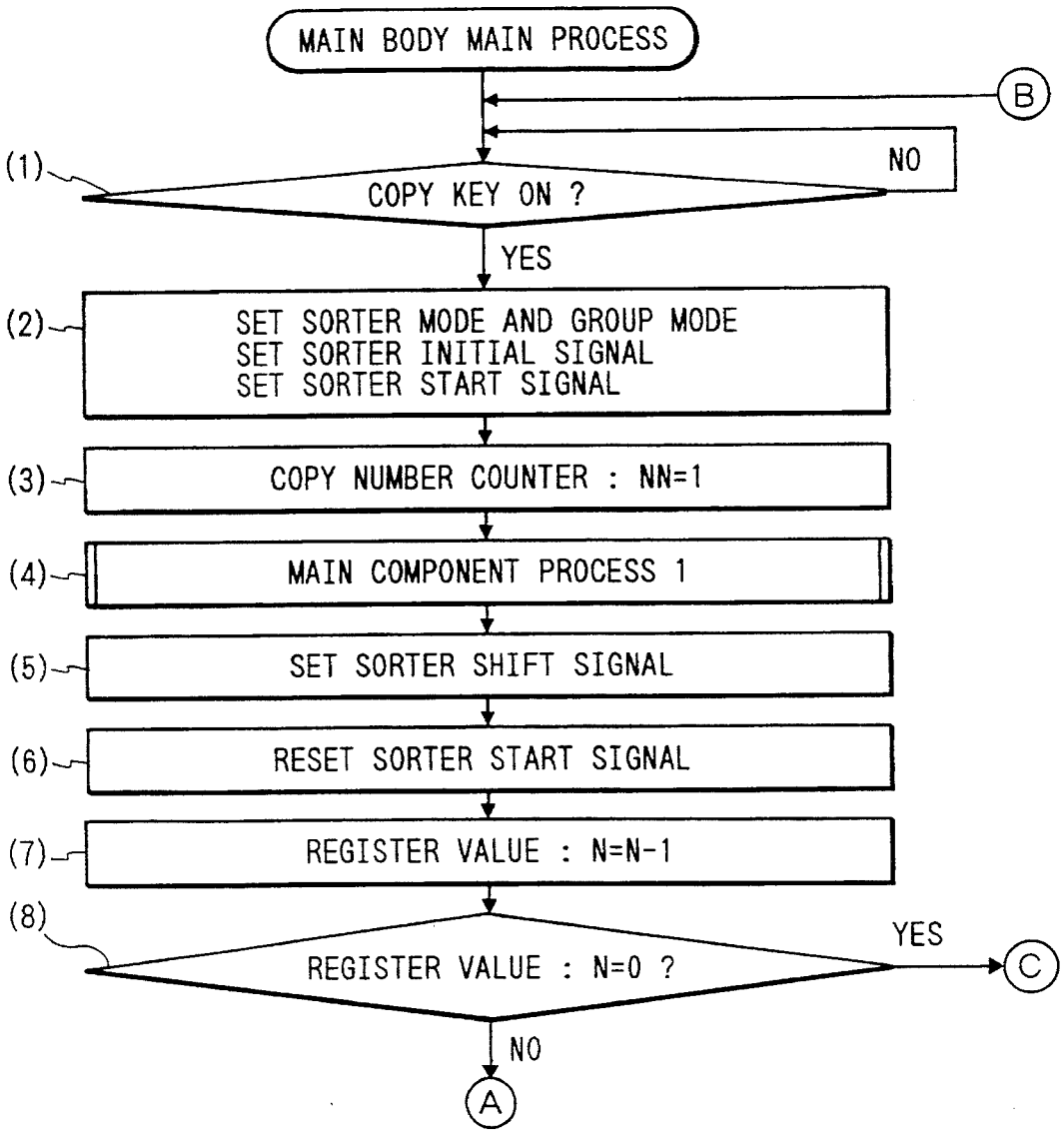
FIG. 15 is comprised of FIGS. 15A and 15B illustrating flow charts showing an example of the main process sequence in the image forming system of the present invention.
Figure 15B:
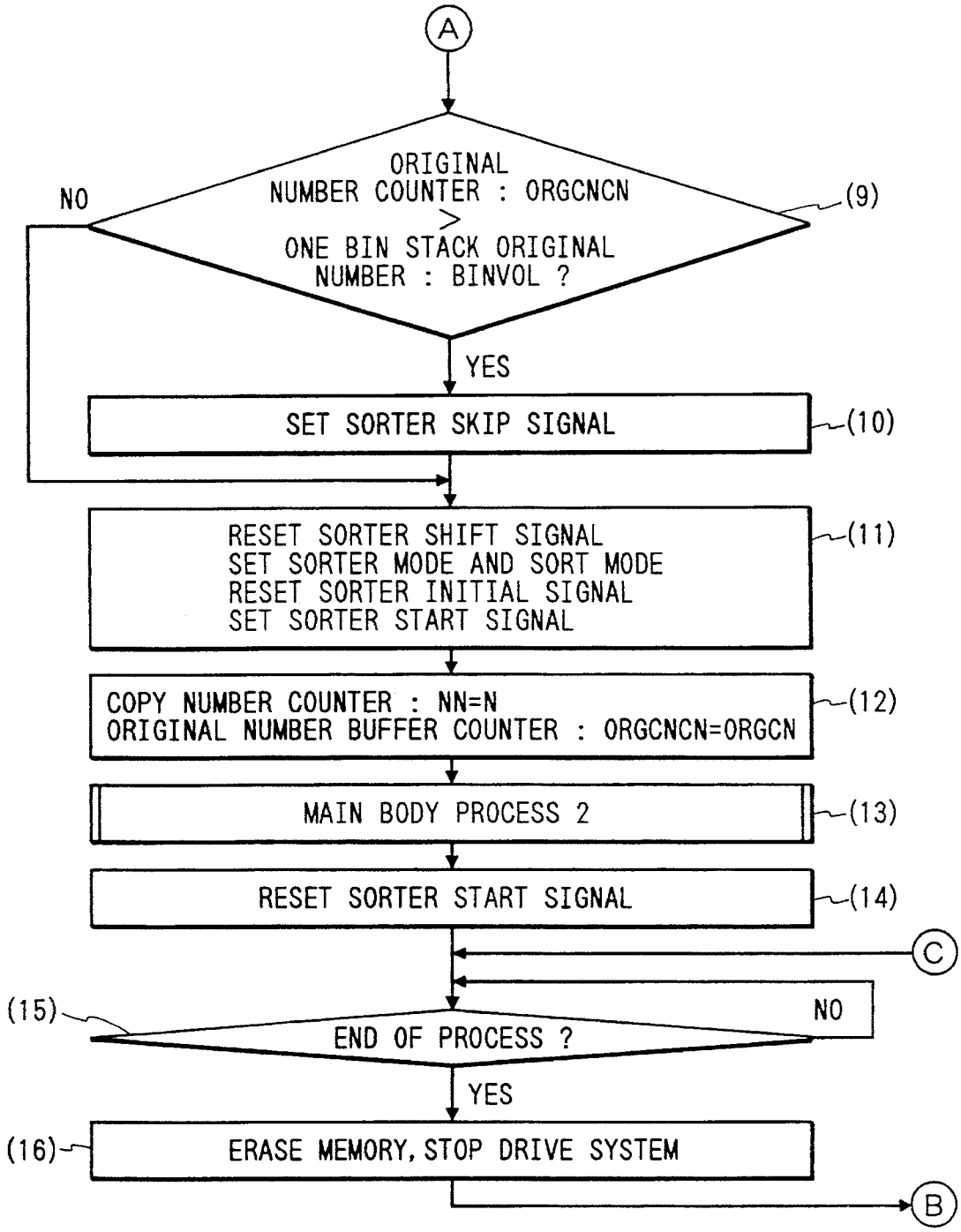

FIGS. 15A and 15B are flow charts showing an example of the main control sequence in the image forming system of the present invention, wherein (1) to (16) indicate process steps.

At first, there is awaited the actuation of the copy start key which initiates the image forming operation (1), and, when the copy start key is actuated, the operation mode of the sorter 700 is set (2). In this case, there are set the group mode for storing a set of copy sheets in the uppermost bin $B_1$ of the sorter 700, an initializing signal for the sorter 700, and a sorter start signal indicating the start of operation thereof (details of the functions of the sorter 700 will be explained later). Then, the count NN of a copy number counter, indicating the number of formed copies, is set at "1" (3).

Then, there is executed a main body process-1 routine, to be explained later (4). The main body process-1 executes image formation of a number set by the copy number counter, for each of the originals placed on the RDF 100, by feeding an original onto the platen glass, effecting a copying operation once for the original, then discharging the original from the platen glass to the original tray 101, and repeating these operations for all the originals. The main body process-1 routine effects a cycle of the originals present on the RDF 100 and simultaneously counts the number of the originals.

Then, a sorter shift signal is set (5), and the sorter start signal is reset (6). In this manner, the copy sheets of a set, prepared corresponding to the originals placed on the RDF 100, are stored in the uppermost storage bin of the sorter 700.

Then, the copy number "1" is subtracted from the set copy number N (N ←N−1) (7), and there is discriminated whether thus subtracted number is "0" (8). If 0, the sequence process to a step (15) to terminate the processes in the main body 500 and in the accessory devices. Then executed are post-processes for clearing the memories and stopping the driving systems (16), and the sequence returns to the step (1).

On the other hand, if the discrimination of the step (8) turns out negative, there is discriminated whether the number of originals counted in the main body process-1 (counted by an original number counter ORGCNCN) is larger than the maximum storage capacity BINVOL per bin of the sorter 700 (9), and, if not, the sequence proceeds to a step (11), but, if larger, there is set a sorter skipping signal to be explained later (10). Then, the sorter shifting signal is reset, and the operation mode of the sorter 700 is set. In the present case, in order to store the copy sheets in the succeeding storage bins of the sorter, there is selected the sorting mode. Also, the initializing signal for the sorter 700 is reset, and the sorter start signal for starting the function of the sorter is set (11).

Then, the remaining copy number N is substituted in the count NN of the copy number counter, and the value of an original number counter ORGCNCN, counted in the main body process-1, is substituted in an original number buffer counter ORGCNCN (12). Then, there is executed a main body process-2 routine, as will be explained later (13). The main body process-2 routine executes copying operations by a copy number set by the copy number counter, for the originals placed on the RDF 100, by feeding an original onto the platen glass, effecting the copying operations for the set copy number for the original, then discharging the original from the platen glass to the original tray 101, and repeating these operations for all the originals. As the sorter 700 is in the sorting mode, the copy sheets prepared in succession from a same original are stored in respectively different bins. After this main body process-2 routine, the sorter start signal is reset (14), then the process of the main body 500 and the accessory units is terminated (15), also post-processes for clearing various memories and stopping the driving systems are executed (16), and the sequence returns to the step (1).

Figures 16, 16A:
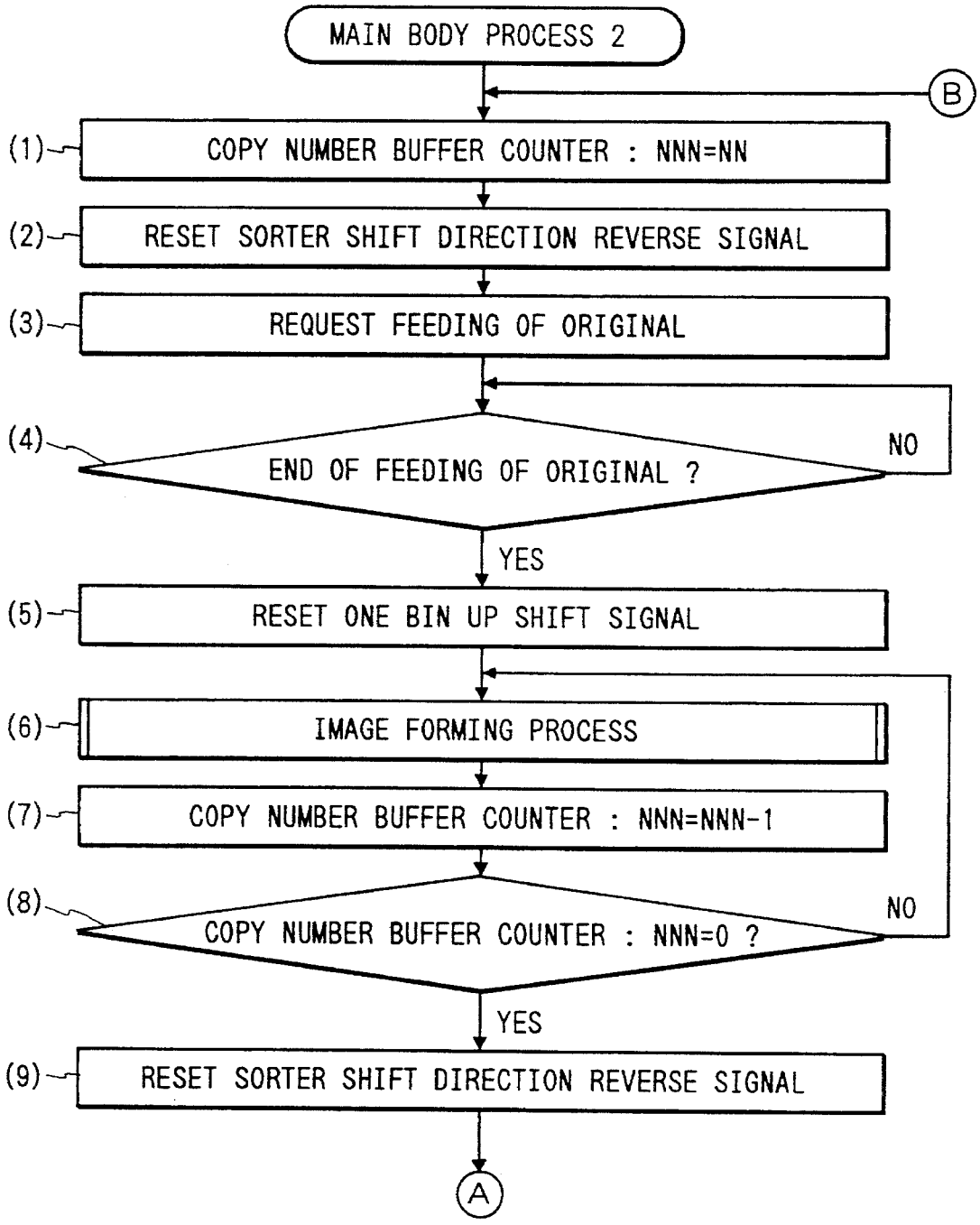
FIG. 16 is comprised of FIGS. 16A and 16B illustrating flow charts showing the details of a main body process 2 routine shown in FIG. 15.
Figure 16B:
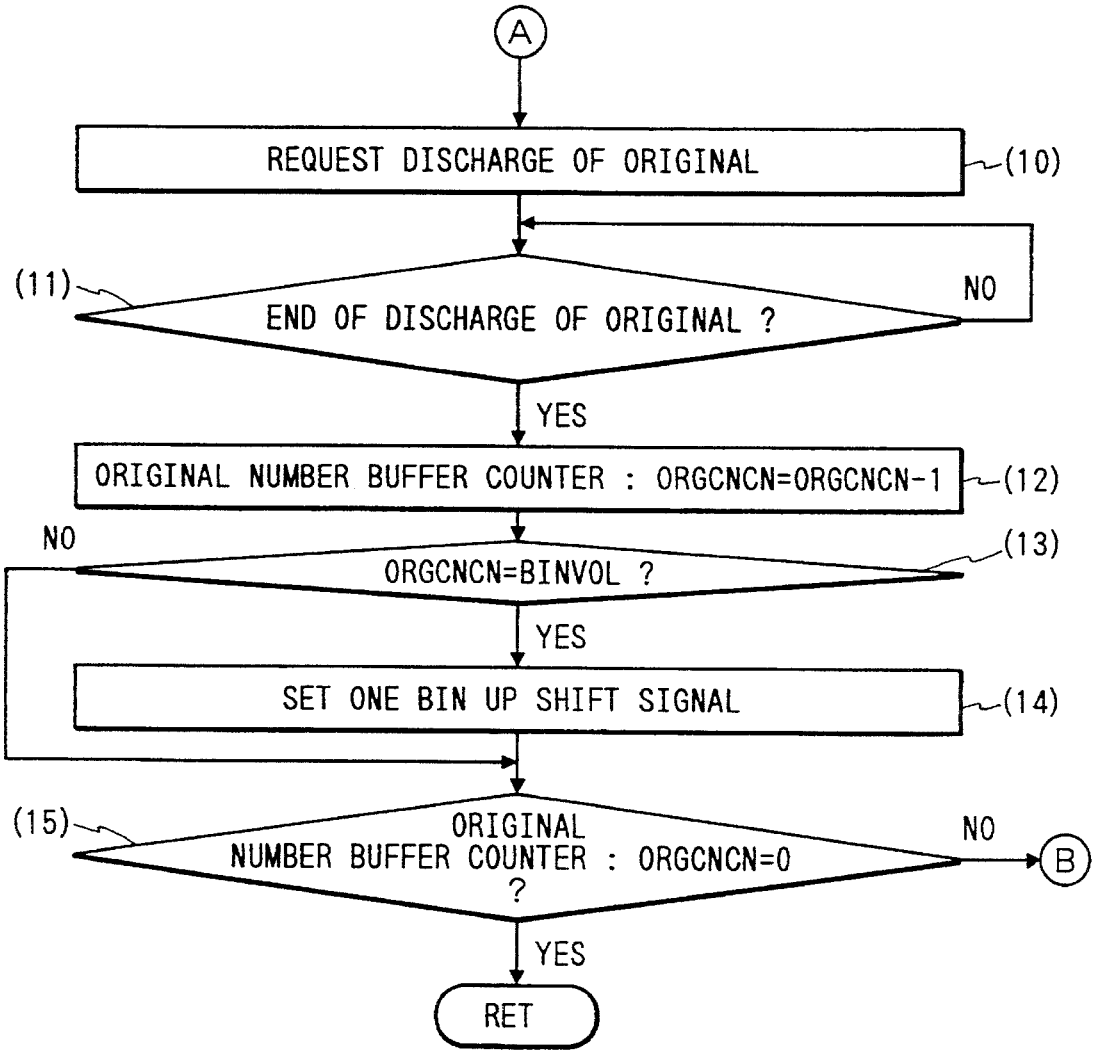

FIGS. 16A and 16B are flow charts showing the details of the main body process-2 routine shown in FIGS. 15A and 15B, wherein (1) to (15) indicate process steps.

At first, the count of the copy number counter NN is substituted in the copy number buffer counter NNN (1), and a sorter shift direction inverting signal is reset (2). Then, a request is sent to the RDF 100 for original feeding onto the platen glass (3), and the completion of the original feeding is awaited (4). Upon completion of the original feeding, a bin upshift signal is reset (5), then the aforementioned image forming routine is executed (6), and the count of the copy number NNN is decreased by "1" (7). Then, there is discriminated whether the count has reached "0" (8), and, if not, the sequence returns to the step (6). If "0" has been reached, there is set a sorter shift direction inverting signal (9), and a request is released for the original discharge (10). Upon completion of the original discharge (11), the count of the original number counter ORGCNCN is decreased by "1" (12), then there is discriminated whether the count of the original number counter ORGCNCN coincides with the maximum storage capacity BINVOL per bin (13), and, if not, the sequence proceeds to a step (15), but, in case of coinciding, there is a bin upshift signal (14). In this manner, the storage bins of the sorter 700 are upshifted by a bin, whereby, in case the sheets are stored in the 3rd, 5th, 7th, 9th, . . . bins in response to the sorter skipping signal, the bins are upshifted by a bin in response to the bin upshift signal to store the sheets in the 2nd, 4th, 6th, 8th, . . . bins.

Subsequently, there is discriminated whether the count of the original number counter ORGCNCN is "0" (15), and, if not, the sequence returns to the step (1), but, if "0" , the routine is terminated. In this manner, image formations for the remaining copy number are executed for each original, until the last original is detected.

Figures 17, 17A:
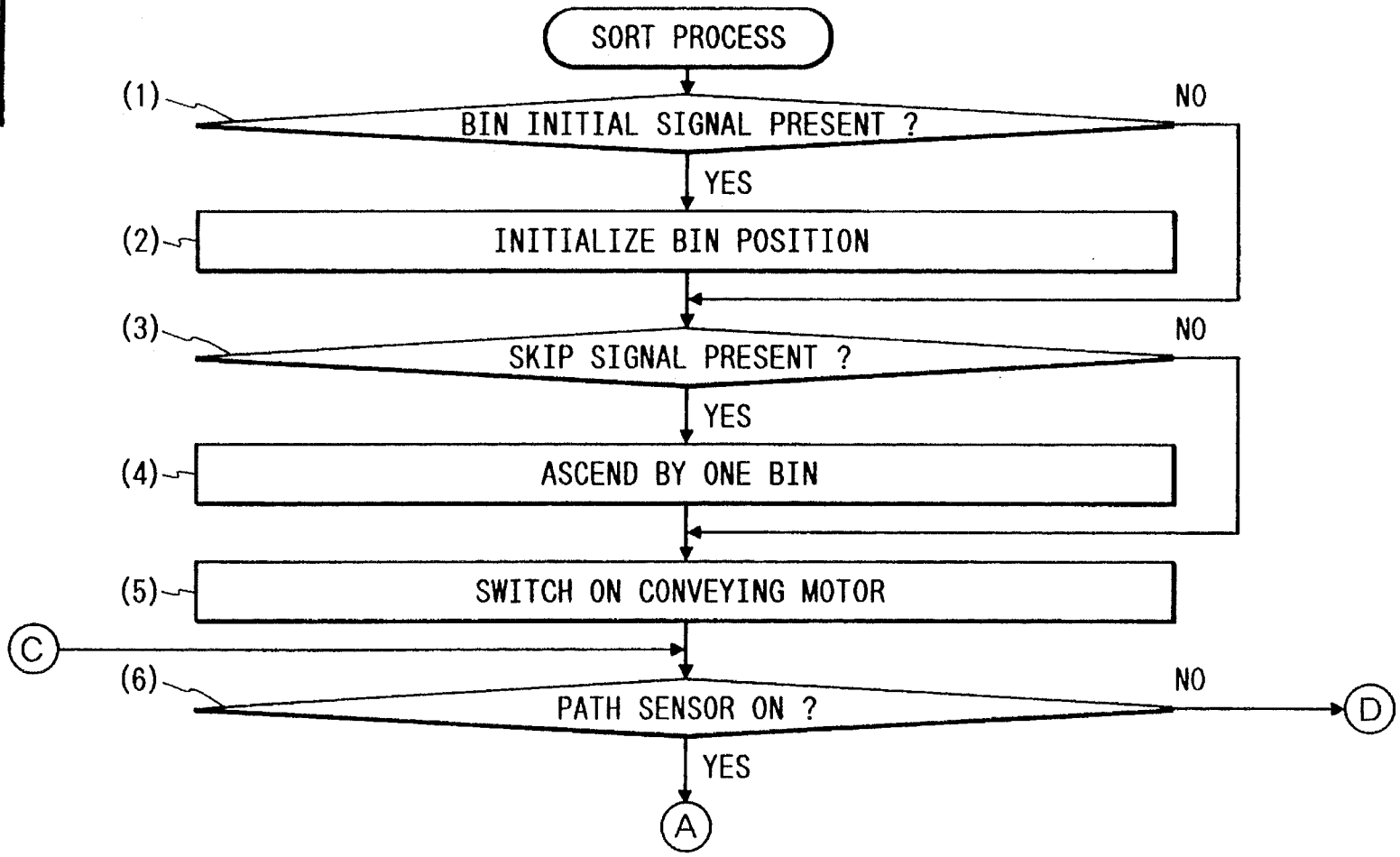
FIG. 17 is comprised of FIGS. 17A to 17C illustrating flow charts showing the details of a first sorting routine shown in FIG. 10.
Figure 17B:
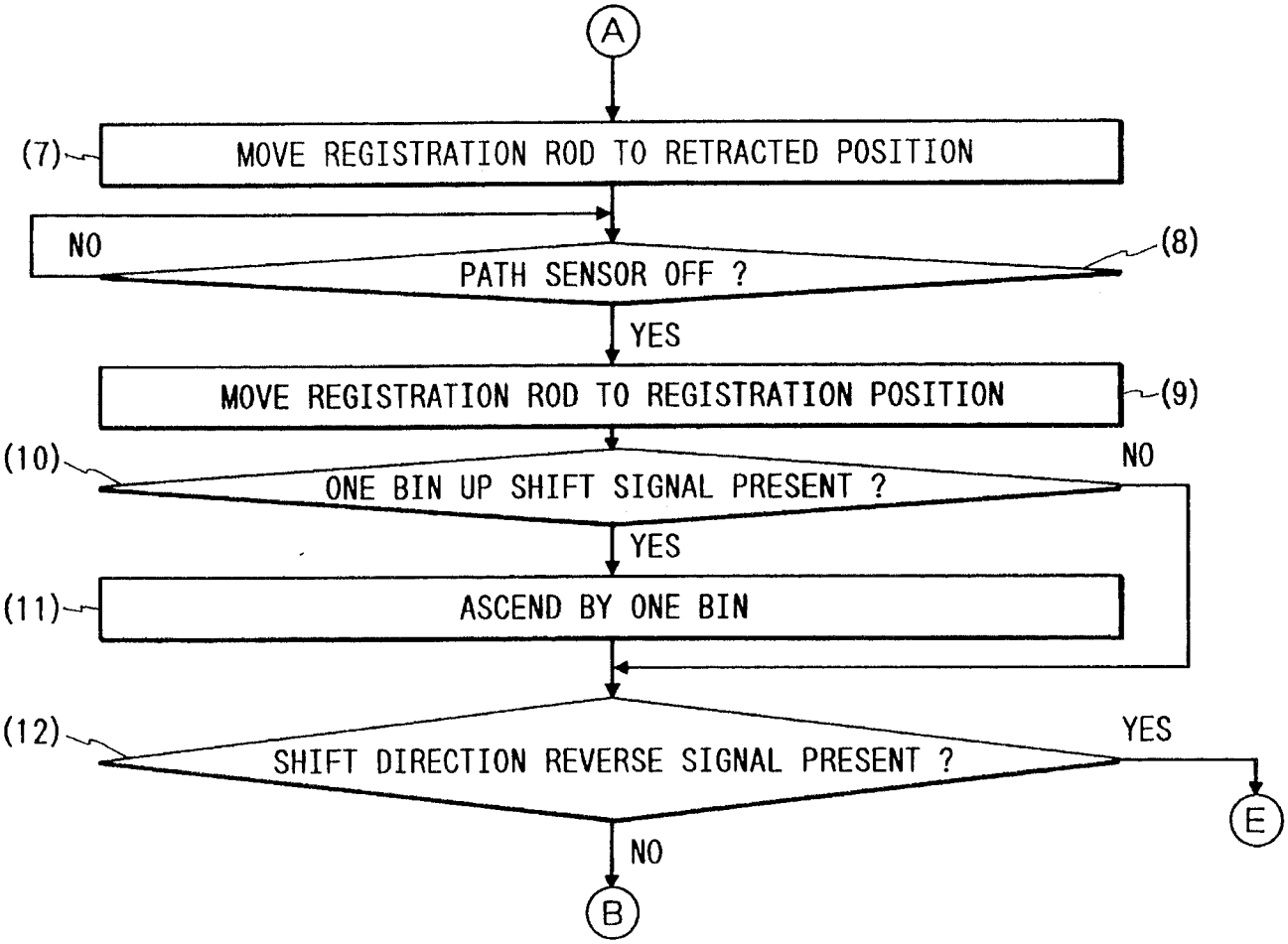
Figure 17C:
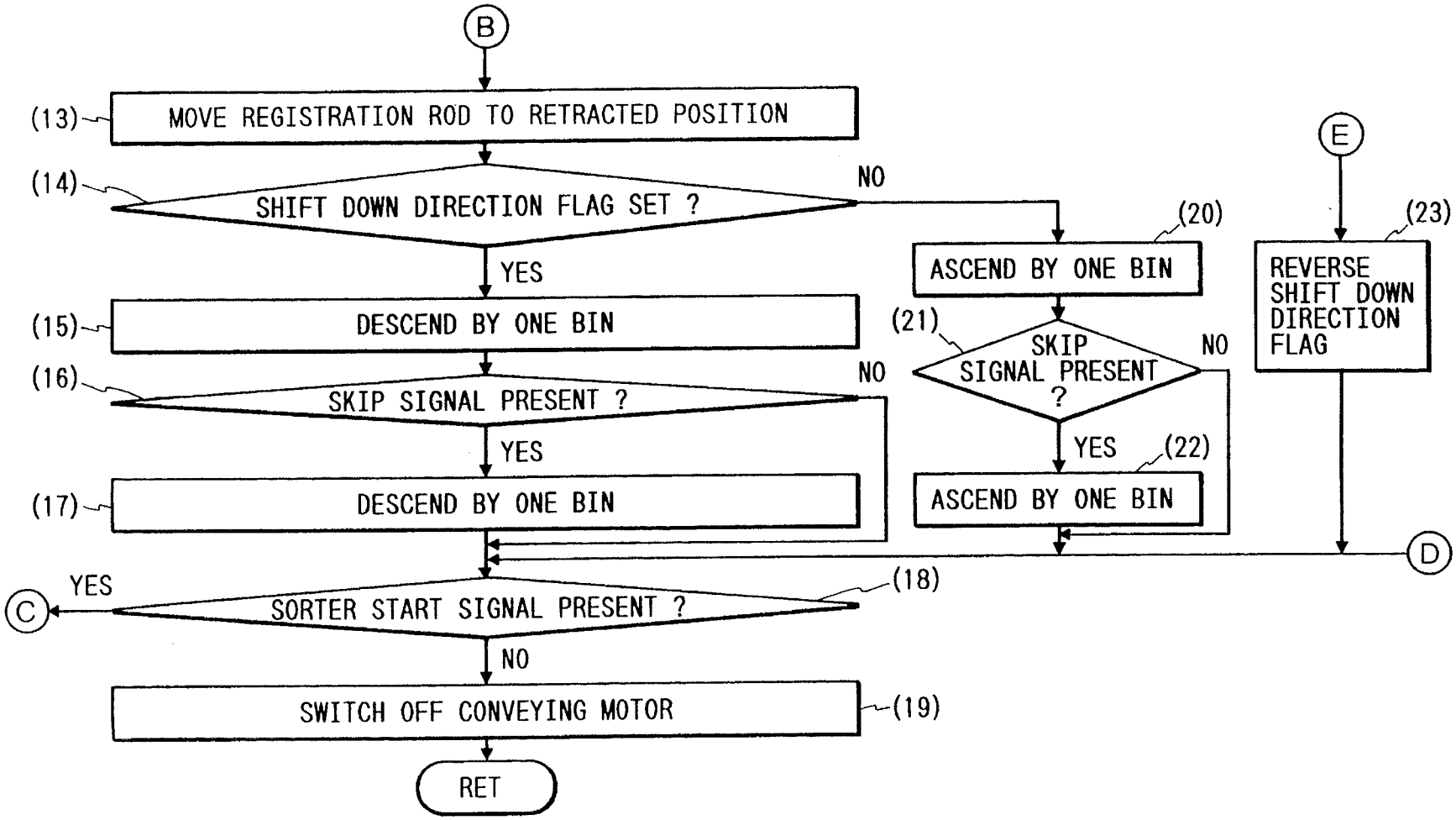

FIGS. 17A to 17C are flow charts showing the details of a first sorting routine, wherein (1) to (23) indicate process steps.

At first, the controller CONT3 discriminates whether the bin initializing signal, for effecting the sheet storage from the uppermost bin, is present (1), and, if not, the sequence proceeds to a step (3), but, if present, the bin unit is lowered to the non-sorting home position as the initialization of the bins (2). Then, there is discriminated whether the skipping signal is turned on (3), and, if not, the sequence proceeds to a step (5), but, if turned on, the bins are lifted by a step (4).

Subsequently, the transport motor is turned on (5), then the controller CONT3 discriminates whether the path sensor is turned on (6), and, if not, the sequence proceeds to a step (18), but, if turned on, the aligning rod is moved to the retracted position, in order to effect the sheet alignment afterwards (7). Subsequently, when the path sensor is turned off (8), the aligning rod is moved to the aligning position, for aligning the sheets (9). Then, there is discriminated whether the bin upshift signal is turned on (10), and, if not, the sequence proceeds to a step (12), but, if turned on, the bins are lifted by a step (11).

Then, there is discriminated whether the shift direction inverting signal (shift direction reverse signal) is released (12), and, if released, the sequence proceeds to a step (23). Then the downward shift flag, indicating the shifting direction in the sorter 700, is inverted (without bin shifting), and the sequence returns to the step (18).

On the other hand, if the discrimination in the step (12) turns out negative, the aligning rod is moved the retracted position (13), then there is discriminated whether the downward shift flag, indicating the shifting direction of the sorter 700, is set (14) , and, if set, the bins are lowered by a bin (15). Then, there is further discriminated whether the skipping signal is turned on (16), and, if not, the sequence proceeds to a step (18) but, if turned on, the bins are lowered by a bin (17). Subsequently, there is discriminated whether the sorter start signal is turned on, and, if turned on, the sequence returns to the step (6), but, if not, the transport motor is stopped (19) and the sorting routine is terminated.

On the other hand, if the discrimination of the step (14) turns out negative, namely if the downward shift flag (shift down direction flag) is not set, the bins are lifted by a step (20), then there is discriminated whether the skipping signal is turned on (21), and, if not, the sequence proceeds to a step (18). If turned on, the bins are lifted by a step (22), then there is discriminated whether the sorter start signal is turned on (18), and, if turned on, the sequence returns to the step (6) but, if not, the transport motor is stopped (19) and the sorting routine is terminated.

In the above-explained embodiment, the copying operations and the counting of the originals are executed during the first recycling of the originals, and the method of storage of sheets in the second recycling of the originals is made variable according to the number thereof, thus achieving suitable handling of the copy sheets corresponding to few or many originals. However, it is also possible to handle the copy sheets corresponding to a large number of originals, by so constructing a predetermined storage bin (for example, the 1st bin) as to store the copy sheets of a number corresponding to the maximum number of originals placeable on the RDF, also so constructing other bins (second and subsequent bins) as to store the copy sheets of a half of the number (in the foregoing embodiment, 100 originals at maximum being acceptable, while the first bin can store more than 100 sheets and each of the second and subsequent bins can store 50 sheets at maximum), then sorting the copy sheets corresponding to the first cycle of the originals always in the skipping mode in the odd-numbered bins, starting from the 1st bin (namely, in the 1st, 3rd, 5th, 7th, . . . bins), and, if the number of sheets exceeds the maximum storage capacity of the second and subsequent bins, sorting the subsequent sheets in the skipping mode in the even-numbered bins, namely in the 2nd, 4th, 6th, 8th, . . . bins.

In this case, if the set copy number is an even number n, the copy sheets are initially skip sorted into the 1st, 3rd, 5th, 7th, . . . , (2n−1)-th bins, and, if the number of the originals does not exceed the maximum storage capacity (50 sheets) of each bin, the copy sheets for the second cycle are skip sorted into the 2nd, 4th, 6th, 8th, . . . , 2n-th bins. If the number of the originals exceeds 50, the copy sheets corresponding to the remaining originals in the first cycle are sorted into the 1st, 2nd, 4th, 6th, 8th, . . . , 2n-th bins, and, in the second cycle, the copy sheets corresponding to the initial 50 originals are skip sorted into the (n+2)-th, (n+4)-th, . . . , 2n-th bins, while those corresponding to the remaining originals are sorted into the (n+1)-th, (n+3)-th, . . . , (2n−1)-th bins. Also, if the set copy number is an odd number n, the copy sheets are initially skip sorted into the 1st, 3rd, 5th, . . . , n-th bins. If the number of the originals does not exceed the maximum storage capacity (50 sheets) of each bin, the copy sheets for the second cycle are sorted into the 2nd, 4th, 6th, . . . , (n−1)-th bins, and, in the second cycle, the copy sheets corresponding to the initial 50 originals are skip sorted into the (n+2)-th, (n+4)-th, . . . , (2n−1)-th bins, while those corresponding to the remaining originals are sorted into the (n+1)-th, (n+3)-th, . . . , (2n−2)-th bins.

in this manner, appropriate sheet sorting is rendered possible, corresponding to few to many originals.

In the foregoing embodiment, the sorting of the copy sheets is varied according to the counting of the number of originals, but it is also possible to count the number of the copy sheets prepared in the first cycle of the originals and to accordingly vary the sorting method.

Furthermore, in the foregoing embodiment, the storage capacity of the 1st bins is the same as the number of the originals acceptable by the RDF, and the storage capacity of the second and subsequent bins is selected as a half of the number, but it is also possible to select the storage capacity of all the bins as a half of the number, and to start the sheet storage in the first cycle of the originals in the 2nd bin, thereby accommodating the copy sheets in the 1st and 2nd bins corresponding to the maximum number of originals acceptable by the RDF, while counting the number of the originals.

Furthermore, in the foregoing embodiment, the storage capacity per bin in the sorter is selected as ½ of the maximum number of originals acceptable by the RDF, but it is also possible to select the storage capacity as ⅓ or ¼ of the maximum number of the originals, and to effect skip sorting of the copy sheets in every three or every four storage bins.

In the foregoing embodiment, as explained in the foregoing, while first sorting control means stores the copy sheets, prepared corresponding to the originals fed in a first recycling, into a predetermined storage bin of the sorter, counting means counts the number of the originals fed in the first recycling, then the counted number of the originals is compared with the maximum storage capacity in each of the storage bins other than the predetermined storage bin, and second sorting control means sorts the copy sheets, prepared in the second recycling of the originals, into plural storage bins, so as not to exceed the maximum storage capacity. Thus, the number of the originals need not be counted in advance but can be identified in the copying operations in the first recycling of the originals, and the copy sheets of a desired number, prepared from the originals of a number exceeding the maximum storage capacity per bin of the sorter, can be efficiently sorted without sacrificing the copying efficiency.

Also, the second sorting control means is adapted, in the second recycling of the originals, to sort the copy sheets into two adjacent storage bins so as not to exceed the maximum storage capacity per bin, so that the copy sheets of a desired number, prepared from the originals of a number exceeding the maximum storage capacity per bin of the sorter can be sorted in an easily collatable manner, with a proper order of pages.

Furthermore, the second sorting control means is adapted, in the second recycling of the originals and based on the output of the counting means, to sort the copy sheets of a set substantially equally into two adjacent storage bins, so as not to exceed the maximum storage capacity per bin, whereby the thicknesses of divided bundles of sheets can be made uniform and such divided bundles appear beautifully after stapling.

Furthermore, the second sorting control means is adapted, in the second recycling of the originals and based on the output of the counting means, to sort the copy sheets, corresponding to an original, into storage bins of a predetermined number in a skipped manner according to the set copy number, whereby, when the sorting mode is selected, the copy sheets can be sorted in the proper order of pages.

Furthermore, in the second recycling of the originals, determination means compares the number of the storage bins to be used for sorting and the number of total bins excluding predetermined storage bins, and determines the settable number of originals, and correction means automatically corrects the set copy number according to the output of the determination means, whereby the sorting of an optimum copy number utilizing all the storage bins can be efficiently achieved.

Consequently, there can be obtained an excellent effect of efficiently obtaining copies of a desired number from the originals of a number exceeding the maximum storage capacity per bin.

In the following there will be explained another embodiment of the image forming system of the present invention.

Figure 18:
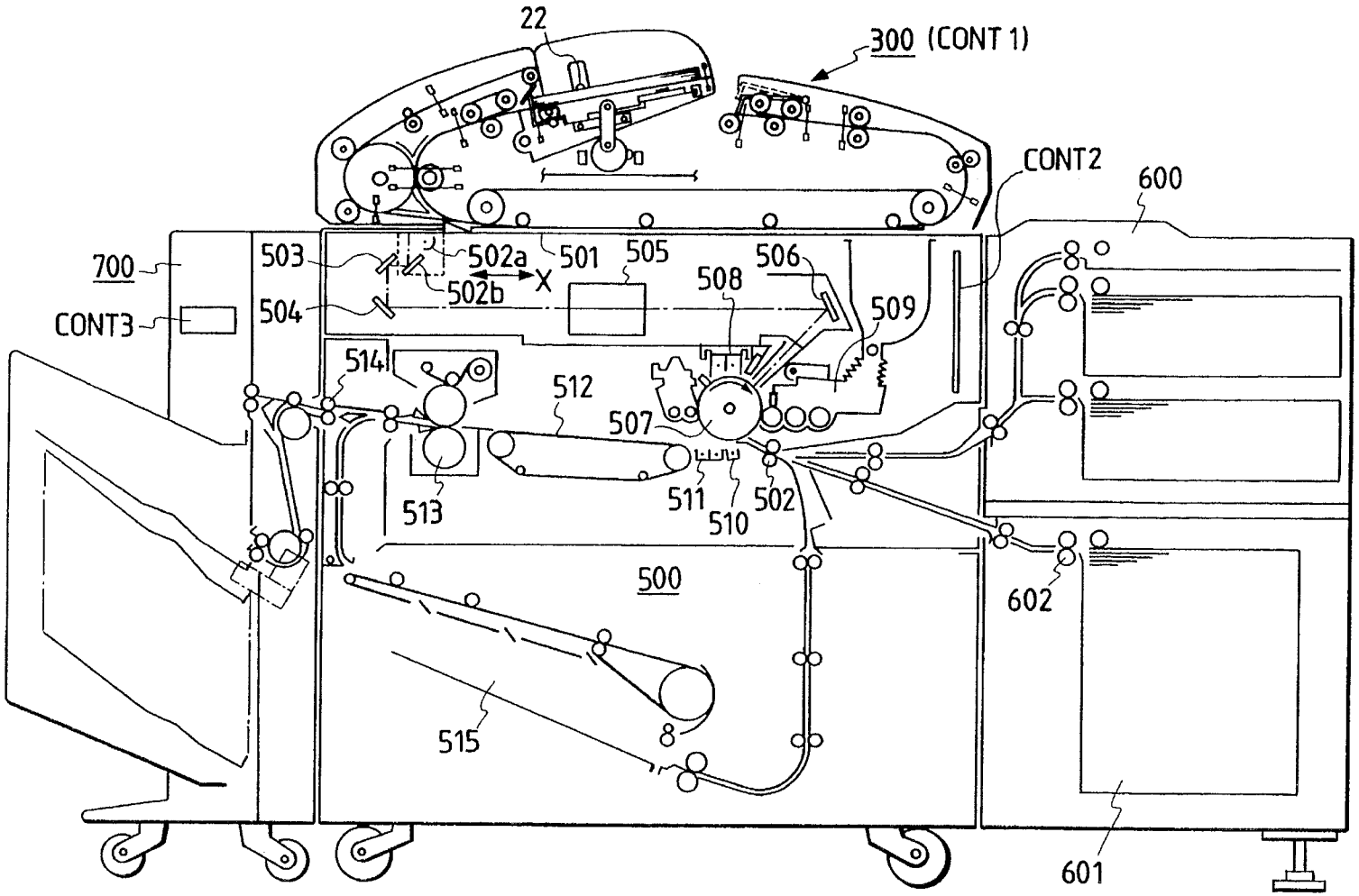
FIG. 18 is a cross-sectional view of an image forming system constituting another embodiment of the present invention.

FIG. 18 is a cross-sectional view of an image forming system of the present invention.

A recycling document feeder (RDF) 300 is controlled by a controller CONT1 to be explained later. The image forming process of a main body 500 will not be explained, as it is same as that of the system shown in FIG. 1.

In such 3rd image forming system, based on the approximate number of the original sheets, detected by detection means (partition member 22) prior to the original feeding, control means (controllers CONT1 to CONT3) selects the process conditions of the RDF 300 and the sorter 700 so as to reduce the process time for said originals, so that the image formation can be executed with a shortest time, corresponding to the approximate number of the original sheets stacked on the original tray.

In a 4th image forming system, the detection means (partition member 22) detects the approximate number of the original sheets stacked on the original tray, based on the thickness of the originals, so that the number of the originals required for selecting optimum conditions for the original handling and the recording medium can be detected, without actual feeding of the originals.

In a 5th image forming system, the control means (controllers CONT1 to CONT3) selects the feed path from the RDF so as to reduce the original handling time for the original sheets, based on the approximate number thereof detected by the detection means (partition member 22), so that the image forming process can be started with a shortest feed path, according to the approximate number of the original sheets stacked on the original tray.

In a 6th image forming system, the detection means (partition member 22) detects the approximate number of the original sheets stacked on the original tray, based on the thickness of the stack, whereby the number of the originals required for selecting the optimum feed path can be detected without the actual feeding of the originals.

In a 7th image forming system, the control means (controllers CONT1 to CONT3) selects a first feed path for original feeding from the original tray in case the detection means detects that the thickness of the originals stacked on the original tray does not exceed a predetermined value, whereby the image formation can be achieved with a high throughput even when the number of the originals on the original tray is limited.

In an 8th image forming system, the control means (controllers CONT1 to CONT3) selects a skip sorting mode in the sorter in case the detection means detects that the thickness of the originals stacked on the original tray exceeds a predetermined value, whereby an optimum sheet sorting mode can be securely selected prior to the start of the original feeding.

In this manner there is provided an image forming system equipped with means for detecting the thickness (amount) of the originals, in order to detect, to a certain level, the thickness or amount of the stack of the originals after they are placed on an original handling device in the system and prior to the start of the copying operation, whereby the sheet handling method in the device and the sheet sorting method in the sorter can be adjusted to an optimum sequence, according to thus detected thickness or amount, prior to the start of the copying operation.

More specifically, the original handling device is provided with detection means of a rough ability, capable of distinguishing the thickness of several originals from the thickness of originals exceeding the maximum storage capacity of each bin of the sorter, namely a thickness of about 50 originals in case each storage bin can store 50 sheets, thereby reducing the total copy time and improving the productivity in a copying operation for preparing a limited number of copies (mainly one copy) from a limited number of originals, and effectively utilizing the non-stop image reading mode or the continuous-feeding fixed-reading mode of a short original exchange time for a larger number of originals.

For the originals of a number exceeding the maximum storage capacity per bin of the sorter, there can be utilized the skip sorting mode, in which a series of copy sheets are stored in two adjacent storage bins, and, for the originals of a number not exceeding the capacity, the conventional sorting method can be applied. The recycling document feeder 2 of the present invention is provided an original tray 4 in the upper part, and a wide belt 7 thereunder, supported by a driving roller 36 and an idler roller 37. The belt 7 is maintained in contact with the platen glass 3 of the main body 500, and serves to transport the original sheet P from the original tray 4 to a predetermined position on the platen 3 or from the platen 3 to the original tray 4.

Figure 19:
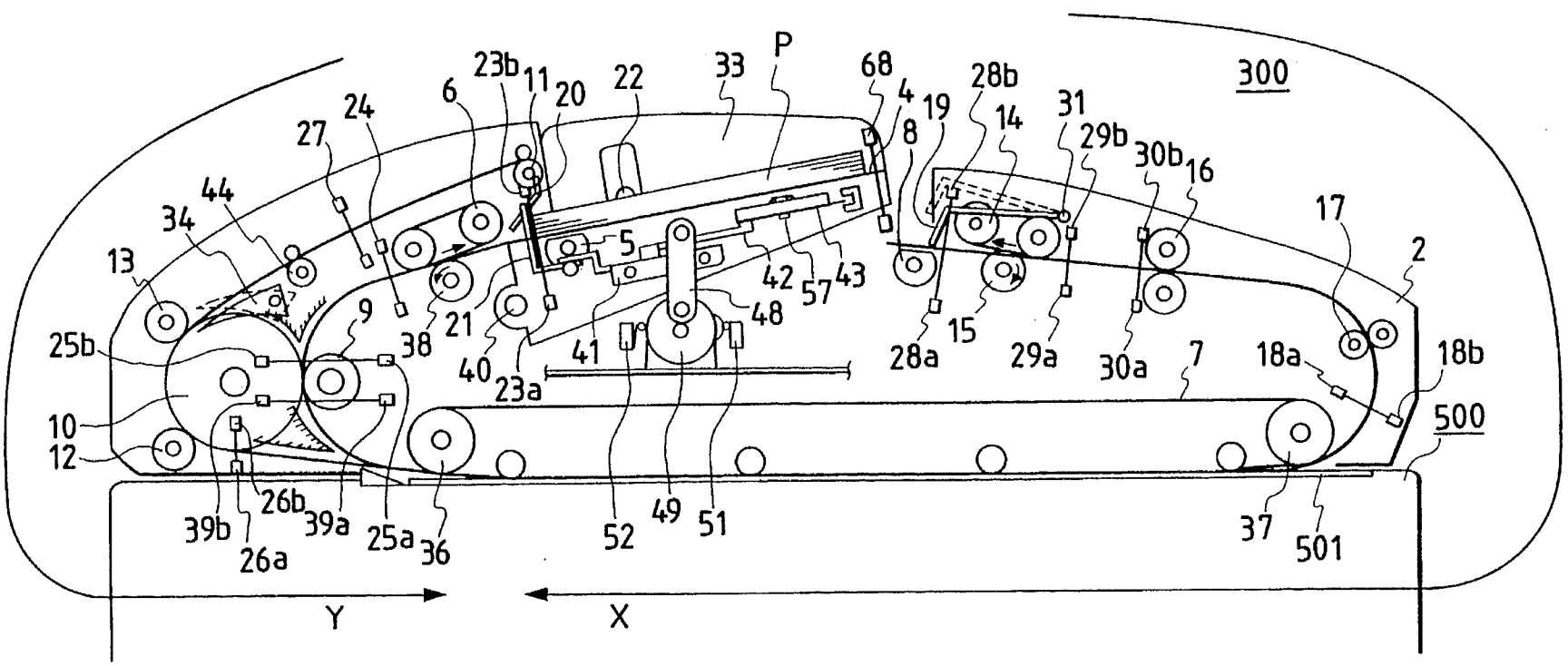
FIG. 19 is a cross-sectional view showing the details of an original feeding device 300.

FIG. 19 is a detailed cross-sectional view of the RDF 300 shown in FIG. 18.

As shown in FIG. 19, the original tray 4 is provided with a pair of width defining plates 33, which is rendered slidable in the transversal direction of the original sheets P for defining the sheets P, on the original tray 4, in the transversal direction thereof, thus ensuring the stability of feeding of the original sheets P and the alignment thereof in feeding onto the platen 3. The defining plate 33 is provided with a jogging mechanism, to be explained later, for pressing each original P transported onto the original tray 4 toward a reference guide member (the defining plate) 33, thereby improving the alignment of the original sheets P. Besides, the original tray 4 is rendered, by a tray moving mechanism to be explained later, capable of a rocking motion about a rocking center, between positions shown in FIGS. 19 and 20.

Adjacent to the original tray 4, there are provided a semi-circular sheet feeding roller 5 and a stopper 21 vertically movable by a stopper solenoid 108 (cf. FIG. 5).

The original sheets P stacked on the original tray 4 is prevented from movement toward the downstream direction, by the stopper 21 in the protruding position. When the copying conditions are entered and the copy start key is depressed in the operation unit of the image forming apparatus 500, the stopper 21 is retracted to open the path of the original sheets P, which move in the downstream direction by the action of the feed roller 5. In this state, the partition member 22, connected to the partition motor 105 (cf. FIG. 23) provided in the reference guide member 33 on the tray 4 is rotated and placed on the original sheets P, in order to separate the processed originals from the unprocessed ones.

At the downstream side of the stopper 21, there are provided a transport roller 38 and a separating belt 6, constituting a separating unit and rotated as indicated by arrows, thereby separating one by one the original sheets P advanced from the tray 4 and forwarding the thus separated original sheet further in the downstream direction.

Above the stopper 21, there is provided a weight 20 which can be lowered by a weight solenoid 109 (cf. FIG. 23) to pinch the original sheets P in cooperation with the feeding roller 6, thereby increasing the feeding force thereof, in case the original sheets P on the tray 4 are few and cannot proceed to the separating unit by the feeding force of the roller 5 alone.

The weight 20 also serves as thickness detecting means for the stack of the originals on the original tray 4, the means being an essential component in the present invention. In the following, the functions of the RDF 300 will be explained further, with reference to transport paths shown in FIG. 22 and driving mechanisms shown in FIG. 23.

Figure 22:
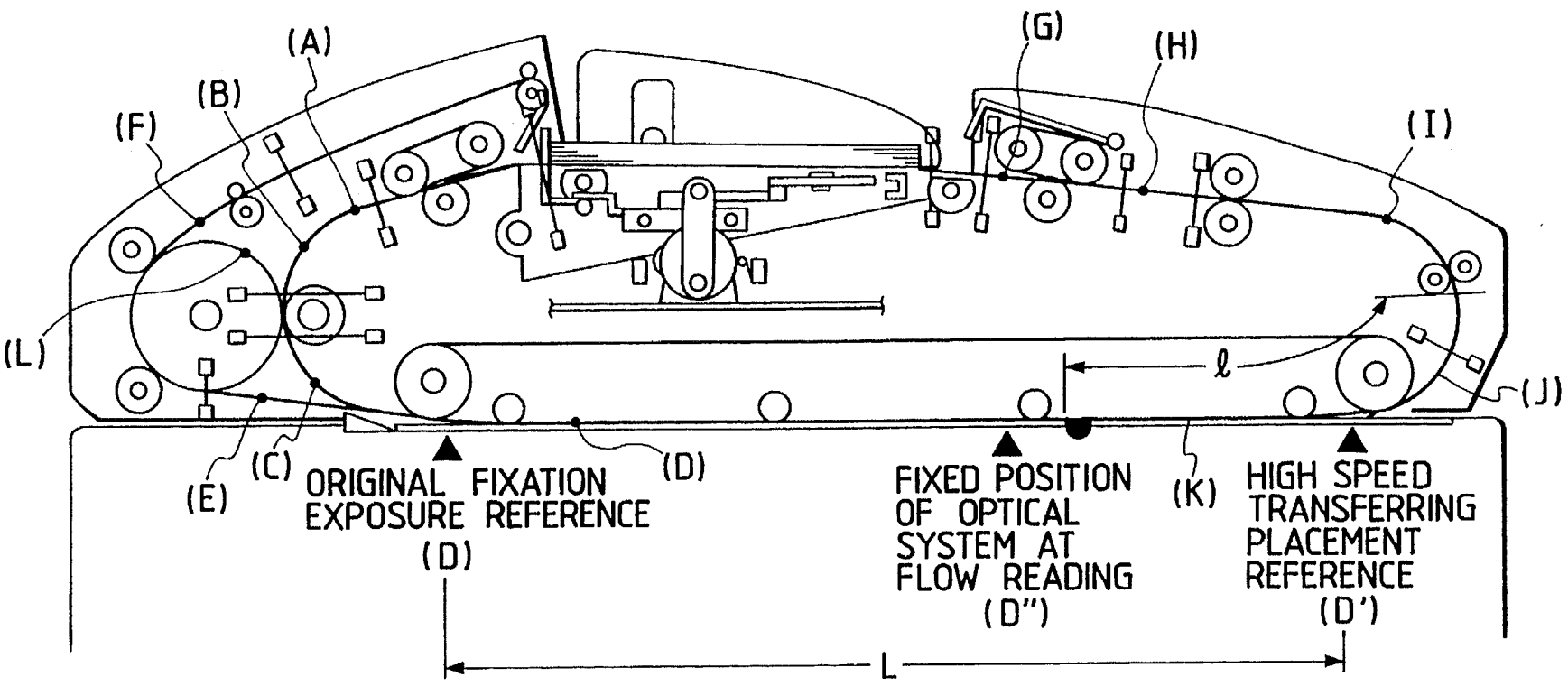
FIG. 22 is a schematic view showing transport paths of the original feeding device 300.

FIG. 22 is a schematic view showing the transport paths of the RDF 300 shown in FIG. 18.

From the separating units 6, 38 to the platen 501 there are formed transport paths A, B and C, which are connected in a bent manner to the path on the platen 501, thereby guiding the original sheet P onto the platen 501.

In the vicinity of the feed roller 5, there are provided entrance sensors 23*a*, 23*b*, constituting a transmissive photosensor for detecting the presence of the original sheet P on the tray 4. In a left-hand portion of the main body of the RDF 300, there is provided a large roller 10, and original discharge paths E, F are formed extending from the platen 3 to above the original tray 4 through the outside of the large roller 10.

An original inverting path G, for inverting the top and bottom sides of the original P, is branched from the discharge paths E, F at the top portion of the large roller 10 (cf. FIG. 22) and is united, at the downstream portion, with the original feed path B.

In the downstream portion of the discharge path F, there are provided relay rollers 44 and discharge rollers 11, for transporting the original sheet P, transported in the discharge paths E, F, onto the top of the original stack on the tray 4. The wide belt 7 positioned on the platen 501 transports and places the original sheet P to a predetermined position on the platen 501, and, after the image reading, discharges the original P from the platen. At the uniting point of the feed paths A, B, C and the inverting path G, there is provided a feed roller 9, which forms a loop on the arriving original sheet P thereby preventing skewed advancement.

In the vicinity of the roller 9, at the upstream side thereof, there are provided sensors 25*a*, 25*b* constituting a transmissive photosensor for detecting the front and rear ends of the original sheet P, passing any of the paths A, B, C and G.

At the downstream side of the roller 9, there are provided registration sensors 39*a*, 39*b*, constituting a transmissive photosensor for detecting the rear end of the original sheet P.

In the discharge paths D, E under the large roller 10, there are provided inversion sensors 26*a*, 26*b* constituting a transmissive photosensor for detecting the original sheet P discharged from the platen 501. Also, in the discharge path E between the large roller 10 and the discharge rollers 11, there are provided discharge sensors 27*a*, 27*b* constituting a transmissive photosensor for detecting the original sheet P passing the path E for discharge onto the tray 4. In the branching portion from the discharge paths E, F to the inverting path G, there is provided an inverting flapper 34 which switches the paths, by a movement between solid-lined and broken-lined positions shown in FIG. 23, under the control by an inverting flapper solenoid 110.

At the right-hand side of the main body of the RDF 300, there are provided second original separating means, and second original feed paths H, I, J, for feeding the original sheets to the image reading position on the platen 501, from the right-hand end thereof. The original tray 4 is rendered capable of a rocking motion, in relation to the rocking function of the tray 4 to be explained later, with the positions shown in FIGS. 19 and 20 as upper and lower limits.

Figure 20:
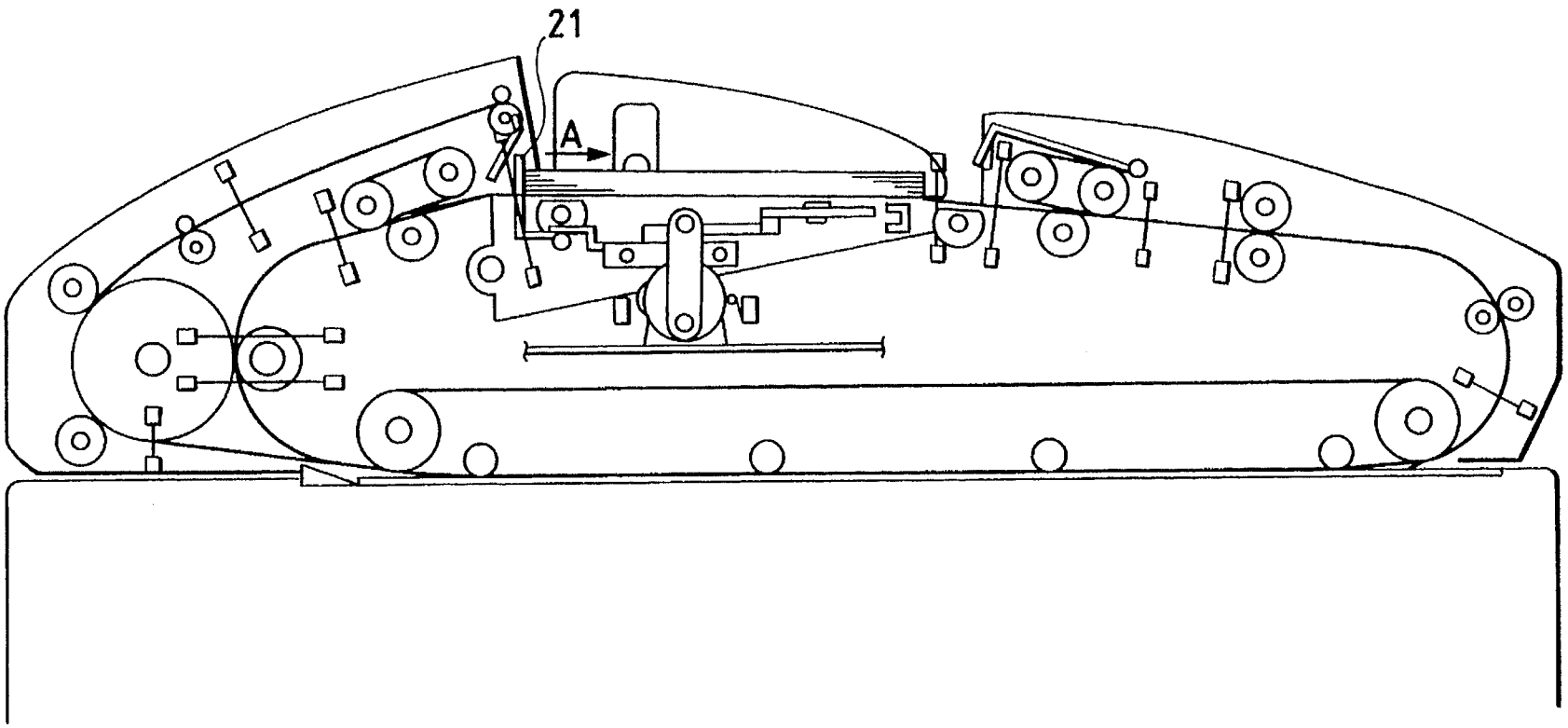
FIG. 20 is a view showing the rocking state of an original tray.

When the original tray 4 is in the lower limit position shown in FIG. 20, it is positioned adjacent to a second semicircular feed roller 8, and a transport roller 15 and a separating belt 14, constituting a second separating unit and rotated as indicated by arrows, whereby the original sheets P advanced from the tray 4 are one by one separated and transported further in the downstream direction.

The original tray 4 assumes the upper or lower limit position, according to the size of the originals placed on the tray and the operation conditions entered in the image forming apparatus. When the original tray 4 reaches the lower limit position, the aforementioned stopper 21 of the tray 4 moves the originals stacked thereon by a certain distance toward the second separating means.

Figure 23:
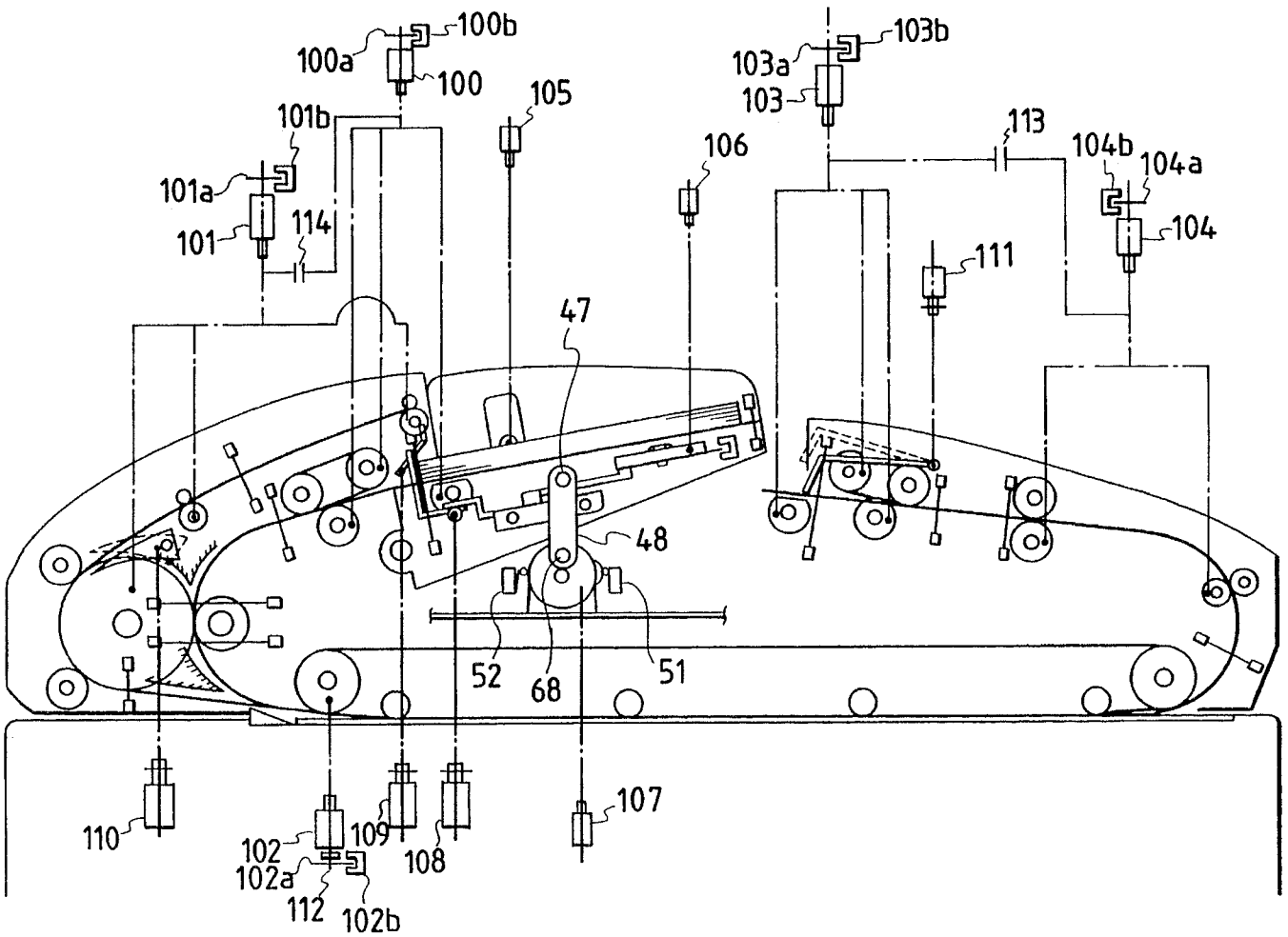
FIG. 23 is a view showing driving mechanisms for the transport paths of the device 300.

FIG. 23 illustrates the driving mechanisms for the transport paths of the RDF 300, shown in FIG. 18.

A first, separating motor 100 drives the transport roller 38 and the separating belt 6, constituting the separating unit, as indicated by arrows. A belt motor 102 drives a roller 36 for driving the wide belt 7, and the rotation is transmitted further to the roller 37 through the belt.

On the shaft of the belt motor 102 there is provided a brake 112, for ensuring the stop position of the belt 7. An inverting motor 101 drives the large roller 10 and the discharge rollers 11. A second separating motor 103 drives the transport roller 15 and the separating belt 14, constituting the second separating unit, as indicated by arrows.

A motor 104 drives the second feed roller 16 and the relay rollers 17. On the shafts of the motors, there are provided clock disks 100*a*, 101*a*, 102*a*, 103*a*, 104*a* respectively provided with plural slits, and there are also provided clock sensors 100*b*, 101*b*, 102*b*, 103*b*, 104*b* for generating pulses by detecting the slits with transmissive photosensors.

By detecting the revolution of the motors through the counting of the clock pulses from the sensors 100*b*, 101*b*, 102*b*, 103*b*, 104*b*, there can be measured the amounts of rotation of the transport rollers, whereby the amount of movement of the original sheet P can be detected.

An inverting flapper solenoid 110, for shifting the inverting flapper 34, places in the deactivated state said flapper 34 in the solid-lined position, thereby transporting the original sheet P from the discharge paths E, F to the original tray 4, and, in the energized state, places the flapper 34 in the broken-lined position, thereby guiding the sheet P from the discharge paths E, F to the inverting path G.

Figure 24:
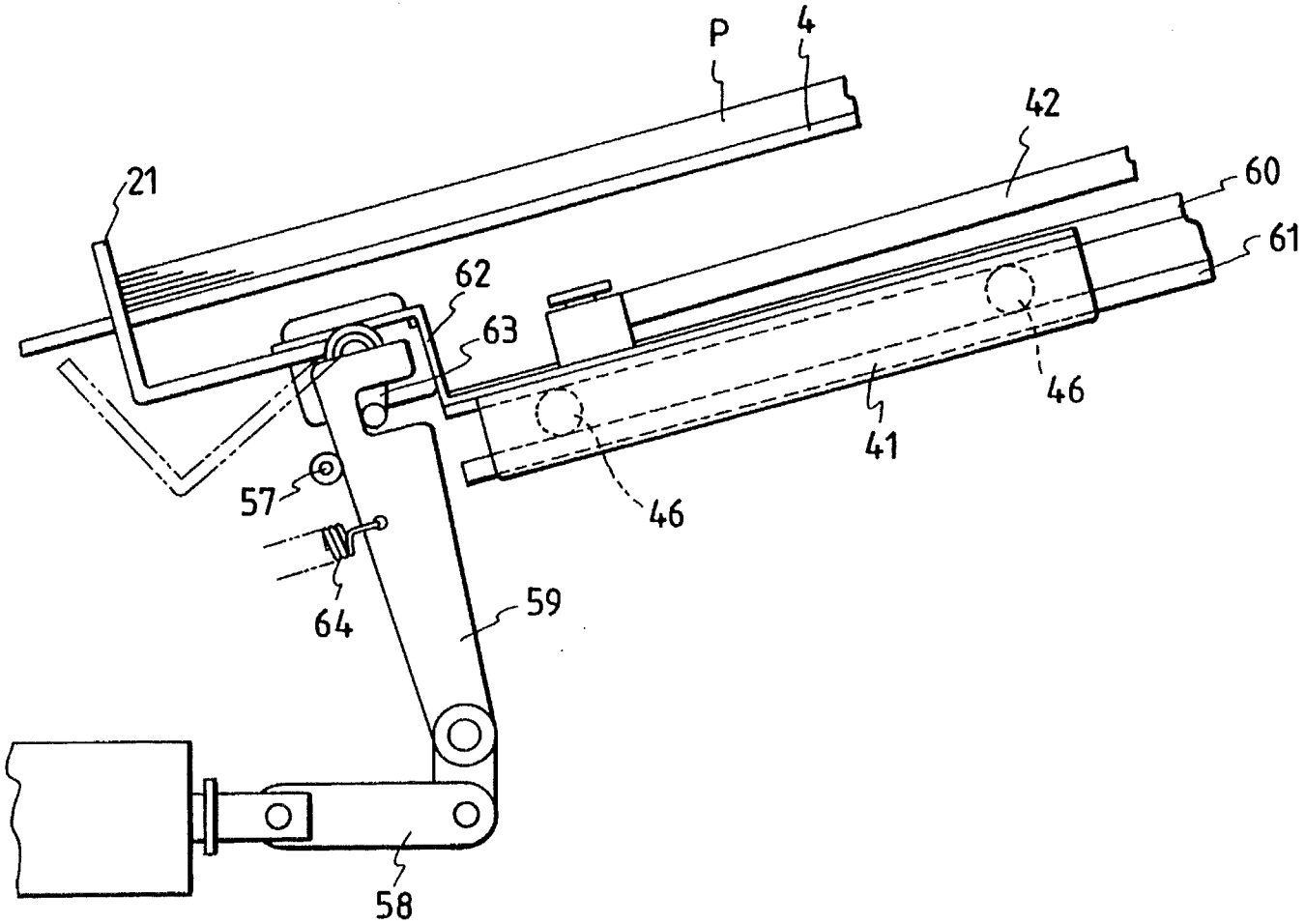
FIGS. 24 and 25 are partial magnified views showing the rocking mechanism for the original tray 4.
Figure 25:
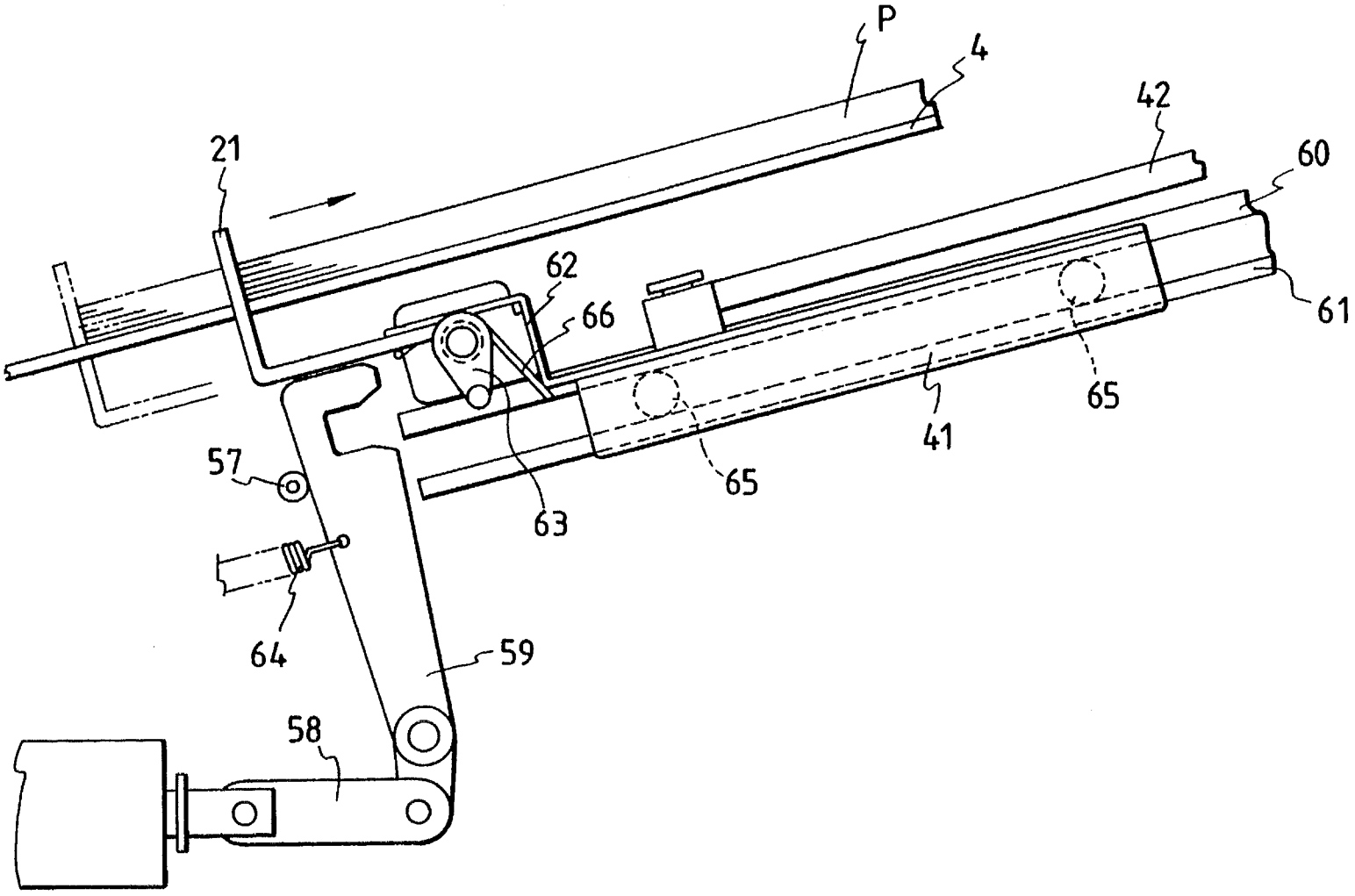
Figure 26A:
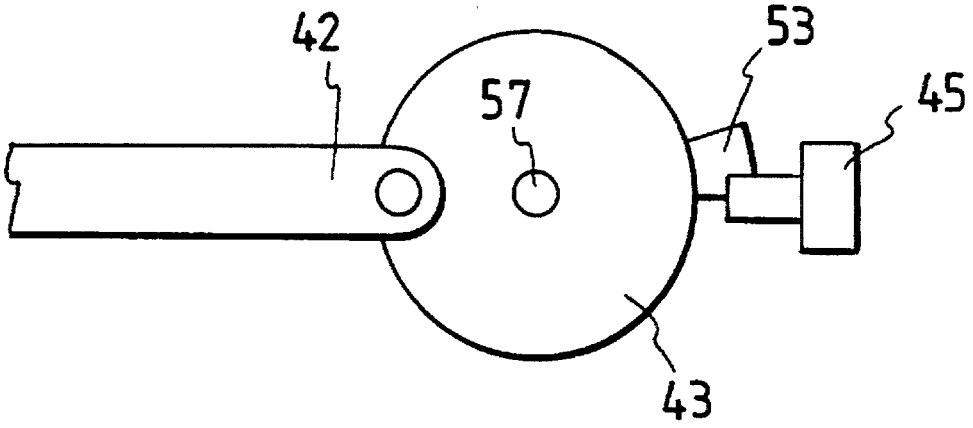
FIGS. 26A and 26B are partial magnified views showing the rocking mechanism for the original tray 4.
Figure 26B:
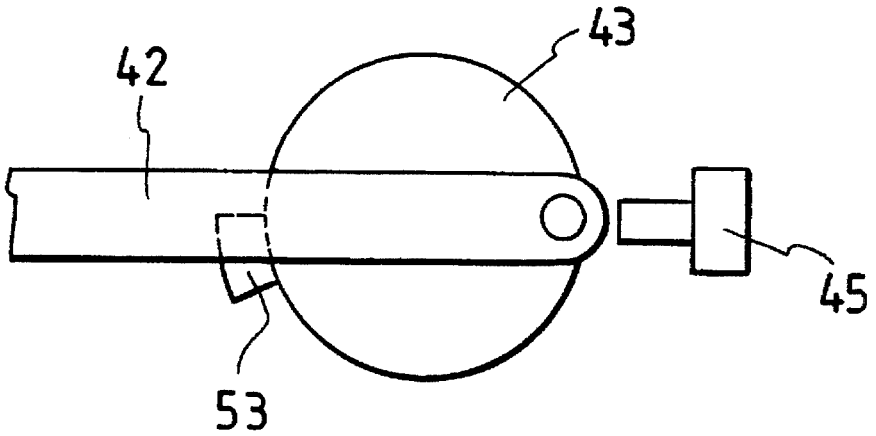

A stopper solenoid 108 for vertically moving the stopper 21 places, in the deactivated state, the stopper in the illustrated position thereby preventing the stack of the originals P on the tray 4 from moving toward the downstream direction, and, when energized, retracts the stopper 21 thereby opening the path for the original sheets P (cf. FIG. 24).

A weight solenoid 109, for vertically moving the weight 20, is in the illustrated position when deactivated, but, when energized, lowers the weight 20 to press the original sheets P onto the feed roller 5, thereby increasing the feeding force thereof. An original stopper solenoid 111, for vertically moving the original stopper 19, is in the solid-lined position or in the broken-lined position, respectively when deactivated or energized.

In the following, the rocking motion of the original tray 4 will be explained, with reference to FIG. 23.

The shaft of a tray rocking motor 107 is connected to a tray rocking arm 48. Under the original tray 4 there is provided a tray rocking shaft 47, which engages with an end of a tray rocking arm 48, of which the other end is fixed on a tray rocking arm shaft 68. Thus, by the rotation of said shaft 68, the tray rocking arm 48 rocks between positions shown in FIGS. 19 and 20, and the original tray 4 rocks about a center 40.

There are provided upper and lower limit switches 51, 52 for detecting the upper and lower limit positions of the original tray 4, and the rotation of the rocking motor 107 is controlled by the detection of the limit switches.

In the following, there will be explained the stack transporting means on the original tray 4, with reference to FIG. 23.

A stopper sliding motor 106 moves the stopper 21 in a direction A shown in FIG. 20, thereby moving the original sheets P to the second separating unit 14, 15, and returns to the original position after said movement.

Figure 27:
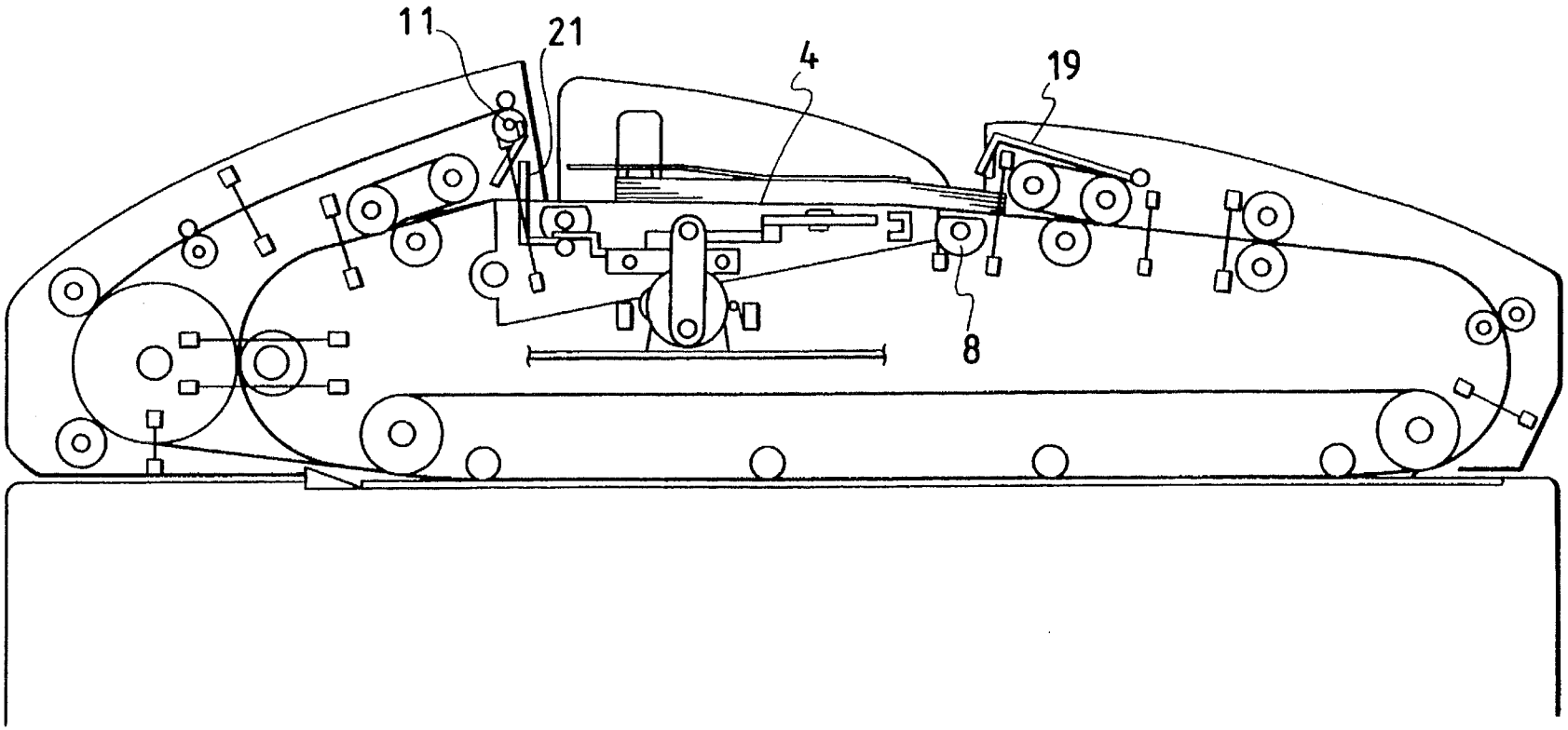
FIGS. 27 to 29 are views showing a stopper mechanism for the original tray 4.
Figure 28:
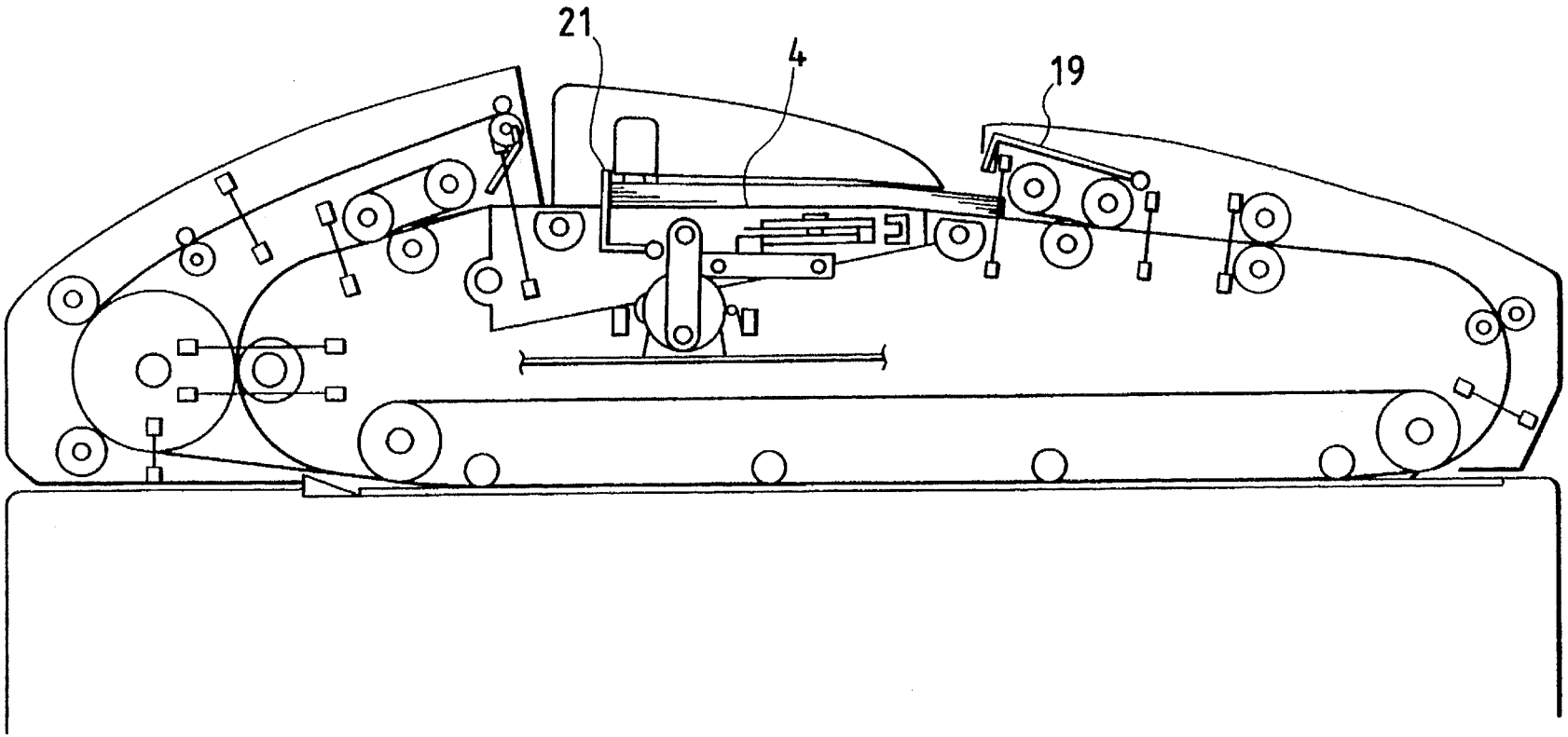

Also, as shown in FIGS. 27 and 28, when each original sheet is discharged from the discharge rollers 11 onto the original tray 4, the stopper 21 presses the rear end of said original toward the second separating unit, thereby improving the alignment of the originals P in the transport direction on the tray 4.

In the following, there will be explained the rocking mechanism and the rocking operation of the original tray, with reference to FIGS. 24 to 26B.

Inside guide members 60, 61 provided on the original tray 4 (cf. FIG. 24), a stopper slide member 41 moves by the rotation of an eccentric cam 43 transmitted through a link member 42 and by the cooperation of rollers 46. The eccentric cam 43 is associated with a flag 53 and a transmissive photosensor 45, for detecting the home position (FIG. 24). When the original tray 4 reaches the lower limit position, the original stopper 19 rocks upwards about the shaft 31 by the function of the solenoid 111 (cf. FIG. 23), thus accepting the stack of the originals P, transported by the stack transporting means. The stack is always transported to the detecting position of the transmissive photosensor 28*a*, 28*b*, provided in the upstream vicinity of the second separating means, for detecting the presence of the original sheet (cf. FIG. 21).

After the stack transportation, the original stopper 19 is placed on the stack. At the downstream side of the second separating means 14, 15, there is provided the second feed roller 16, which forms a loop on the arriving original sheet P, thereby preventing skewed feed thereof. In the upstream vicinity of the second feed roller 16, there are provided second sheet sensors 30*a*, 30*b*, constituting a transmissive photosensor for detecting the front and rear ends of the original sheet P.

At the further downstream side there are provided relay rollers 17, and, in the second feed path J there are provided transmissive photosensors 18*a*, 18*b* for detecting the front end of the original sheet P, thereby effecting the timing control of the copy sheet feeding in the image forming apparatus.

In the following, there will be explained the stopper mechanism of the original tray 4 shown in FIG. 19, with reference to FIGS. 27 and 28, which illustrate the function of the stopper mechanism.

Figure 21:
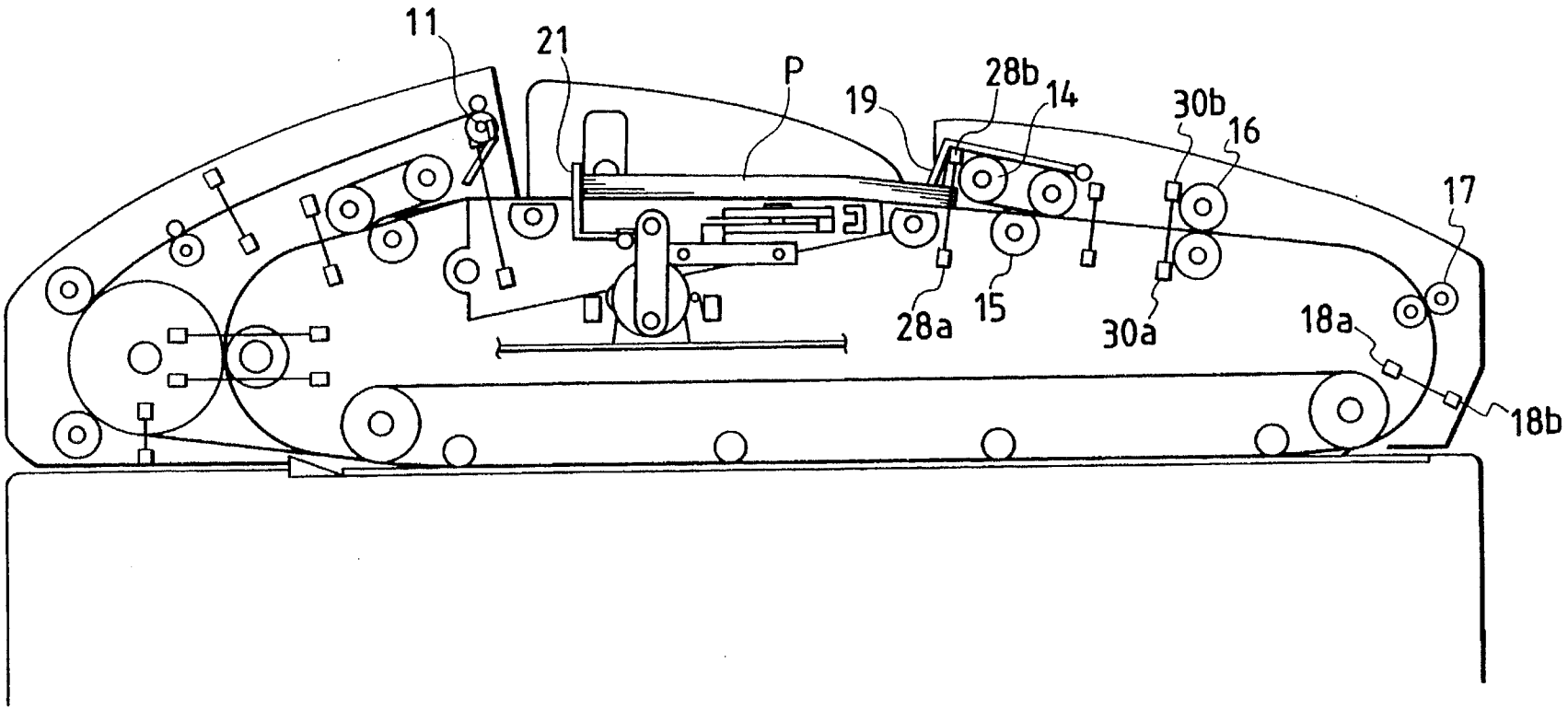
FIG. 21 is a view showing the rocking state of an original tray 4.
Figure 29:
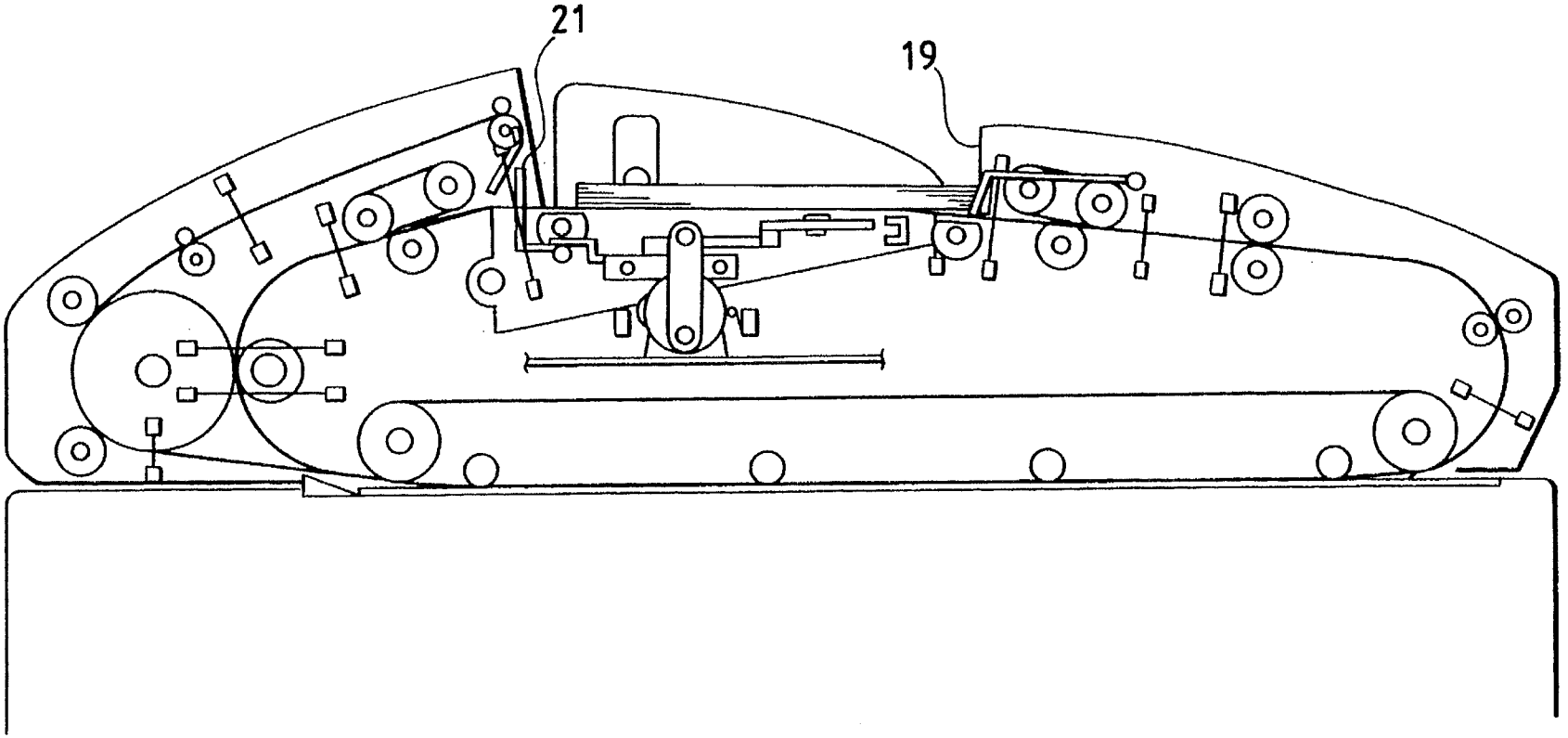

When the lowermost original is separated and transported by the rotation of the second semicircular roller 8, and if the copy number is selected as one in the image forming apparatus, the original stopper 19 remains placed on the original sheets P as shown in FIG. 21, thereby preventing the original sheet, discharged from the discharge rollers 11, from entering the second separating unit. If the copy number is selected as n (n cycles of the original sheets) in the image forming apparatus, the original stopper 19 is retracted upwards as shown in FIGS. 27 and 28 until the original sheet completes (n−1) cycles, and then is placed on the original sheets when the first original sheet in the n-th cycle is placed again on the stacked original sheets, thereby preventing the first original from entering the second separating unit. At the end of n-th cycle, the front end of the original sheets P is defined by the original stopper 19, as shown in FIG. 29. Subsequently the original tray 4 moves upwards and stops at the upper limit position. Also, when the copy number is selected as one in the image forming apparatus, the front end position of the original sheets P is defined by the original stopper 19 as shown in FIG. 29.

Figure 30A:
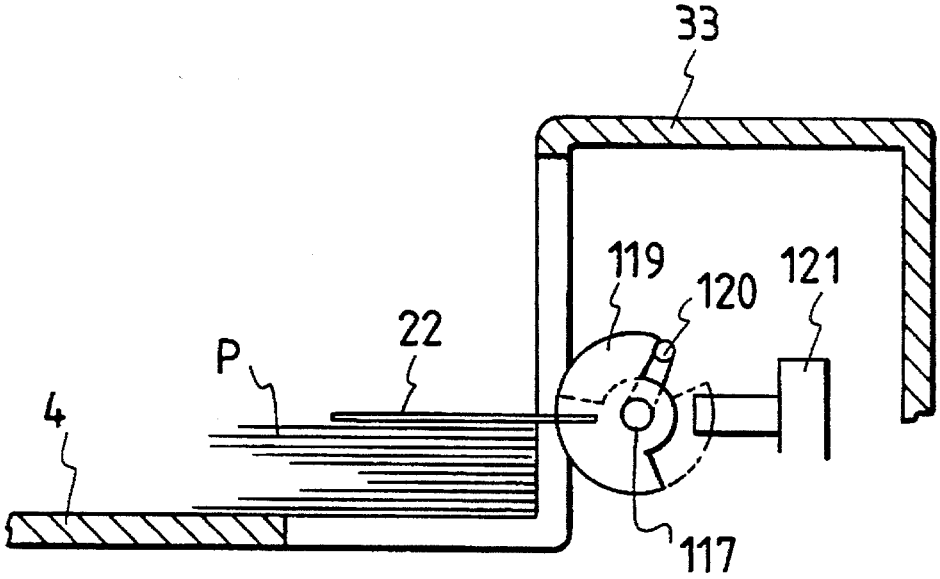
FIGS. 30A and 30B are partial cross-sectional views showing the structure of a partition member 22.
Figure 30B:
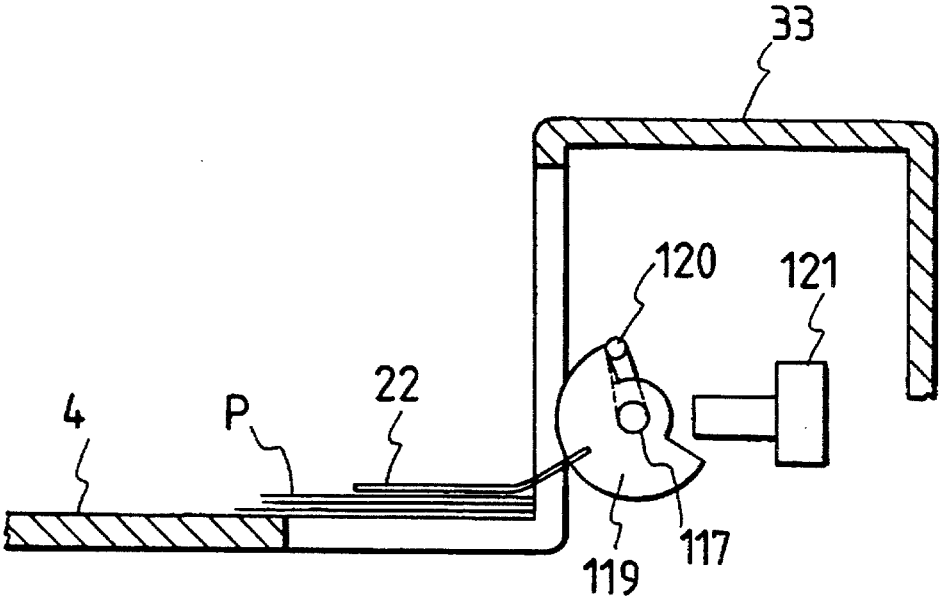

In the following, there will be given an explanation on the partition member 22 of the tray 4 shown in FIG. 4, with reference to FIGS. 30A and 30B, illustrating the structure of the partition member 22.

Referring to FIGS. 30A and 30B, on the shaft 117 of the partition member motor 105 shown in FIG. 23, there are coaxially provided a partition flag 119 rendered freely rotatable, and a partition lever 120 fixed on the shaft 117 and adapted to drive the partition flag 119.

The partition flag 119 is partially cut off in the periphery thereof as illustrated, and is provided with a partition member 22, made of a flexible material such as polyester film or a plate spring and adapted to integrally rotate with the partition flag 119 about the shaft 117.

The partition flag 119, having the center of gravity thereof at the side of the partition member 22, stops at a position with the partition member 22 vertically downwards, when not driven by the partition lever 120. A partition sensor 121 detects the partition flag 119, thereby identifying the position of the partition member 22.

When the original tray 4 is fully loaded with the original sheets P as shown in FIG. 30A, the partition member 22 lies flat on the sheets without deformation, since the distance from the end of the sheets to the mounting portion of the partition member 22 is short.

On the other hand, when the original tray 4 is loaded with fewer original sheets P as shown in FIG. 30B, a conventional rigid partition member is stopped when the front end thereof contacts the surface of the original sheets P, so that, at the end position thereof, the partition member becomes spaced from the surface of the sheets. In such conventional configuration, therefore, when the original sheet P is placed again on the partition member, it collides with the partition member and cannot be stably stacked thereon. In this embodiment, however, since the partition member 22 is flexible, it lies flat on the surface of the stack of the original sheets P as in the case of full stack, by the driving force of the partition lever 120.

Consequently, the partition member 22 always lies flat on the surface of the stack of the original sheets P regardless of the amount thereof on the original tray 4. Thus, the original sheets P discharged onto the partition member 22 can be stably stacked thereon, without collision with the member 22 and thus without disturbing the discharge.

In the following, there will be explained the jogging mechanism of the original tray shown in FIG. 19, with reference to FIG. 31.

Figure 31:
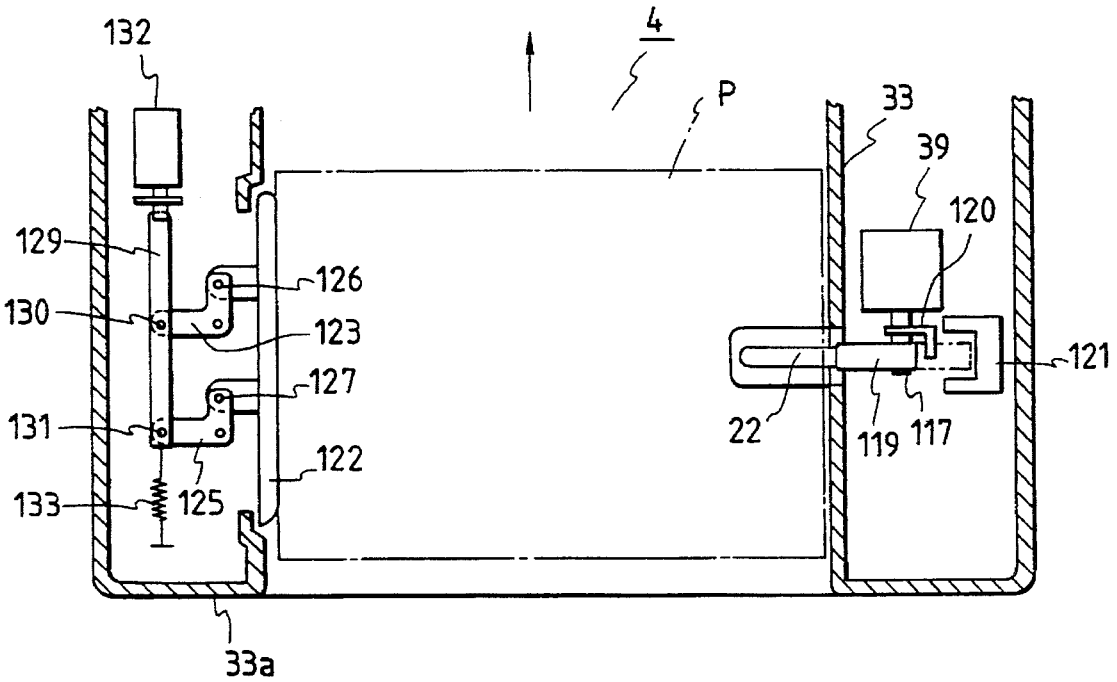
FIG. 31 is a view showing a jogging mechanism for the original tray 4.

Referring to FIG. 31, a jogging guide 122, constituting a part of a transversal defining plate 33*a*, is protrudably supported therefrom. On a side of the jogging guide, opposite to the original sheets, there are provided two jogging pins 126, 127 engaging with ends of jogging links 123, 125, of which the other ends engage with a jogging lever 129 through pins 130, 131.

The jogging lever 129 is linked to a jogging solenoid 132. Thus, when the solenoid 132 is energized, the jogging guide 122 presses the sheets P toward the reference guide 33, and, when the solenoid 132 is deactivated, the jogging guide 122 is separated, by a return spring 133, from the end face of the sheets.

Thus, at each re-loading of the original sheet P onto the original tray 4, the jogging solenoid 132 is energized and then turned off, thereby securely pressing the sheet P to the reference guide 33 and improving the alignment of the originals sheets P on the original tray 4.

Also, in linkage with the transversal defining plate 33*a*, there is provided an unrepresented slidable variable resistor, in order to obtain the transversal size of the sheets stacked on the original tray 4, by the movement of the defining plate 33*a*.

At the rear end of the original tray 4, there is provided, as shown in FIG. 19, a sheet length detecting sensor 68 which is composed, for example, of a reflective sensor and is provided for identifying whether the sheet length is in excess of that of the letter size (216 mm), or equal to or less than that of the letter size.

Regardless whether the sheet length detecting sensor 68 identifies the sheet length as in excess of or equal to or less than that of the letter size, if the set copy number is selected as "1" (entered in the operation unit of the image forming system) and if the approximate thickness detected by the partition member 22 identifies a condition $h<h2$ (corresponding to four originals or less in the present embodiment), the original sheets P placed on the tray 4 are fed from the side of the first separating means 6, 38 (switchback-path mode).

On the other hand, if the length detecting sensor 68 identifies that the sheet length is not in excess of that of the letter size (entrance sensors 23*a*, 23*b* being on, and length detection sensor 68 being off), the transversal size information of the sheet is obtained from the slidable variable resistor linked with the defining plate 33*a*, in order to discriminate whether the sheets are of A4 or letter size. If the sheet size is A4 size or letter size and if the set copy number is "2" or larger, or if the sheet size is A4 size or letter size, if the set copy number is "1" and if the aforementioned approximate thickness detection identifies a condition $h \geqq h2$ (corresponding to five or more originals in this embodiment), the original tray is lowered, and the original sheets are fed from the side of the second separating means 14, 15.

Besides, whether the sheet feeding is to be made from the side of the first separating means 6, 38 or the second separating means 14, 15 is determined by the image forming mode of the image forming apparatus. If the sheet size is other than A4 or letter size, or if the set copy number is "1" and a condition $h<h2$ is satisfied, the sheets are fed from the side of the first separating means. It is to be noted that the above-mentioned size classification is only an embodiment of the present invention, and can therefore be selected in an arbitrary manner.

In the following, there will be explained the structure and function of the thickness detecting mechanism for the stack of originals on the original tray 4, shown in FIG. 19, with reference to FIGS. 32 to 34 which are partial cross-sectional views showing the functions of said mechanism.

As shown in these drawings, the weight 20 is supported by a weight rocking arm 201, clockwise rotatably about an end 201*b* of said arm. In the normal state, the weight 20 is positioned with respect to the rocking arm 201, under an anticlockwise biasing force exerted by unrepresented spring means and with an end 201*e* of the arm 201 functioning as a stopper.

The weight rocking arm 201 is paired in the transversal direction with another rocking arm (not shown) and is integrally constructed therewith through a stay member 201*f*, whereby the weight 20 is supported on both sides.

At the rocking center of the rocking arm 201, there penetrates a shaft 201*a*, by means of which the rocking arms 201, 201' are supported by lateral plates of the main body 2.

Because of the above-mentioned structure, under the application of a clockwise moment, the weight 20 can freely rotate clockwise about the shaft 201*b*, with respect to the rocking arm 201.

A solenoid arm 202, for transmitting the power of a solenoid 109 by rotation about the penetrating shaft 201*a* of the rocking arm 201, is maintained in contact, by a spring 203, with a projection 201*g* of the rocking arm. The spring 203 is supported between a spring support portion 202*a* of said solenoid arm and a spring support portion 201*d* of the rocking arm.

Figure 32:
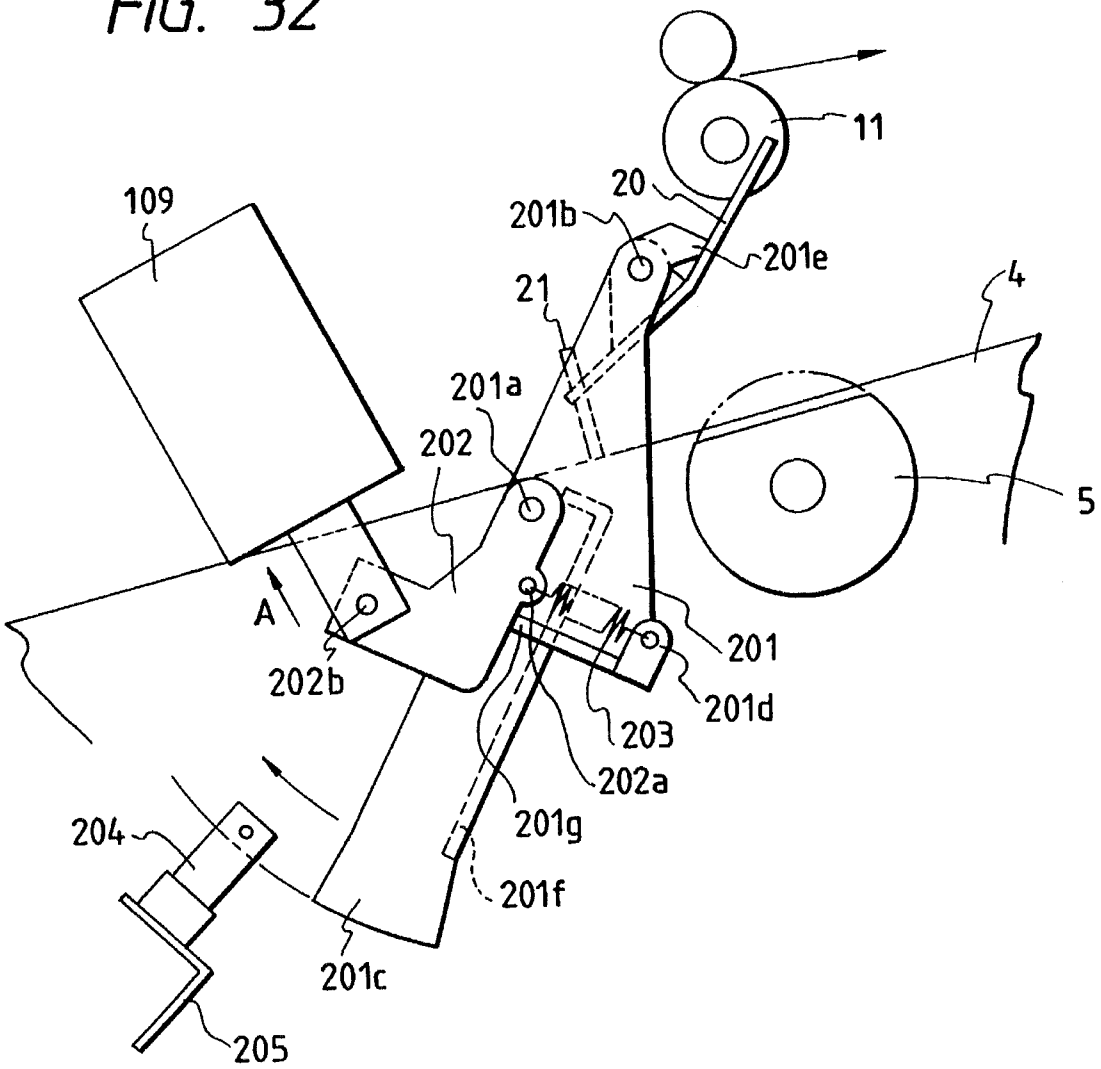
FIGS. 32 to 34 are partial cross-sectional views showing the function of a thickness detecting mechanism for the bundle of originals placed on the original tray 4.
Figure 33:
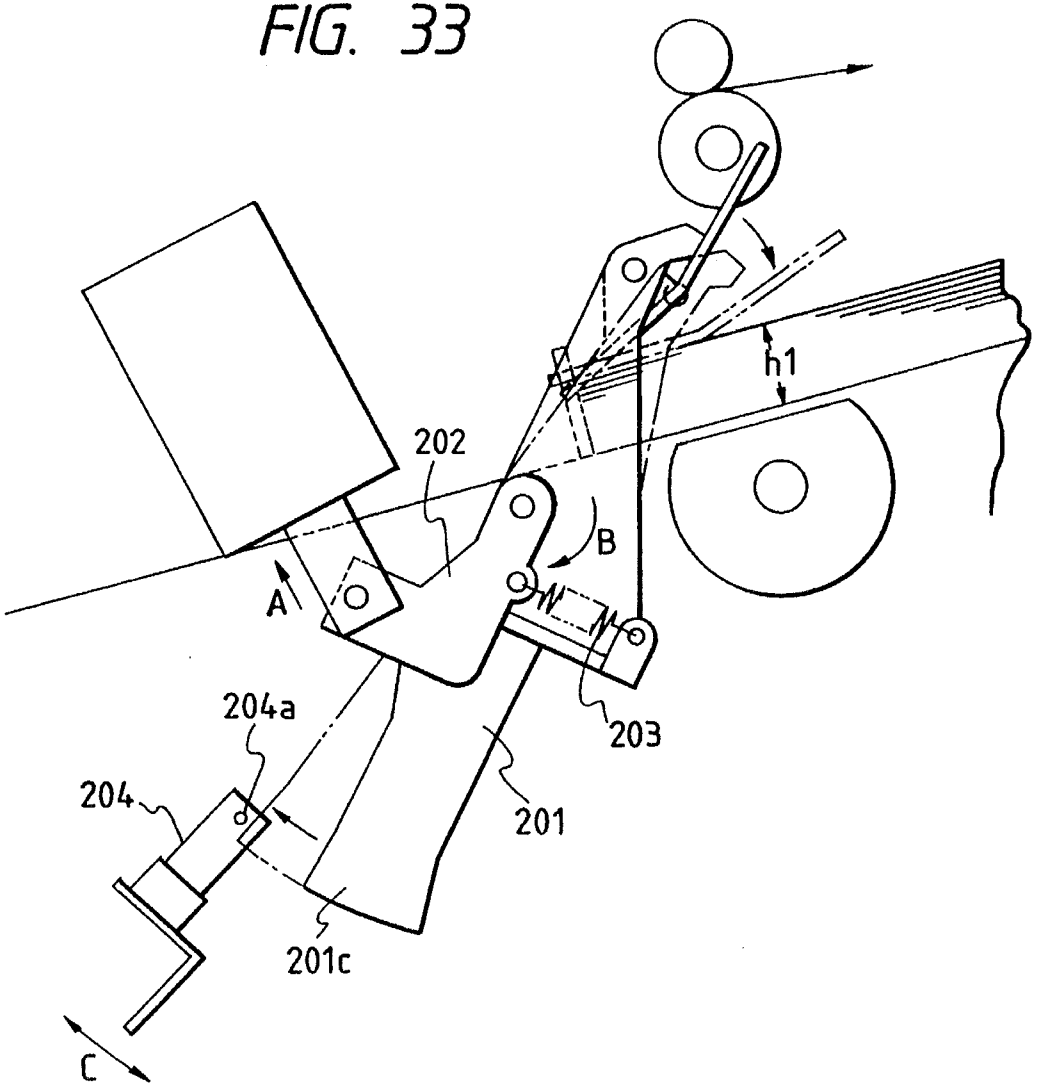
Figure 34:
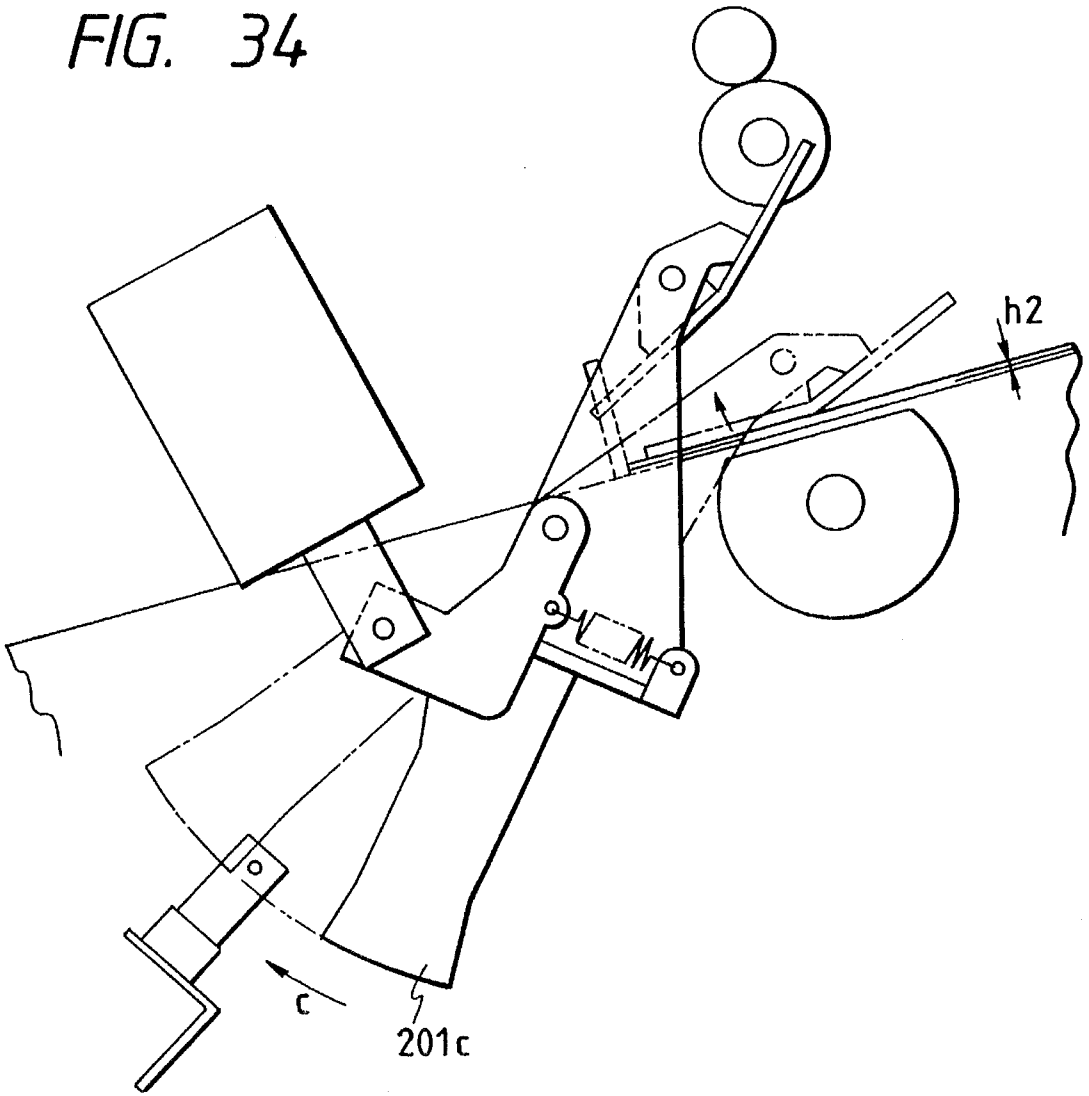

The spring has a considerably strong force, so that, when the solenoid 109 is energized to attract the plunger thereof in a direction A in FIG. 33 while the original sheets are absent on the original tray 4, the weight rocking arm 201 and the solenoid arm 202 rotate integrally about the penetrating shaft 201*a*, with the solenoid arm maintained in contact with the projection 201*g* as shown in FIG. 32.

When the semicircular feed roller 5 is rotated and comes into contact at the periphery thereof (indicated by a chain line in FIG. 32) with the weight 20, and the weight rocking arm 201 becomes unable to further rotate clockwise, and if the solenoid 109 is energized to attract the plunger in the direction A, the solenoid arm 202 rotates clockwise with respect to the rocking arm 201, about the shaft 201*a* against the biasing force of the spring 203, and is maintained at a position when the solenoid 109 effects the attraction of a predetermined stroke.

At the other end of the rocking arm 201 there is integrally formed a flag 201*c*, of which position can be detected in three levels, by a position sensor 204 supported by the main body 2 of the apparatus across a sensor holder 205, when the rocking arm is rotated clockwise by the solenoid 109.

In a first level shown in FIG. 33, by the energization of the solenoid 109 in response to a command from the control circuit (to be explained later) of the main body, the plunger is attracted in the direction A, whereby the weight rocking arm 201 rotates clockwise in a direction B about the penetrating shaft 201*a*. Thus the weight 20 presses the surface of the stacked originals, and the weight 20 itself rotates clockwise in a direction C about the shaft 201*b*, thus lying along the surface of the stacked originals.

The appropriate force of the spring 203 suppresses the curling of the original sheets, whereby the sheets are pinched in a flat state between the weight 20 and the original tray 4, as shown in FIG. 33.

The fluctuation in the thickness of the originals can be absorbed by the difference in the rocking angle between the rocking arm 201 and the solenoid arm 202. When the thickness h of the originals exceeds a predetermined value h1 (namely, when the number of originals on the original tray 4 exceeds the maximum storage capacity per bin of the sorter; for the ease of explanation, the maximum storage capacity per bin is assumed to be 50 sheets, and the original tray 4 is assumed to be capable of accepting up to 100 originals), the flag 201*c* of the rocking arm does not intercept the optical axis 204*a* of the position sensor 204 after the lapse of a predetermined time from the start of energization of the solenoid 109, whereby the output signal of the sensor remains turned off, and the RDF can recognize that the thickness of the stacked originals exceeds the predetermined value. The relationship between the thickness h of the stack of the originals and the number thereof somewhat fluctuates depending on the thickness per sheet, but, in the present embodiment, the relationship between said predetermined value h1 and the number of the originals can be adjusted, depending on the thickness of the original sheet most frequently used by the user, at the mounting of the RDF 300. Such adjustment can be achieved, for example, by rendering the position of the sensor 204 regulable in the direction C, or by moving the sensor 204 or the holder 205 in the direction C by a stepping motor or the like, according to a learning software which provides a stack thickness h1 corresponding to the anticipated number of originals, based on the original counting after one or several cycles of the original feeding.

In this manner, it is rendered possible to approximately detect the number of the originals, from the thickness h1 of the stack.

The number of the originals corresponding to the thickness h1 may involve a certain error, with respect to the designed number of originals, due to a detection error or a fluctuation in the sheet thickness, and, because of such error, the number of the copy sheets prepared from the originals may become less or more than the maximum storage capacity. The former case does not cause a problem because the number of the copy sheets is within the specification of the sorter, but, the latter case may result in an excessive storage of the sheets in the storage bin, or, in case of a stapling sorter, an excessive number of pages to be stapled. Such difficulty, however, can be avoided by including a certain margin in the actual storage capacity or in the actually staplable number of pages, with respect to the upper limit in the specification. For example, if the maximum storage capacity in the specification is 50 sheets, the actual space is so designed as to accept 50 to 60 sheets.

Then, if the number of the originals is less than a predetermined value as shown in FIG. 17 (in case of four or less originals in the present embodiment), namely if the stack thickness does not exceed a value h2, after the energization of the solenoid 109, the position sensor 204 is turned on for a certain time by the rotation of the rocking arm 201 in the direction C (cf. FIG. 43), and is then turned off. The RDF 300 can recognize, by such output signal state, that the thickness of the stacked originals on the original tray 4 does not exceed the value h2, or that the number of the originals is four or less.

Then, if the output signal is continuously on, it can be recognized that the thickness h of the stacked originals is within a range $h2<h<h1$, or, in case of the present embodiment, the number of the originals is within a range of about 5 to 50 sheets. FIG. 35 shows the relationship between the output signal state and the number of sheets. In the present embodiment, the relationship between the stack thickness h and the number of sheets is based on a paper of 80 gr/m$^2$ (thickness 100μ) which is frequently used.

Figures 36, 36A:
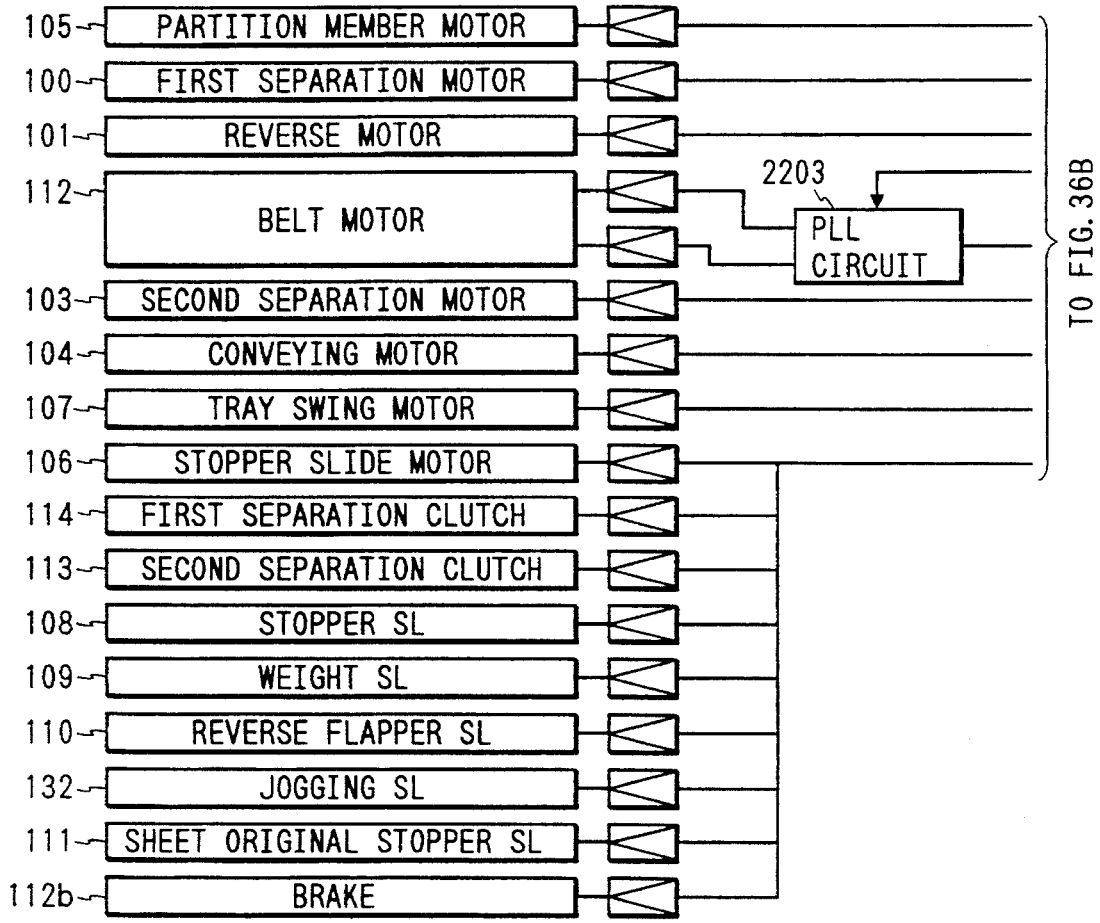
FIG. 36 is comprised of FIGS. 36A and 36B illustrating block diagrams of the structure of a controller CONT2.
Figure 36B:
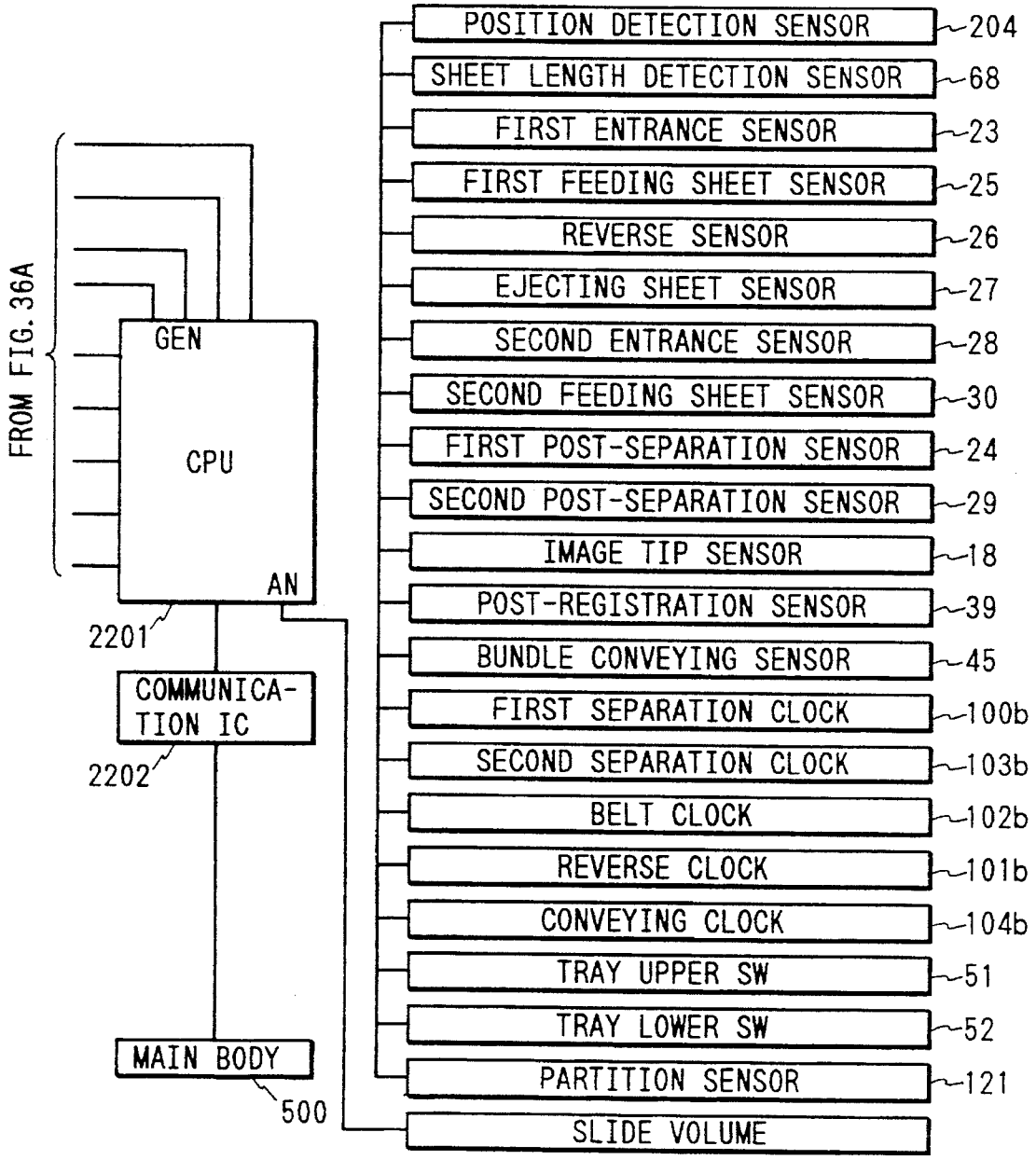

FIGS. 36A and 36B are block diagrams of the controller CONT2 shown in FIG. 18, wherein the same components as those in FIG. 23 are represented by same numbers.

A one-chip microcomputer 2201 is provided therein with a CPU, a ROM, a RAM, etc. and receives the signals of various sensors at input ports thereof.

The slidable variable resistor (slide volume) for detecting the original width is connected to an analog/digital converting port of the microcomputer 2201, whereby the resistance of the resistor can be detected in 255 levels.

Output ports of the microcomputer 2201 are connected to various loads, through drivers. In particular, the belt motor 112 is connected through a known PLL circuit 2203 and a forward/reverse driver, and the PLL circuit 2203 receives a rectangular signal of an arbitrary frequency from an output port GEN of the microcomputer 2201, whereby the revolution of the belt motor 112 or the speed of the wide belt 7 can be arbitrarily varied by the variation of the frequency.

Control data are exchanged with the controller CONT1 of the main body, through a communication IC 2202. The received data include the non-stop image reading speed data (v), original transport mode data such as one side/two side/non-stop image reading, original feeding trigger signal, original exchange trigger signal, and original discharge trigger signal, and the transmitted data include operation completion signals for original feeding/exchange/discharge, detected original size data, last original signal indicating the end of the original stack, and image front end signal in the non-stop image reading mode.

Figures 37, 37A:
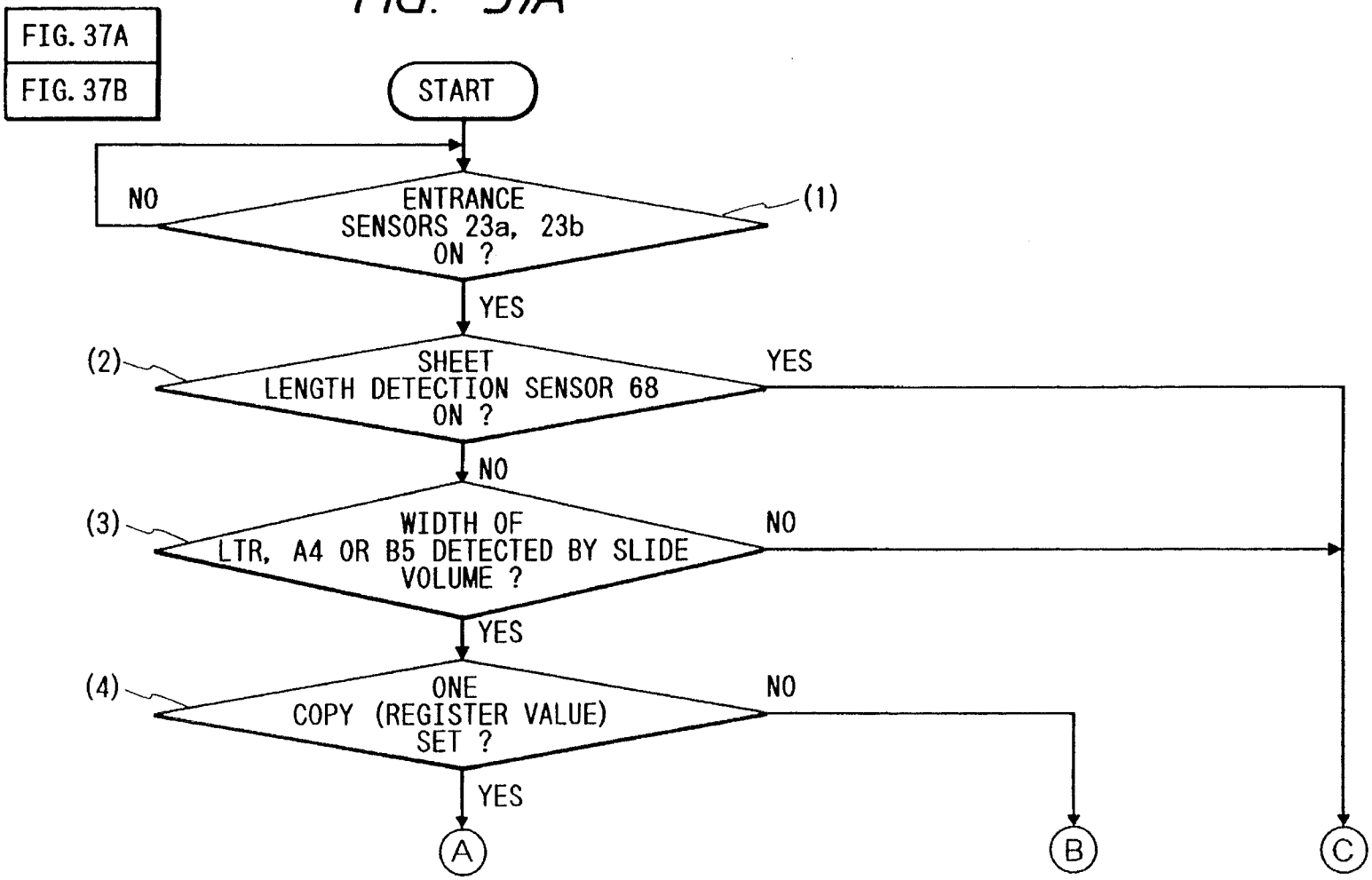
FIG. 37 is comprised of FIGS. 37A and 37B illustrating flow charts showing an example of the original feeding control sequence.
Figure 37B:
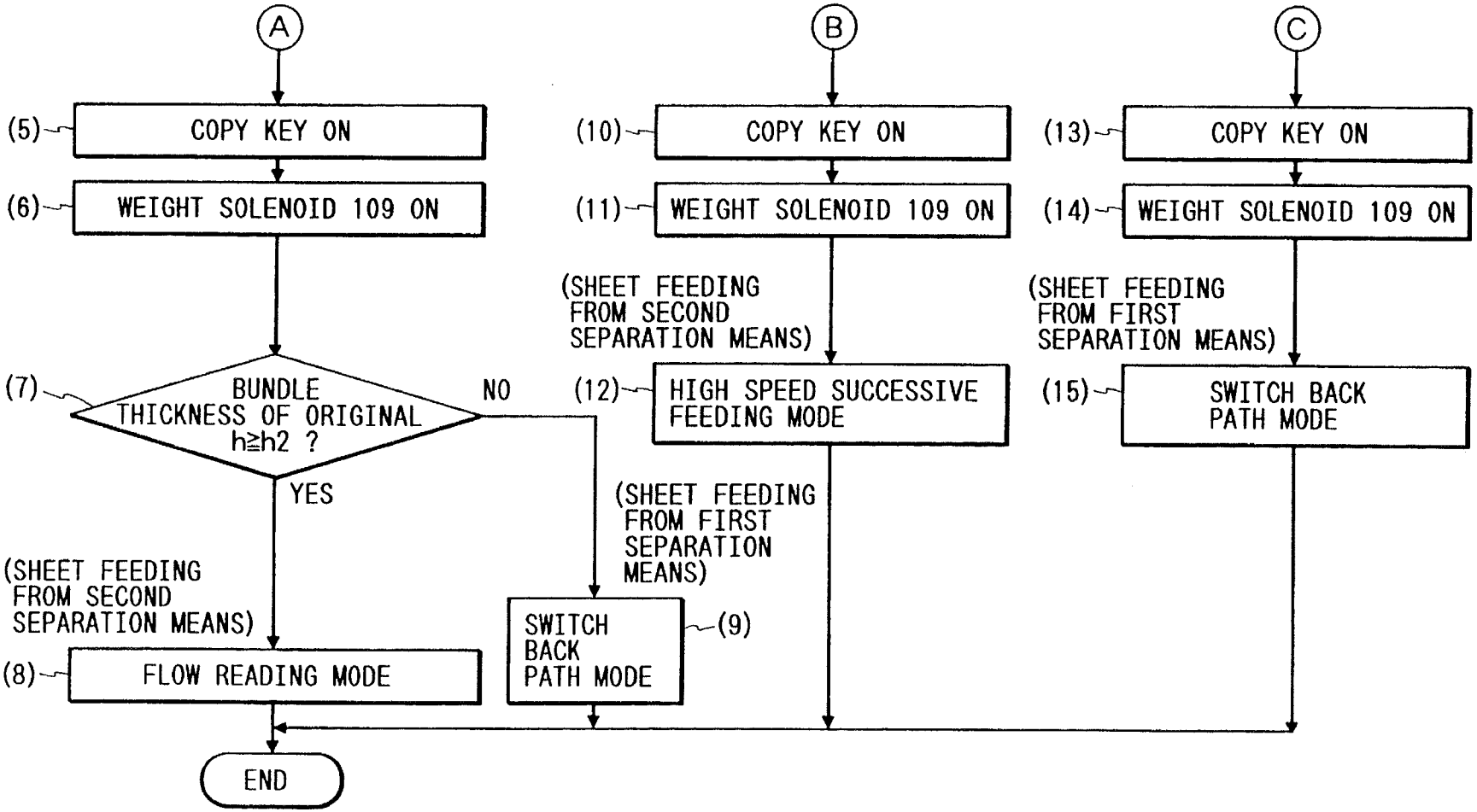
Figure 38:
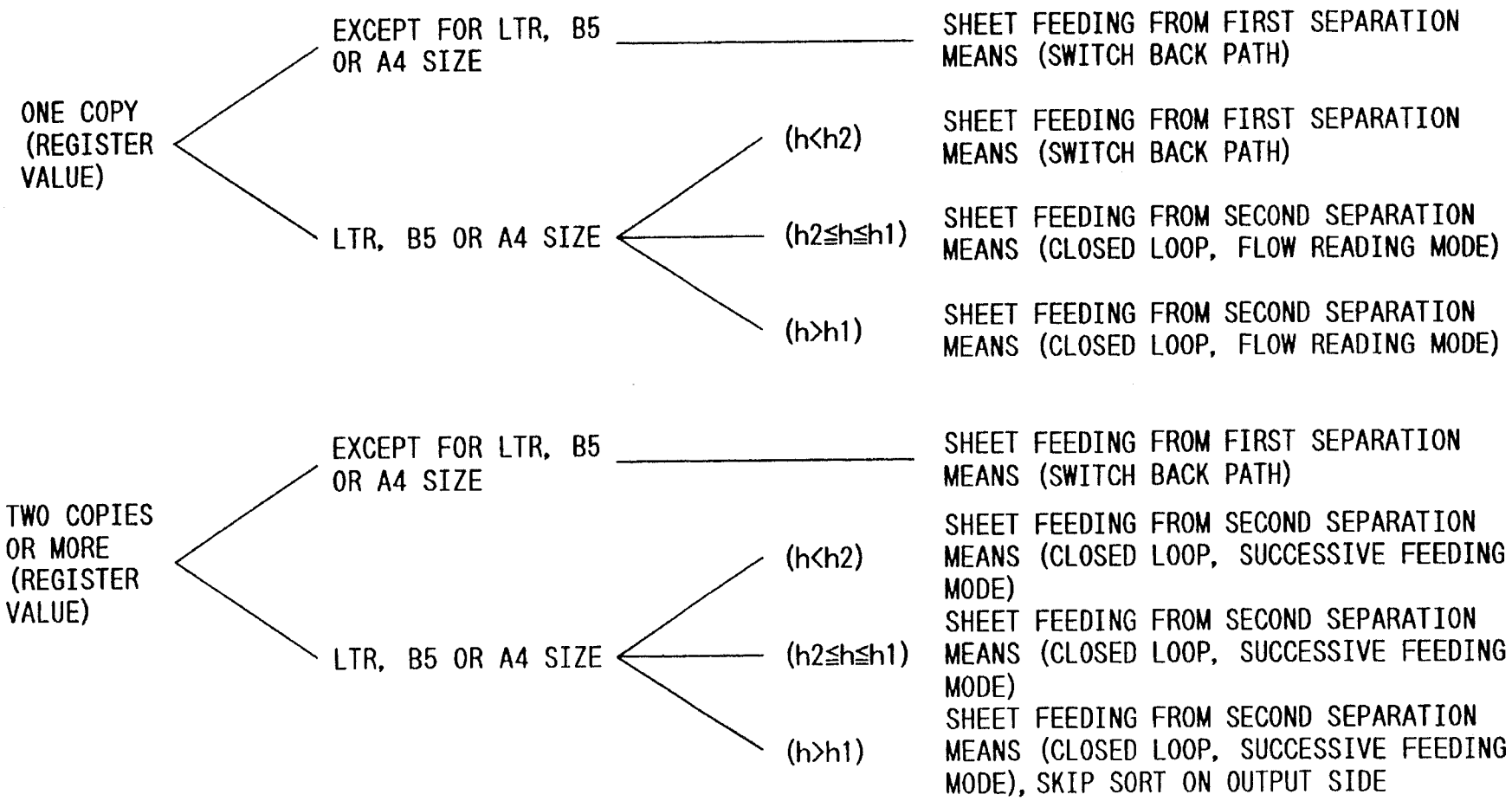
FIG. 38 is a chart showing the relationship between the set number of copies and the original feeding mode determined by the thickness of originals.

The ROM of the microcomputer 2201 stores in advance a control program corresponding to the flow chart shown in FIGS. 37A and 37B, and the controller CONT2 controls the inputs and outputs according to the control program, for example, in the same-size one-side copying mode, as shown in a system chart in FIG. 38.

FIGS. 37A and 37B are flow charts showing an example of the original feeding control sequence in an image forming system embodying the present invention, wherein (1) to (15) indicate process steps.

At first, when the originals are set on the original tray 4, a step (1) detects the originals by the entrance sensors 23*a*, 23*b*, then a step (2) identifies that the originals are of a large size if the length detecting sensor 68 is turned on, and, after the copy key is actuated in a step (13), a step (14) energizes the solenoid 109 for approximate thickness detection of the originals and discriminates whether $h>h1$ or $h\leqq h1$ is satisfied. Then, a step (15) effects the recycling of the originals in the switchback-path mode (sheet feeding through paths A, B, C, D, E, F through the first separating means 6, 38, platen 501 and discharge rollers 11), thereby completing a series of copying operations. If, in the step (2), the length detecting sensor 68 is turned off, the originals are identified as of a small size, and, a step (3) discriminates, by the slidable variable resistor (slide volume) linked with the transversal defining plate 33*a*, whether the width of the originals corresponds to the A4, letter or B5 size, and, if yes, a step (4) discriminates whether the set copy number (register value), entered into the operation unit of the main body 500, is "1" or otherwise. If it is "1", in response to the actuation of the copy key in a step (5), the solenoid 109 is energized (step (6)), then a step (7) discriminates by the position sensor 204 whether a condition $h\geqq h2$ is satisfied, and, if not, the number of the originals is identified as few (4 or less in the present embodiment). Thus, the originals are fed through the first separating means in the switchback-path mode (step (9)), whereby a series of copying operations is completed.

On the other hand, if the condition is satisfied, the original feeding is executed through the second feeding means 14, 15, whereby a series of copying operations is executed in the non-stop image reading mode (flow reading mode) (step (8)).

If the set copy number is "2" or larger, after the copy key and the weight solenoid are turned on, there is executed the approximate thickness detection of the original stack, then there is discriminated whether a condition $h<h1$ or $h\geqq h1$ is satisfied, and, if satisfied, a series of copying operations is executed in a high-speed continuous feeding mode through the second separating means 14, 15.

In this situation, in case of $h>h1$, the sorter sorts the copy sheets by skipped sorting, but, in case of $h\geqq h1$, the sorter sorts the copy sheets into the consecutive storage bins without skipping. This also applies to the step (7) or (14).

In the above-explained embodiment, the high-speed continuous feed mode and the non-stop image reading mode are switched according to whether the set copy number is identified as "1" or not in the step (4), but such criterion for switching by the copy number is not necessarily limited to "1".

Also, in the embodiment, the original sheets are handled through the switchback-path for improving the productivity in case the detected approximate thickness of the sheet stack does not exceed h2 corresponding to about four originals, but such number of originals is not limitative as long as the difference in time from the actuation of the copy key to the start of scanning of the first original can be absorbed, or as long as the total copy time is shorter, in consideration of the total lengths of the switchback-path and the closed-loop path and the linear speed.

In this manner, under any situation, the RDF recognizes in advance a path capable of shortening the total copy time and handles the original sheets through such path of the shorter total copy time.

In the following there will be explained the outline of the post-processing of the copy sheets on the output side in the image forming system.

For the post-processing, there is connected a sorter 700 with stapling function, provided, for example, with 20 storage bins, as shown in FIG. 18.

In the following, there will be explained the sheet sorting operation when the thickness h of the original stack in the RDF 300 satisfies a condition h>h1, wherein the thickness h1 corresponds to about 50 original sheets.

In this embodiment, the RDF 300 is assumed to be capable of accepting up to 100 original sheets, and the sorter is, as mentioned above, provided with 20 bins as in the ordinary sorters.

If the number of bins is reduced to about 10, the number of sets of copies sortable in one operation becomes limited. On the other hand, if the number of bins is increased in excess of 20, the storage capacity per bin has to be considerably reduced, unless two or more sorters are connected. For these reasons, the present embodiment considers a most popular sorter, which is provided with 20 storage bins, capable of storing 50 sheets per bin.

Figure 39:
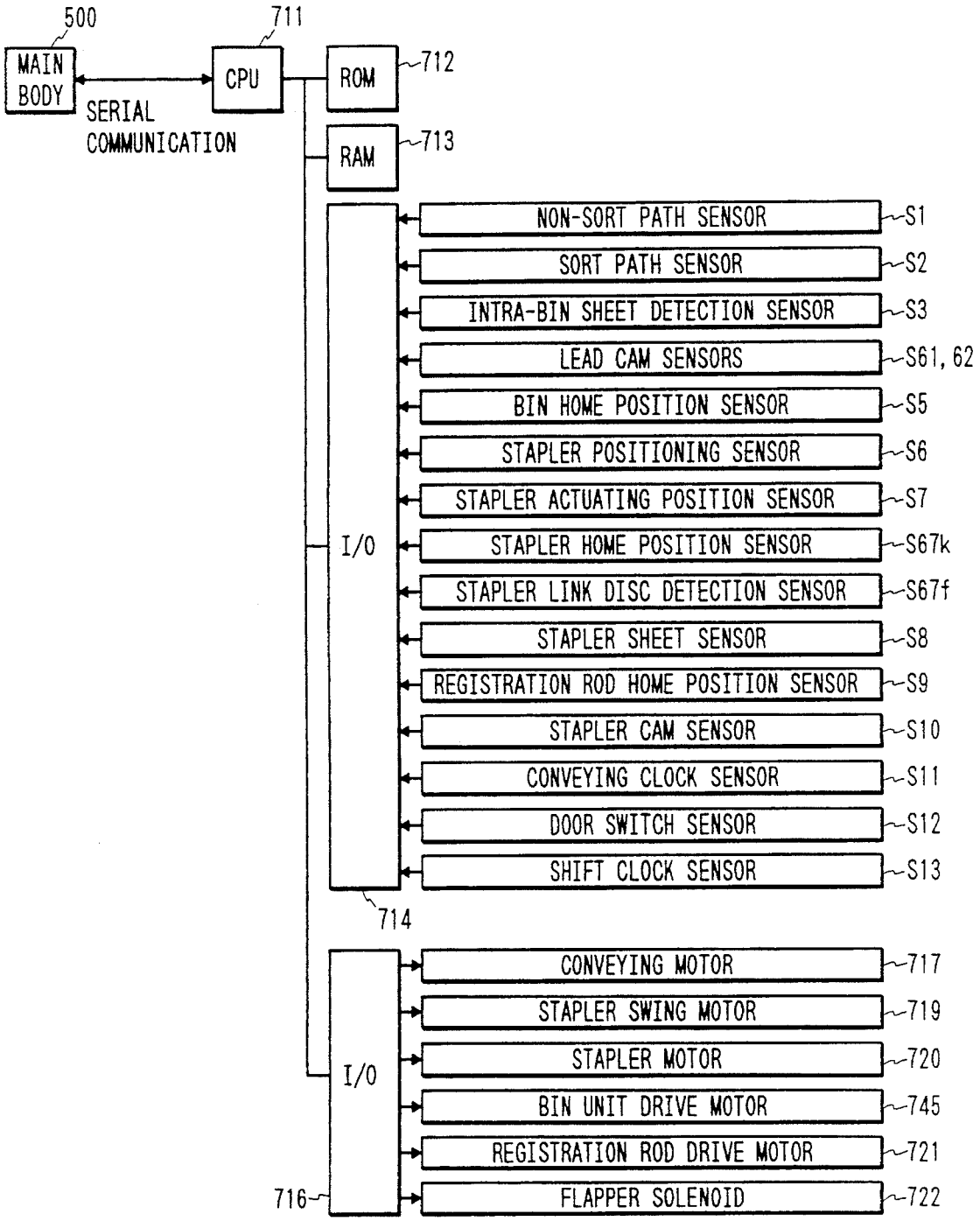
FIG. 39 is a block diagram showing the structure of the controller of a sorter 700.

FIG. 39 is a block diagram showing the structure of the controller of the sorter 700 shown in FIG. 18.

A CPU 711 controls the entire sorter 700, based on a control program stored in a ROM 712. A RAM 713 functions as a work area for the CPU 711. Input/output ports 714 transmits the input signals from various sensors S1–S3, S8–S13, S61, S62, S67*k*, S67*f* etc. to the CPU 711.

Input/output ports 716 send drive signals to the transport motor (conveying motor) 717, stapler rocking motor (stapler swing motor) 719, stapler motor 720, bin unit driving motor 745, aligning rod driving motor (registration rod drive motor) 721, flapper solenoid 722, etc.

Figure 40:
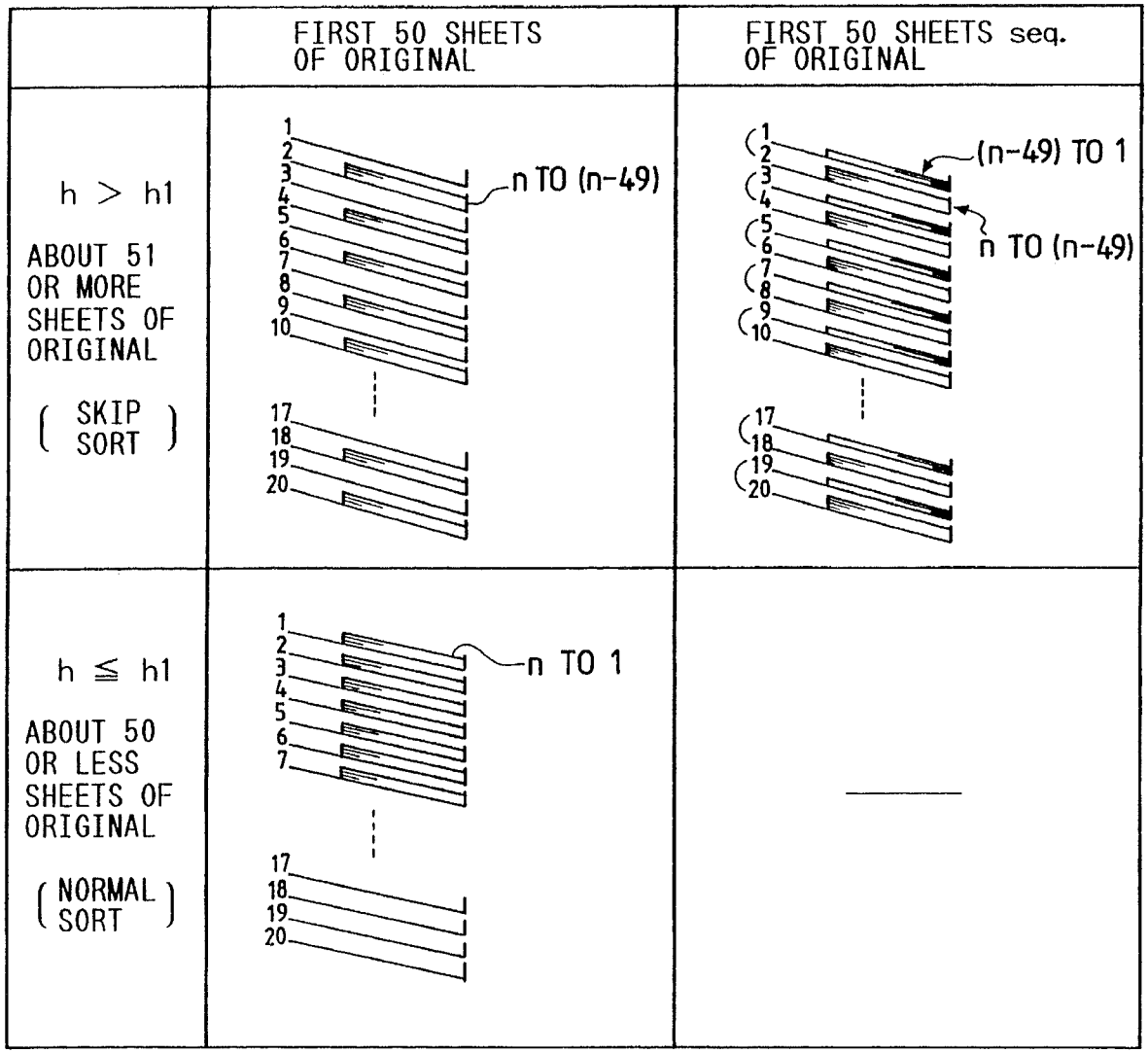
FIG. 40 is a schematic view showing the sheet stacking states in different sorting modes of the sorter 700.

FIG. 40 is a schematic view showing the sheet storage states in different sorting modes of the sorter 700 shown in FIG. 18.

As shown in FIG. 40, if the original stack thickness satisfies a condition h>h1 (h1 corresponding to about 51 original sheets) in the skipped sorting mode, since the originals are stacked in face-up mode and are separated from the bottom of the stack, the copy sheets prepared from the initial 50 original sheets, namely from the last n-th page to (n–49)-th page, are stored in the every other even-numbered bins, namely 2nd, 4th, 6th, 8th, . . . bins, and the copy sheets corresponding to the remaining originals from the (n–50)-th page to the 1st page are stored in the 1st, 3rd, 5th, 7th, . . . bins.

Thus, the copies corresponding to the original sheets can be obtained from the vertically adjacent two bins, namely 1st and 2nd bins, 3rd and 4th bins, or 5th and 6th bins etc. Besides, the copy sheets taken from the 1st, 2nd, 3rd, 4th, 5th, 6th, . . . bins are arranged in the proper order of pages and are therefore convenient for handling.

Figure 41:
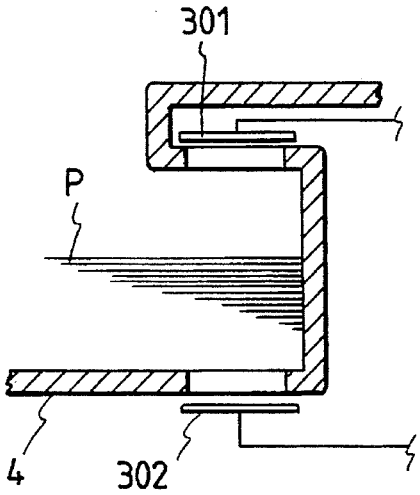
FIGS. 41, 42A, 42B and 43 are partial cross-sectional views showing examples of the thickness detecting mechanism for the originals on the original tray.

In the foregoing embodiment, the approximate detection of the number of originals on the original tray 4 is achieved by measuring the stacked thickness thereon by the weight 20, but it is also possible to provide electrodes 301, 302 as shown in FIG. 41 above and below the stacked originals on the tray 4 and to detect the change in the capacitance C by the presence of the stacked originals, or to detect the weight of the originals placed on the tray. In the former method, the number of the originals is detected from the change of the capacitance C, induced by a change in the relative dielectric constant $\epsilon r$ caused by the presence of the originals. The capacitance C is given by:

$$C=\epsilon r\cdot\epsilon_0 S/d$$

wherein S: electrode area, d: electrode distance, $\epsilon r$: relative dielectric constant, and $\epsilon_0$: dielectric constant of vacuum.

Figure 42A:
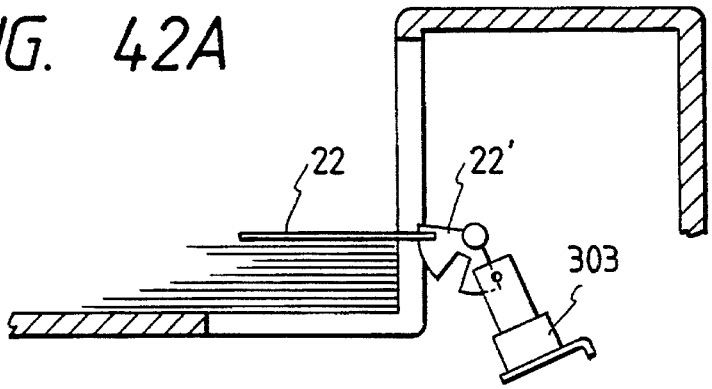

It is furthermore possible to provide an actuator capable of pressing the top of the stacked originals on the original tray 4, and to detect the thickness by detecting the level of the stack, as shown in FIG. 42A.

For example, the partition member 22 of the foregoing embodiment may be given an integral flag 22' for detecting the position of the partition member, and to obtain an output signal corresponding to the stack thickness by a photointerruptor 303.

Figure 42B:
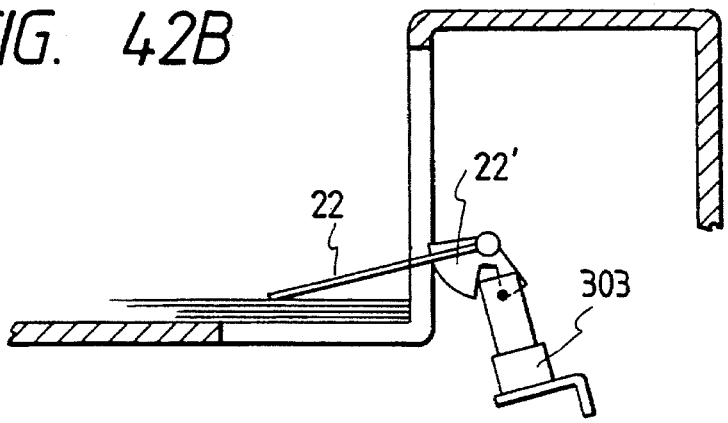

When many originals are stacked as shown in FIG. 42A, the output signal of the photointerruptor 303 is turned off, but, when few originals are stacked as shown in FIG. 42B, the output signal is at first off and then on.

Figure 43:
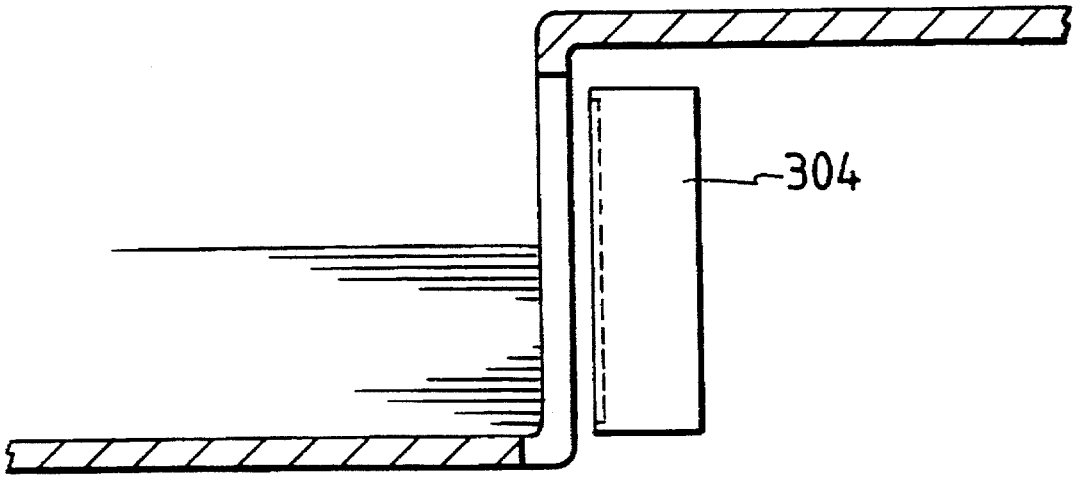

It is furthermore possible to provide the original tray 4 with detection means capable of directly detecting the top position of the stack, such as a CCD line sensor, as shown in FIG. 43, thereby detecting the top position of the stack. In such case, the precision of detection can be improved by providing a pressure member (not shown) for suppressing the curl of the sheets.

As explained in the foregoing, in the 3rd image forming system, the control means selects the process conditions of the RDF and the sorter so as to shorten the processing time for the original sheets, based on the approximate number of the original sheets detected by the detection means prior to the feeding of the original sheets, whereby the image forming process can be started with a shortest time, corresponding to the approximate number of the original sheets placed on the original tray.

Also, in the 4th image forming system, the detection means is adapted to detect the approximate number of the original sheets stacked on the original tray, based on the thickness of the sheets, whereby the original sheet number, required for selecting the optimum process for the processing of the originals and the recording media, can be determined without actual feeding of the original sheets.

Also, in the 5th image forming system, the control means selects the feed path from the RDF so as to shorten the process time for the original sheets, based on the approximate number of the original sheets detected by the detection means prior to the feeding of the original sheets, whereby the image forming process can be started with a shortest feed path, according to the approximate number of the original sheets placed in the original tray.

Also, in the 6th image forming system, the detection means is adapted to detect the approximate number of the original sheets placed on the original tray, based on the thickness of the original sheets, whereby the original sheet number, required for selecting the optimum feed path, can be determined without the actual feeding of the original sheets.

Also, in the 7th image forming system, the control means selects a 1st feed path from the original tray in case the detection means detects that the thickness of the original sheets stacked on the original tray does not exceed a predetermined value, whereby the image forming process can be achieved with a high throughput even when the number of the original sheets on the original tray is limited.

Also, in the 8th image forming system, the control means selects the skipped sorting mode in the sorter in case the detection means detects that the thickness of the original sheets stacked on the original tray exceeds a predetermined value, whereby an optimum sorting mode can be securely selected prior to the start of the original feeding.

Consequently, there is obtained an advantage of selecting optimum process conditions for the original sheets and the copy sheets, capable of achieving a high throughput.

It is also possible to combine the method of the former embodiment in which a set of copies is prepared in the first cycle of the original sheets with the counting of the number thereof, and, in the 2nd cycle of the original sheets, the non-skipped sorting or skipped sorting is selected according to the number of the original sheets, and the method of the latter embodiment of detecting the thickness of the stack of the original sheets and selecting the non-skipped sorting or skipped sorting according to the thickness. For example, in case of using a sorter with 20 storage bins of a maximum storage capacity of 50 sheets per bin, the thickness of the stacked originals is detected prior to the 1st feeding cycle of the originals, and, if said thickness exceeds a value corresponding to 50 sheets, a set of copies is prepared in said first cycle of the original sheets, with the counting of the number thereof, and the obtained copy sheets are stored in the 2nd bin. If the number of the original sheets at the end of the first cycle does not exceed 50, the copy sheets prepared in the 2nd cycle of the original sheets are sorted into the 1st, 3rd, 4th, 5th, 6th, . . . bins. On the other hand, if the number of the original sheets exceeds 50, the sheet sorting is switched from the 2nd bin to the 1st pin, in the course of the copying operation of the 1st cycle of the original sheets. Then, in the 2nd cycle of the original sheets, the copy sheets are initially sorted into the 4th, 6th, 8th, . . . bins, and then they are sorted into the 3rd, th, 7th, . . . bins after the 51st original sheet. On the other hand, if the thickness of the stacked originals does not exceed a predetermined value corresponding to 50 sheets, each original is consecutively exposed so as to prepare all the required copies in one cycle of the originals only, and the prepared copy sheets are sorted in succession into the 1st, 2nd, 3rd, 4th, 5th, . . . bins. In this manner the copying operation can be executed with a high speed and a high efficiency.

What is claimed is:

1. A copying apparatus comprising:

original support means for supporting original sheets;

original transport means for feeding said originals one by one from said original support means to an exposure unit, and, after the exposure, discharging said originals to said original support means;

circulation detecting means for detecting one circulation of the originals by said original transport means;

counting means for counting the number of the originals transported by said original transport means;

copying means for effecting exposure in said exposure unit, and copying the image of the exposed original onto a sheet;

storage means provided with plural storage units for storing sheets subjected to the copying by said copying means; and control means adapted to cause said original transport means to effect an operation of a first circulation of the originals, to cause said counting means to effect an operation of counting the number of the originals, to cause said copying means to effect an operation of copying said originals, and to cause said storage means to store the copied sheets in predetermined storage units, then to cause said original transport means to effect an operation of a second circulation of the originals, and to cause said copying means to effect an operation of copying the originals, and also adapted to vary the assignment of the storage units for storing the copied sheets according to the counting result by said counting means.

2. A copying apparatus according to claim 1, wherein said control means is adapted to vary the assignment of storage in said storage units, according to whether the result of counting by said counting means exceeds the maximum storage capacity per said storage unit or not.

3. A copying apparatus according to claim 1, wherein said storage means includes a first storage unit of which maximum storage capacity exceeds the number of the originals transportable by said original transport means, and a second storage unit of which maximum storage capacity is less than the number of the originals transportable by said original transport means, wherein the sheets copied in said first circulation of the originals are stored in said first storage unit while those copied in said second circulation of the originals are stored in said second storage unit.

4. A copying apparatus according to claim 3, wherein said storage means includes a plurality of said second storage units.

5. A copying apparatus according to claim 4, wherein said control means is adapted, in case the result of counting by said counting means does not exceed the maximum storage capacity of said second storage unit, to cause the successive copied sheets to be stored in successive storage units, and, in case said result of counting exceeds the maximum storage capacity of said second storage unit, to cause the successive copied sheets to be stored in the skipped storage units, skipping at least one storage unit therebetween.

6. An image forming system including a feeder capable of separating and feeding a stack of originals in succession to a predetermined position on a platen glass of an image forming apparatus, and, after image scanning, discharging and recycling said originals in succession, and a sorter capable of sorting copy sheets, released from said image forming apparatus into plural bins, said system comprising:

counting means for counting the number of the originals in a first circulated feeding of said originals from said feeder;

first sorting control means for storing the copy sheets, obtained corresponding to the originals fed in said first circulation, into a predetermined bin of said sorter; and second sorting control means for comparing the number of the originals counted by said counting means with a maximum storage capacity of each of said bins excluding said predetermined bin, and for sorting the sheets into plural bins so as not to exceed said maximum storage capacity, in a second or subsequent circulation of the originals.

7. An image forming system according to claim 6, wherein said second sorting control means is adapted to sort the sheets into two adjacent bins so as not to exceed said maximum storage capacity, in the second or subsequent circulation of the originals.

8. An image forming system according to claim 6, wherein said second sorting control means is adapted to sort the sheets substantially equally into two adjacent bins so as not to exceed said maximum storage capacity, in the second or subsequent circulation of the originals.

9. An image forming system according to claim 6, wherein said second sorting control means is adapted to sort the sheets, corresponding to a same original, into bins of a predetermined number, selected in skipped manner according to a selected copy number, based on the output of said counting means in the second circulation of the originals.

10. An image forming system according to claim 6, further comprising:

determination means for comparing the number of sorting bins to be used in the second or subsequent circulation of the originals with the number of total bins excluding said predetermined bin, thereby determining the number of settable originals; and correction means for automatically correcting the set copy number based on the output of said determination means.

11. A sheet handling apparatus comprising:

storage means including plural storage units for storing sheets subjected to copying of originals; and control means for causing an operation of a first circulation of the originals, an operation of counting the number of said originals, an operation of copying said originals, and an operation of storing copied sheets in a predetermined storage unit of said storage means, and then an operation of a second circulation of the originals and an operation of copying said originals, and varying the assignment of the storage units for storing the copied sheets according to the result of said counting.

12. A copying apparatus comprising:

original support means for supporting a stack of originals;

detection means for detecting the thickness of the stack of originals supported by said original support means;

original transport means for feeding the originals one by one from said original support means to an exposure unit, and, after the exposure, discharging the originals to said original support means;

copying means for effecting exposure in said exposure unit, and copying an image of each exposed original onto a sheet;

storage means provided with plural storage units for storing sheets subjected to the copying by said copying means; and control means for varying assignment of the storage units for storing the copied sheets, according to the result of detection by said detection means.

13. A copying apparatus according to claim 12, wherein said control means is adapted to vary the assignment of said storage units for sheet storage, according to whether the result of detection by said detection means exceeds a thickness corresponding to the maximum storage capacity per said storage unit or not.

14. A copying apparatus according to claim 13, wherein said control means is adapted, in case the result of detection by said detection means does not exceed a thickness corresponding to the maximum storage capacity per said storage unit, to cause the successive copied sheets to be stored in successive storage units, and, in case said result of detection by said detection means exceeds a thickness corresponding to the maximum storage capacity per said storage unit, to cause the successive copied sheets to be stored in the skipped storage units, skipping at least one storage unit therebetween.

15. A sheet handling apparatus comprising:

storage means provided with plural storage units for storing sheets subjected to copying of originals; and control means for causing an operation to detect the thickness of stacked originals and an operation to copy said originals, and adapted to vary the assignment of the storage units for sheet storage, according to the result of detection of the thickness of the stacked originals.

16. A sheet handling apparatus according to claim 15, wherein said control means is adapted to vary the assignment of said storage units for sheet storage, according to whether the result of detection exceeds a thickness corresponding to the maximum storage capacity per said storage unit or not.

17. A sheet handling apparatus according to claim 16, wherein said control means is adapted, in case the result of detection does not exceed a thickness corresponding to the maximum storage capacity per said storage unit, to cause the successive copied sheets to be stored in successive storage units, and, in case said result of detection exceeds a thickness corresponding to the maximum storage capacity per said storage unit, to cause the successive copied sheets to be stored in skipped storage units, skipping at least one storage unit therebetween.

18. An image forming system provided with an original processing device including an original tray for supporting original sheets to be subjected to image formation; detection means for detecting the approximate number of the original sheets supported on said original tray; a sheet feed path for successively separating the originals on said original tray one by one and guiding said originals to an original reading position from an end of a platen glass; and original feed/discharge means for feeding said original sheet to said original reading position through said sheet feed path, and, after original reading, discharging said original sheet from said platen glass; an image forming apparatus for effecting image formation on a fed recording medium, corresponding to said original sheet; and a sheet post-processing device for effecting a predetermined post processing on the recording media discharged from said image forming apparatus, according to plural processing modes, said system comprising:

control means for selecting and controlling process conditions of said original processing device and of said sheet post-processing device in such a manner as to shorten a process time for the original sheets, based on the approximate number of said original sheets detected by said detection means prior to the feeding of the original sheets.

19. An image forming system according to claim 18, wherein said detection means is adapted to detect the approximate number of the original sheets, based on the thickness thereof stacked on said original tray.

20. An image forming system according to claim 18, wherein said control means is adapted to select a skipped sorting mode on the sheet post-processing device, in case the detection means detects that the thickness of the original sheets stacked on the original tray exceeds a predetermined thickness.

21. An image forming system provided with an original processing device including an original tray for supporting original sheets to be subjected to image formation; detection means for detecting the approximate number of the original sheets supported on said original tray; a first sheet feed path for successively separating the original sheets on said original tray one by one and guiding the original sheets to an original reading position from an end of a platen glass; a second sheet feed path for successively separating the original sheets on said original tray one by one in a direction different from that of said first sheet feed path and guiding the original sheets to an original reading position from an end of the platen glass; and original feed/discharge means for feeding the original sheets to said original reading position through said first or second sheet feed path, and, after original reading, discharging the original sheets from said platen glass to said original tray through an original discharge path; an image forming apparatus for effecting image formation on a fed recording medium, corresponding to each of the original sheets; and a sheet post-processing device for effecting a predetermined post processing on the recording media discharged from said image forming apparatus, according to plural processing modes, said system comprising:

control means for selecting and controlling a feed path from said original processing device so as to shorten a process time for the original sheets, based on the approximate number thereof detected by said detection means prior to the feeding of the original sheets.

22. An image forming system according to claim 21, wherein said detection means is adapted to detect the approximate number of the original sheets, based on the thickness thereof stacked on the original tray.

23. An image forming system according to claim 21, wherein said control means is adapted to select the first feed path for feeding from the original tray, in case the detection means detects that the thickness of the original sheets stacked on the original tray does not exceed a predetermined thickness.

24. An image forming system according to claim 21, wherein said control means is adapted to select a skipped sorting mode on the sheet post-processing device, in case the detection means detects that the thickness of the original sheets stacked on the original tray exceeds a predetermined thickness.

* * * * *

UNITED STATES PATENT AND TRADEMARK OFFICE

CERTIFICATE OF CORRECTION

PATENT NO. : 5,455,667

DATED : October 3, 1995

INVENTOR(S) : MASAKAZU HIROI, ET AL.

It is certified that error appears in the above-indentified patent and that said Letters Patent is hereby corrected as shown below:

Column 9

Line 65, "pair." should read --pairs.--.

Column 11

Line 11, "operation-once" should read --operation once--.

Column 12

Line 58, "been-relased" should read --been released--.

Column 17

Line 55, "in" should read --In--.

Signed and Sealed this

Ninth Day of January, 1996

Bruce Lehman

*Attest:*

BRUCE LEHMAN

*Attesting Officer*

*Commissioner of Patents and Trademarks*